US012467238B2

(12) United States Patent
Onodera et al.

(10) Patent No.: US 12,467,238 B2
(45) Date of Patent: Nov. 11, 2025

(54) SHOVEL AND SHOVEL CONTROL DEVICE

(71) Applicant: SUMITOMO HEAVY INDUSTRIES, LTD., Tokyo (JP)

(72) Inventors: Masaru Onodera, Kanagawa (JP); Yusuke Sano, Kanagawa (JP); Keiji Honda, Kanagawa (JP)

(73) Assignee: SUMITOMO HEAVY INDUSTRIES, LTD., Tokyo (JP)

( * ) Notice: Subject to any disclaimer, the term of this patent is extended or adjusted under 35 U.S.C. 154(b) by 163 days.

(21) Appl. No.: 18/473,556

(22) Filed: Sep. 25, 2023

(65) Prior Publication Data

US 2024/0011252 A1 Jan. 11, 2024

Related U.S. Application Data

(63) Continuation of application No. PCT/JP2022/015207, filed on Mar. 28, 2022.

(30) Foreign Application Priority Data

Mar. 30, 2021 (JP) ..... 2021-057821
Mar. 30, 2021 (JP) ..... 2021-057895

(51) Int. Cl.
*E02F 9/26* (2006.01)
*E02F 3/32* (2006.01)
(Continued)

(52) U.S. Cl.
CPC ..... *E02F 9/262* (2013.01); *E02F 3/435* (2013.01); *E02F 3/32* (2013.01); *E02F 9/2203* (2013.01);
(Continued)

(58) Field of Classification Search
CPC ..... E02F 9/2296; E02F 9/2292; E02F 9/2285; E02F 9/2203; E02F 3/32; E02F 3/435; E02F 9/262
(Continued)

(56) References Cited

U.S. PATENT DOCUMENTS

2019/0218744 A1* 7/2019 Izumikawa ..... E02F 3/425
2019/0226181 A1* 7/2019 Imura ..... E02F 9/2221
(Continued)

FOREIGN PATENT DOCUMENTS

JP 2018-150771 9/2018
JP 2018-155077 10/2018
(Continued)

OTHER PUBLICATIONS

International Search Report for PCT/JP2022/015207 mailed on Jun. 14, 2022.

*Primary Examiner* — Yazan A Soofi
(74) *Attorney, Agent, or Firm* — IPUSA, PLLC

(57) ABSTRACT

A shovel includes a lower traveling body, an upper turning body turnably mounted on the lower traveling body, an attachment attached to the upper turning body, and an attitude detection device (a boom angle sensor, an arm angle sensor, a bucket angle sensor, a machine attitude sensor, and a turning angle sensor), and a controller configured to calculate a target angle related to a working angle formed by a plane or a line determined based on a shape of a bucket included in the attachment and a target surface. The controller changes the target angle in accordance with the attitude of the attachment and information relating to the target surface.

20 Claims, 20 Drawing Sheets

(51) Int. Cl.
*E02F 3/43* (2006.01)
*E02F 9/22* (2006.01)

(52) U.S. Cl.
CPC ..... *E02F 9/2285* (2013.01); *E02F 9/2292* (2013.01); *E02F 9/2296* (2013.01)

(58) Field of Classification Search
USPC ..... 701/50
See application file for complete search history.

(56) References Cited

U.S. PATENT DOCUMENTS

| | | | | |
|---|---|---|---|---|
| 2020/0048861 | A1* | 2/2020 | Narikawa | E02F 9/20 |
| 2020/0131731 | A1* | 4/2020 | Wu | E02F 3/439 |
| 2020/0217050 | A1* | 7/2020 | Chiba | E02F 3/435 |
| 2020/0224383 | A1* | 7/2020 | Ishida | E02F 3/435 |
| 2021/0017738 | A1* | 1/2021 | Sano | E02F 9/261 |
| 2021/0054595 | A1* | 2/2021 | Sano | E02F 9/2292 |
| 2021/0079625 | A1* | 3/2021 | Narikawa | E02F 3/435 |
| 2022/0025608 | A1* | 1/2022 | Itoh | E02F 9/2282 |

FOREIGN PATENT DOCUMENTS

| | | |
|---|---|---|
| JP | 2019-112901 | 7/2019 |
| JP | 2020-159049 | 10/2020 |
| JP | 2021-025258 | 2/2021 |
| WO | 2018/051511 | 3/2018 |
| WO | 2019/009341 | 1/2019 |

* cited by examiner

FIG.14

800

| | | | WORK SITE | | | |
|---|---|---|---|---|---|---|
| | | | No. 1 | No. 2 | No. 3 | ・・ |
| PARAMETER | A | EXCAVATION LENGTH | PA1 | PA2 | PA3 | ・・ |
| | B | EXCAVATION DEPTH | PB1 | PB2 | PB3 | ・・ |
| | C | PENETRATION ANGLE | PC1 | PC2 | PC3 | ・ |
| | D | HORIZONTAL PULLING ANGLE | PD1 | PD2 | PD3 | ・ |
| | E | SCOOPING ANGLE | PE1 | PE2 | PE3 | ・ |

SHOVEL AND SHOVEL CONTROL DEVICE

CROSS-REFERENCE TO RELATED APPLICATIONS

This application is a continuation application filed under 35 U.S.C. 111(a) claiming benefit under 35 U.S.C. 120 and 365(c) of PCT International Application No. PCT/JP2022/015207, filed on Mar. 28, 2022 and designating the U.S., which claims priority to Japanese Patent Application No. 2021-057821, filed on Mar. 30, 2021 and Japanese Patent Application No. 2021-057895, filed on Mar. 30, 2021. The entire contents of the foregoing applications are incorporated herein by reference.

BACKGROUND OF THE INVENTION

1. Field of the Invention

The present disclosure relates to a shovel as an excavator and a control device for the shovel.

2. Description of the Related Art

Conventionally, hydraulic shovels that maintain an angle of a bucket with respect to a target surface (design surface) at a constant angle during excavation work are known.

SUMMARY OF THE INVENTION

However, if the angle of the bucket with respect to the target surface is maintained at a constant angle, at a stage where a large amount of earth and sand remains on the design surface, it becomes difficult for the claw tip of the bucket to stick into the ground, and there is a possibility that smooth excavation work is hindered.

Therefore, it is desirable to provide a shovel capable of realizing smoother work.

A shovel according to an embodiment of the present includes a lower traveling body, an upper turning body turnably mounted on the lower traveling body, an attachment attached to the upper turning body, an attitude detection device configured to detect an attitude of the attachment, and a control device configured to calculate a target angle related to a work angle formed by a plane or a line determined based on a shape of a bucket included in the attachment and a target surface.

By the above-described configurations, a shovel capable of realizing smoother work is provided.

BRIEF DESCRIPTION OF THE DRAWINGS

FIG. 14 is a diagram illustrating an example of table information for parameters for each work site.

DETAILED DESCRIPTION OF THE INVENTION

Figure 1:
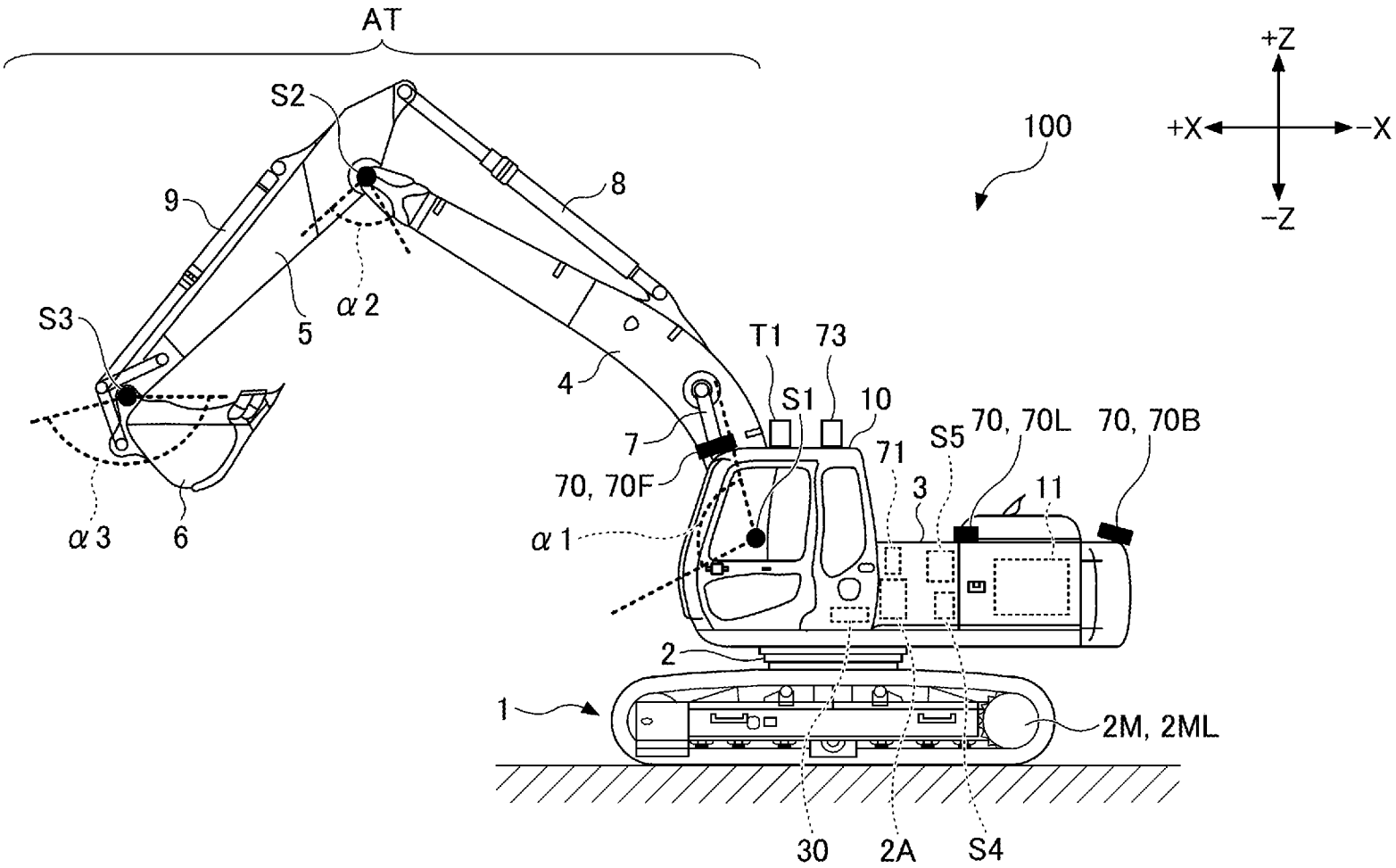
FIG. 1 is a side view of a shovel according to an embodiment of the present disclosure.
Figure 2:
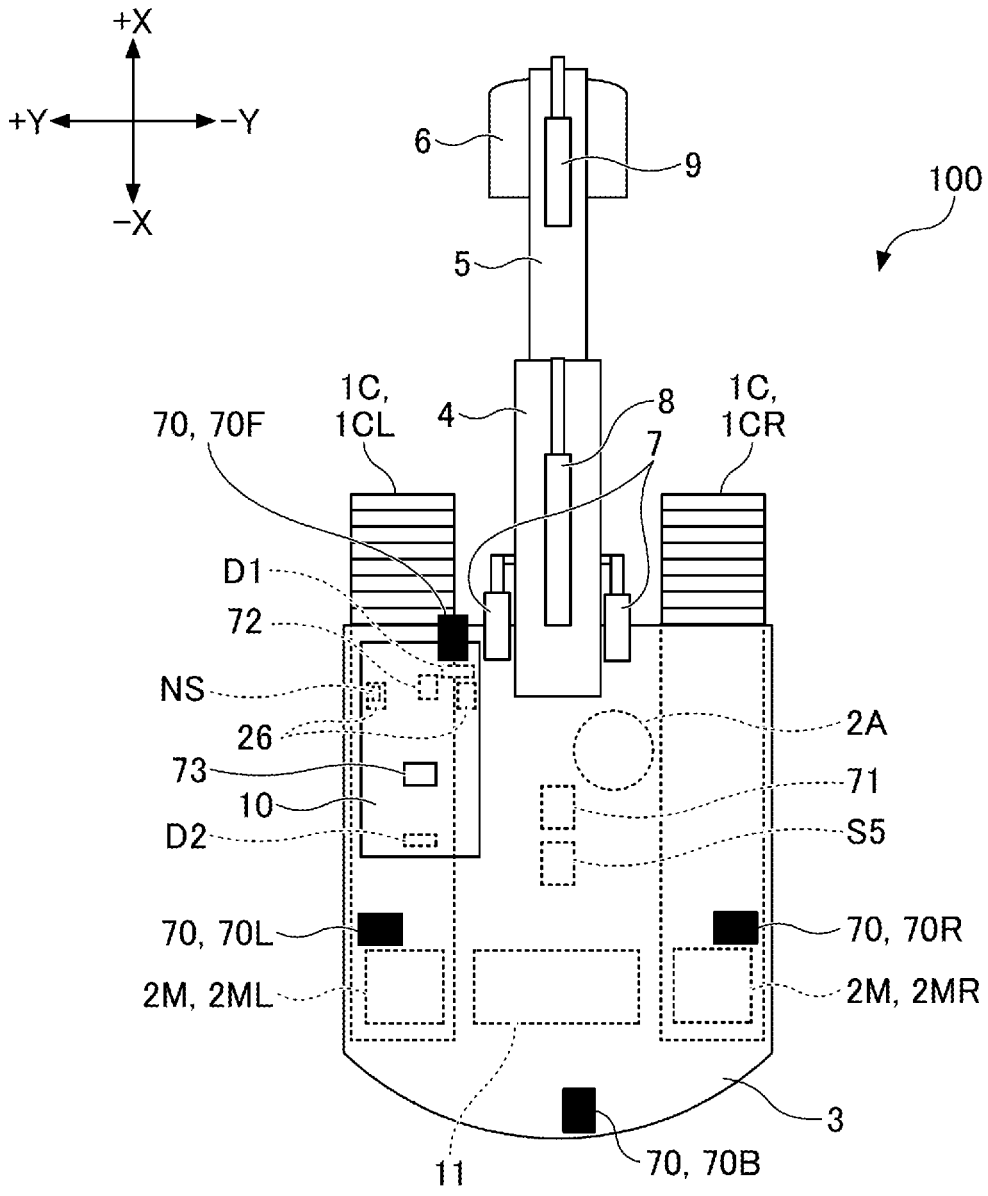
FIG. 2 is a top view of the shovel of FIG. 1.

First, a shovel 100 as an excavator according to an embodiment of the present disclosure will be described with reference to FIGS. 1 and 2. FIG. 1 is a side view of the shovel 100, and FIG. 2 is a top view of the shovel 100.

In the present embodiment, the lower traveling body 1 of the shovel 100 includes crawlers 1C. The crawlers 1C are driven by traveling hydraulic motors 2M as traveling actuators mounted on the lower traveling body 1. In particular, the crawlers 1C include a left crawler 1CL and a right crawler 1CR. The left crawler 1CL is driven by a left traveling hydraulic motor 2ML, and the right crawler 1CR is driven by a right traveling hydraulic motor 2MR.

An upper turning body 3 is turnably mounted on the lower traveling body 1 via a turning mechanism 2. The turning mechanism 2 is driven by a turning hydraulic motor 2A as a turning actuator mounted on the upper turning body 3. However, the turning actuator may be a turning motor generator as an electric actuator.

A boom 4 is attached to the upper turning body 3. An arm 5 is attached to a distal end of the boom 4, and a bucket 6 as an end attachment is attached to a distal end of the arm 5. The boom 4, the arm 5, and the bucket 6 constitute an excavation attachment which is an example of the attachment AT. The boom 4 is driven by a boom cylinder 7, the arm 5 is driven by an arm cylinder 8, and the bucket 6 is driven by a bucket cylinder 9. The boom cylinder 7, the arm cylinder 8, and the bucket cylinder 9 constitute an attachment actuator. The bucket 6 may be, for example, a slope bucket. Further, the bucket 6 may include a bucket tilt mechanism.

The boom 4 is supported so as to be vertically rotatable with respect to the upper turning body 3. A boom angle sensor S1 is attached to the boom 4. The boom angle sensor S1 can detect a boom angle α1 which is a rotation angle of the boom 4. The boom angle α1 is, for example, a rising angle from a state in which the boom 4 is most lowered. Therefore, the boom angle α1 becomes maximum when the boom 4 is lifted to the maximum.

The arm 5 is turnably supported with respect to the boom 4. An arm angle sensor S2 is attached to the arm 5. The arm angle sensor S2 can detect an arm angle α2 which is a rotation angle of the arm 5. The arm angle α2 is, for example, an opening angle from a state where the arm 5 is most closed. Therefore, the arm angle α2 becomes maximum when the arm 5 is opened most.

The bucket 6 is turnably supported with respect to the arm 5. A bucket angle sensor S3 is attached to the bucket 6. The bucket angle sensor S3 can detect a bucket angle α3 which is a rotation angle of the bucket 6. The bucket angle α3 is an opening angle of the bucket 6 from the most closed state. Therefore, the bucket angle α3 becomes maximum when the bucket 6 is most opened.

In the embodiment of FIG. 1, each of the boom angle sensor S1, the arm angle sensor S2, and the bucket angle sensor S3 is configured by a combination of an accelerometer sensor and a gyro sensor. However, each of these angle sensors may be configured by only the acceleration sensor. The boom angle sensor S1 may be a stroke sensor attached to the boom cylinder 7, or may be a rotary encoder, a potentiometer, an inertial measurement device, or the like. The same applies to the arm angle sensor S2 and the bucket angle sensor S3.

The upper turning body 3 is provided with a cabin 10 as a driver's cabin, and is mounted with a power source such as an engine 11. In addition, a space recognition device 70, a direction detection device 71, a position measuring device 73, a machine attitude sensor S4, a turning angle sensor S5, and the like are attached to the upper turning body 3. An operation device 26, a controller 30, an input device 72, a display device D1, a sound outputting device D2, and the like are provided in the cabin 10. In this specification, for the sake of convenience, a side of the upper turning body 3 to which the attachment AT is attached is referred to as a front side, and a side of the upper turning body 3 to which the counterweight is attached is referred to as a rear side.

The space recognition device 70 is configured to recognize an object present in a three-dimensional space around the shovel 100. Further, the space recognition device 70 may be configured to calculate a distance from the space recognition device 70 or the shovel 100 to the recognized object. The space recognition device 70 includes, for example, an ultrasonic sensor, a millimeter wave radar, an imaging device, a LIDAR, a distance image sensor, an infrared sensor, or the like, or any combination thereof. The imaging device is a monocular camera, a stereo camera, or the like, for example. In the present embodiment, the space recognition device 70 includes a front sensor 70F attached to the front end of the upper surface of the cabin 10, a rear sensor 70B attached to the rear end of the upper surface of the upper turning body 3, a left sensor 70L attached to the left end of the upper surface of the upper turning body 3, and a right sensor 70R attached to the right end of the upper surface of the upper turning body 3. An upper sensor that recognizes an object present in a space above the upper turning body 3 may be attached to the shovel 100.

The space recognition device 70 may be configured to be able to detect a predetermined object in a predetermined region set around the shovel 100. That is, the space recognition device 70 may be configured to be able to identify at least one of a type, a position, a shape, and the like of an object. For example, the space recognition device 70 may be configured to be able to distinguish between a person and an object other than a person. Furthermore, the space recognition device 70 may be configured to be able to specify the type of terrain around the shovel 100. The type of terrain is, for example, a ground surface, a hole, an inclined surface, a river, or the like. Furthermore, the space recognition device 70 may be configured to be able to specify the type of obstacle. The type of the obstacle is, for example, an electric wire, a utility pole, a person, an animal, a vehicle, work equipment, a construction machine, a building, a fence, or the like. Furthermore, the space recognition device 70 may be configured to be able to specify the type, size, or the like of a dump truck as a vehicle. Further, the space recognition device 70 may be configured to detect a person by recognizing a helmet, a safety vest, work clothes, or the like, or by recognizing a predetermined mark or the like on the helmet, the safety vest, the work clothes, or the like. Further, the space recognition device 70 may be configured to recognize a state of a road surface. Specifically, the space recognition device 70 may be configured to specify, for example, a type of an object present on a road surface. The types of objects present on the road surface are, for example, cigarettes, cans, PET bottles, stones, and the like. The above-described function of the space recognition device 70 may be realized by the controller 30 that receives the output of the space recognition device 70.

The direction detection device 71 is configured to detect information on a relative relationship between the direction of the upper turning body 3 and the direction of the lower traveling body 1. The direction detection device 71 may be configured by, for example, a combination of a geomagnetic sensor attached to the lower traveling body 1 and a geomagnetic sensor attached to the upper turning body 3. Alternatively, the direction detection device 71 may be configured by a combination of a GNSS receiver attached to the lower traveling body 1 and a GNSS receiver attached to the upper turning body 3. The direction detection device 71 may be a rotary encoder, a rotary position sensor, or the like, or any combination thereof. In a configuration in which the upper turning body 3 is driven to turning by the turning motor generator, the direction detection device 71 may be configured by a resolver. The direction detection device 71 may be attached to, for example, a center joint provided in association with the turning mechanism 2 that realizes the relative rotation between the lower traveling body 1 and the upper turning body 3.

The direction detection device 71 may be configured by a camera attached to the upper turning body 3. In this case, the direction detection device 71 performs known image processing on an image (input image) captured by the camera attached to the upper turning body 3 to detect an image of the lower traveling body 1 included in the input image. The direction detection device 71 detects the image of the lower traveling body 1 using a known image recognition technique, thereby specifying the longitudinal direction of the lower traveling body 1. Then, an angle formed between the direction of the longitudinal axis of the upper turning body 3 and the longitudinal direction of the lower traveling body 1 is derived. The direction of the longitudinal axis of the upper turning body 3 is derived from the mounting position of the camera. In particular, since the crawler 1C protrudes from the upper turning body 3, the direction detection device 71 can specify the longitudinal direction of the lower traveling body 1 by detecting the image of the crawler 1C. In this case, the direction detection device 71 may be integrated into the controller 30. The camera may be the space recognition device 70.

The input device 72 is configured to allow an operator of the shovel to input information to the controller 30. In the present embodiment, the input device 72 is a switch panel provided close to the display unit of the display device D1. However, the input device 72 may be a touch panel disposed on the display unit of the display device D1, or may be a voice input device such as a microphone disposed in the cabin 10. Further, the input device 72 may be a communication device that acquires information from the outside.

The position measuring device 73 is configured to measure a current position of the upper turning body 3. In the present embodiment, the position measuring device 73 is a GNSS receiver, detects the position of the upper turning body 3, and outputs the detected value to the controller 30. The position measuring device 73 may be a GNSS compass. In this case, the position measuring device 73 can detect the position and the direction of the upper turning body 3. Therefore, the position measuring device 73 also functions as the direction detection device 71.

The machine attitude sensor S4 detects an inclination of the upper turning body 3 with respect to a predetermined plane. In the present embodiment, the machine attitude sensor S4 is an accelerometer that detects an inclination angle about a longitudinal axis and an inclination angle about a lateral axis of the upper turning body 3 with respect to a horizontal plane. For example, the longitudinal axis and the lateral axis of the upper turning body 3 are orthogonal to each other and pass through a shovel center point which is a point on the pivot axis of the shovel 100.

The turning angle sensor S5 detects a turning angle of the upper turning body 3. In the present embodiment, it is a gyro sensor. It may be a resolver, a rotary encoder, or the like, or any combination thereof. The turning angle sensor S5 may detect a turning speed or a turning angular speed. The turning speed may be calculated from the turning angular speed.

Hereinafter, at least one of the boom angle sensor S1, the arm angle sensor S2, the bucket angle sensor S3, the machine attitude sensor S4, and the turning angle sensor S5 is also referred to as an attitude detection device. The attitude of the attachment AT is detected based on, for example, the outputs of the boom angle sensor S1, the arm angle sensor S2, and the bucket angle sensor S3.

The display D1 is a device that displays information. In the present embodiment, the display device D1 is a liquid crystal display installed in the cabin 10. However, the display device D1 may be a display of a mobile device such as a smartphone.

The sound outputting device D2 is a device that outputs sound. The sound outputting device D2 includes at least one of devices that outputs sound to an operator in the cabin 10 and a device that outputs sound to an operator outside the cabin 10. The sound outputting device D2 may be a speaker of a mobile terminal.

The operation device 26 is a device used by an operator to operate the actuator. The operation device 26 includes, for example, an operation lever and an operation pedal. The actuator includes at least one of a hydraulic actuator and an electric actuator.

The controller 30 is a control device for controlling the shovel 100. In the present embodiment, the controller 30 is configured by a computer including a CPU, a volatile storage device, a non-volatile storage device, and the like. Then, the controller 30 reads a program corresponding to each function from the non-volatile storage device, loads the program into the volatile storage device, and causes the CPU to execute a corresponding process. The functions include, for example, a machine guidance function that guides the operator's manual operation of the shovel 100 and a machine control function that supports the operator's manual operation of the shovel 100 or causes the shovel 100 to operate automatically or autonomously. The controller 30 may include a contact avoidance function of automatically or autonomously operating or stopping the shovel 100 in order to avoid contact between the shovel 100 and an object present in a monitoring range around the shovel 100. Monitoring of objects around the shovel 100 is performed not only within the monitoring range but also outside the monitoring range.

Figure 3:
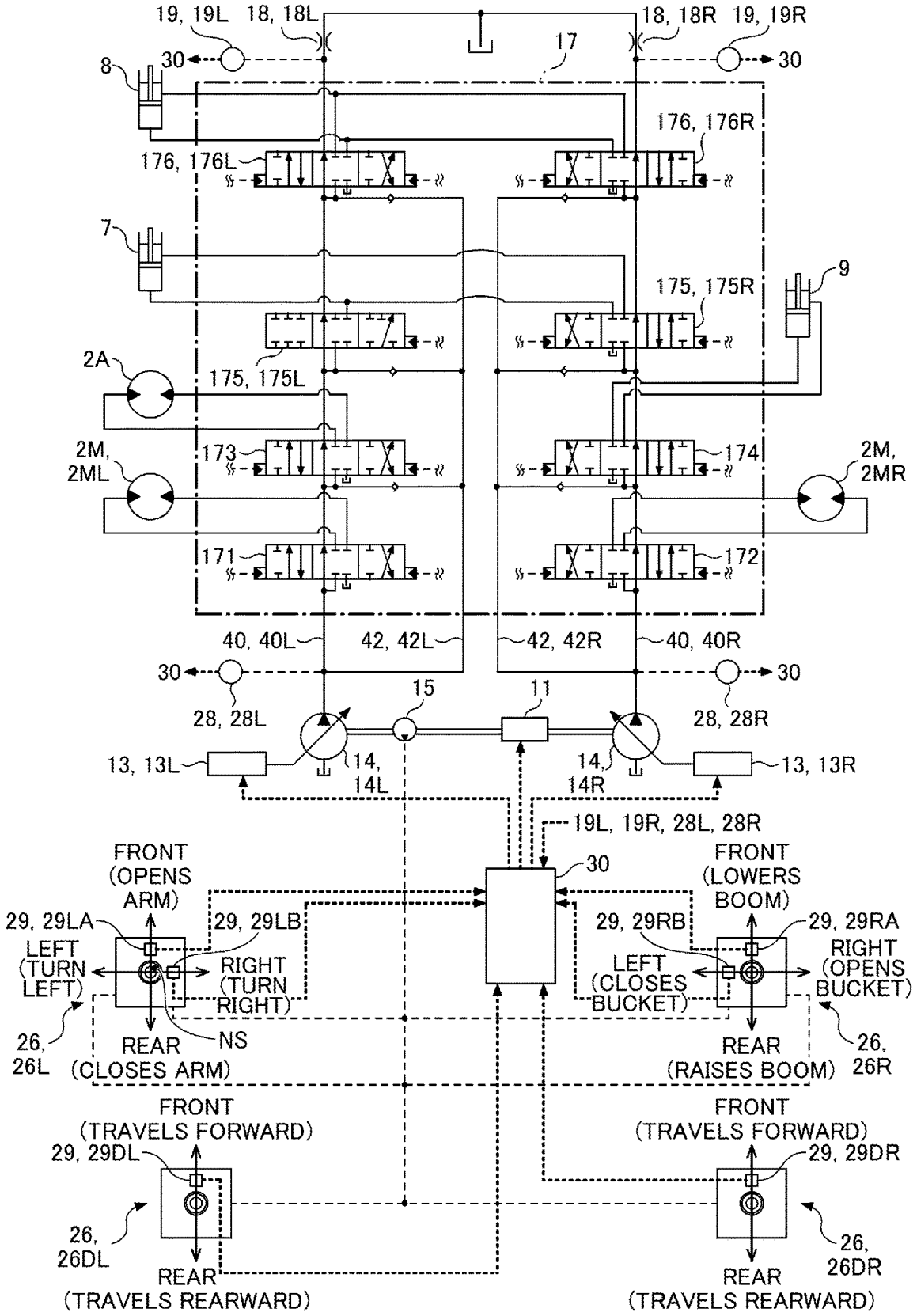
FIG. 3 is a diagram illustrating a configuration example of a hydraulic system mounted on the shovel of FIG. 1.

Next, a configuration example of a hydraulic system mounted on the shovel 100 will be described with reference to FIG. 3. FIG. 3 is a diagram illustrating a configuration example of a hydraulic system mounted on the shovel 100. FIG. 3 illustrates the mechanical drive train, hydraulic line, pilot line, and electrical control system in double, solid, dashed, and dotted lines, respectively.

The hydraulic system of the shovel 100 mainly includes an engine 11, regulators 13, main pumps 14, a pilot pump 15, a control valve unit 17, operation devices 26, discharge pressure sensors 28, operation sensors 29, a controller 30, and the like.

In FIG. 3, the hydraulic system is configured such that hydraulic oil can be circulated from the main pump 14 driven by the engine 11 to the hydraulic oil tank via the center bypass oil passage 40 or the parallel oil passage 42.

The engine 11 is a drive source of the shovel 100. In the present embodiment, the engine 11 is, for example, a diesel engine that operates to maintain a predetermined rotational speed. An output shaft of the engine 11 is coupled to respective input shafts of the main pump 14 and the pilot pump 15.

The main pump 14 is configured to supply hydraulic oil to the control valve unit 17 via hydraulic oil lines. In the present embodiment, the main pumps 14 are swash plate type variable displacement hydraulic pumps.

The regulators 13 are configured to be able to control the discharge amount of the main pumps 14. In the present embodiment, the regulators 13 control the discharge amount of the main pumps 14 by adjusting the swash plate tilt angle of the main pumps 14 in response to a control command from the controller 30.

The pilot pump 15 is an example of a pilot pressure generating device, and is configured to supply hydraulic oil to the hydraulic control device via pilot lines. In the present embodiment, the pilot pump 15 is a fixed displacement hydraulic pump. However, the pilot pressure generating device may be realized by the main pumps 14. That is, the main pumps 14 may have a function of supplying hydraulic oil to various hydraulic control devices via the pilot lines in addition to a function of supplying hydraulic oil to the control valve unit 17 via the hydraulic oil lines. In this case, the pilot pump 15 may be omitted.

The control valve unit 17 is a hydraulic control device that controls a hydraulic system in the shovel 100. In the present embodiment, the control valve unit 17 includes the control valves 171 to 176. The control valve 175 includes a control valve 175L and a control valve 175R, and the control valve 176 includes a control valve 176L and a control valve 176R. The control valve unit 17 is configured to selectively supply the hydraulic oil discharged by the main pumps 14 to one or a plurality of hydraulic actuators through the control valves 171 to 176. The control valves 171 to 176 control, for example, the flow rate of the hydraulic oil flowing from the main pump 14 to the hydraulic actuator and the flow rate of the hydraulic oil flowing from the hydraulic actuator to the hydraulic oil tank. The hydraulic actuators include a boom cylinder 7, an arm cylinder 8, a bucket cylinder 9, a left traveling hydraulic motor 2ML, a right traveling hydraulic motor 2MR, and a turning hydraulic motor 2A.

The operation devices 26 are configured so that an operator can operate the actuators. In the present embodiment, the operation device 26 includes a hydraulic actuator operation device configured to allow an operator to operate a hydraulic actuator. Specifically, the hydraulic actuator operation device is configured such that the hydraulic oil discharged by the pilot pump 15 can be supplied to the pilot ports of the corresponding control valves in the control valve unit 17 via the pilot lines. The pressure (pilot pressure) of the hydraulic oil supplied to each of the pilot ports is a pressure corresponding to the operation direction and the operation amount of the operation device 26 corresponding to each of the hydraulic actuators.

The discharge pressure sensors 28 are configured to be able to detect the discharge pressure of the main pump 14. In the present embodiment, the discharge pressure sensors 28 output the detected value to the controller 30.

The operation sensors 29 are configured to be able to detect contents of an operation of the operation device 26 by the operator. In the present embodiment, the operation sensors 29 electrically detect an operation direction and an operation amount of the operation device 26 corresponding to each of the actuators, and outputs the detected values to the controller 30.

The main pumps 14 include a left main pump 14L and a right main pump 14R. The left main pump 14L circulates hydraulic oil to a hydraulic oil tank via a left center bypass oil passage 40L or a left parallel oil passage 42L, and a right main pump 14R circulates the working oil to the hydraulic oil tank via a right center bypass oil passage 40R or a right parallel oil passage 42R.

The left center bypass oil passage 40L is a hydraulic oil line passing through the control valves 171, 173, 175L, and 176L disposed in the control valve unit 17. The right center bypass oil passage 40R is a hydraulic oil line passing through the control valves 172, 174, 175R, and 176R disposed in the control valve unit 17.

The control valve 171 is a spool valve that switches the flow of the hydraulic oil in order to supply the hydraulic oil discharged by the left main pump 14L to the left traveling hydraulic motor 2ML and discharge the hydraulic oil discharged by the left traveling hydraulic motor 2ML to the hydraulic oil tank.

The control valve 172 is a spool valve that switches the flow of the hydraulic oil in order to supply the hydraulic oil discharged by the right main pump 14R to the right traveling hydraulic motor 2MR and discharge the hydraulic oil discharged by the right traveling hydraulic motor 2MR to the hydraulic oil tank.

The control valve 173 is a spool valve that switches the flow of the hydraulic oil in order to supply the hydraulic oil discharged by the left main pump 14L to the turning hydraulic motor 2A and discharge the hydraulic fluid discharged by the turning hydraulic motor 2A to the hydraulic oil tank.

The control valve 174 is a spool valve that switches the flow of the hydraulic fluid in order to supply the hydraulic oil discharged by the right main pump 14R to the bucket cylinder 9 and discharge the hydraulic fluid in the bucket cylinder 9 to the hydraulic oil tank.

The control valve 175L is a spool valve that switches the flow of the hydraulic oil in order to supply the hydraulic oil discharged by the left main pump 14L to the boom cylinder 7. The control valve 175R is a spool valve that switches the flow of the hydraulic oil in order to supply the hydraulic fluid discharged by the right main pump 14R to the boom cylinder 7 and discharge the hydraulic oil in the boom cylinder 7 to the hydraulic oil tank.

The control valve 176L is a spool valve that switches the flow of the hydraulic oil in order to supply the hydraulic oil discharged by the left main pump 14L to the arm cylinder 8 and discharge the hydraulic oil in the arm cylinder 8 to the hydraulic oil tank.

The control valve 176R is a spool value that switches the flow of the hydraulic fluid in order to supply the hydraulic oil discharged by the right main pump 14R to the arm cylinder 8 and discharge the hydraulic oil in the arm cylinder 8 to the hydraulic oil tank.

The left parallel oil passage 42L is a working oil line parallel to the left center bypass oil passage 40L. When the flow of the hydraulic fluid passing through the left center bypass oil passage 42L is limited or blocked by any one of the control valves 171, 173, and 175L, the left parallel oil passage 40L can supply the hydraulic oil to the control valve further downstream. The right parallel oil passage 42R is a working oil line parallel to the right center bypass oil passage 40R. When the flow of the hydraulic fluid passing through the right center bypass oil passage 40R is limited or blocked by any one of the control valves 172, 174, and 175R, the right parallel oil passage 42R can supply the hydraulic oil to the control valve further downstream.

The regulators 13 include a left regulator 13L and a right regulator 13R. The left regulator 13L controls the discharge amount of the left main pump 14L by adjusting the swash plate tilt angle of the left main pump 14L in accordance with the discharge pressure of the left main pump 14L. For example, the left regulator 13L reduces the discharge amount by adjusting the swash plate tilt angle of the left main pump 14L in accordance with an increase in the discharge pressure of the left main pump 14L. The same applies to the right regulator 13R. This is to prevent the absorption power (absorption horsepower) of the main pump 14 represented by the product of the discharge pressure and the discharge amount from exceeding the output power (output horsepower) of the engine 11.

The operation devices 26 include a left operation lever 26L, a right operation lever 26R, and a traveling lever 26D. The traveling lever 26D includes a left traveling lever 26DL and a right traveling lever 26DR.

The left operation lever 26L is used for the turning operation and the operation of the arm 5. When the left operation lever 26L is operated in the front-rear direction, the control pressure corresponding to the lever operation amount is introduced into the pilot port of the control valves 176 by using the hydraulic fluid discharged by the pilot pump 15. When the left operation lever 26L is operated in the left-right direction, the control pressure corresponding to the lever operation amount is introduced into the pilot port of the control valve 173 by using the hydraulic oil discharged from the pilot pump 15.

To be more specific, when the left operation lever 26L is operated in the arm closing direction, the operating oil is introduced into the right pilot port of the control valve 176L and the operating oil is introduced into the left pilot port of the control valve 176R. When the left operation lever 26L is operated in the arm opening direction, the operating oil is introduced into the left pilot port of the control valve 176L and the operating oil is introduced into the right pilot port of the control valve 176R. When the left operation lever 26L is operated in the left turning direction, the hydraulic oil is introduced into the left pilot port of the control valve 173, and when the left operation lever 26L is operated in the right turning direction, the hydraulic oil is introduced into the right pilot port of the control valve 173.

The right operation lever 26R is used to operate the boom 4 and the bucket 6. When the right operation lever 26R is operated in the front-rear direction, the control pressure corresponding to the lever operation amount is introduced into the pilot ports of the control valves 175 using the hydraulic oil discharged by the pilot pump 15. When the right operation lever 26R is operated in the left-right direction, the control pressure corresponding to the lever operation amount is introduced into the pilot port of the control valve 174 by using the hydraulic oil discharged from the pilot pump 15.

To be specific, when the right operation lever 26R is operated in the boom lowering direction, the hydraulic oil is introduced into the left pilot port of the control valve 175R. When the right operation lever 26R is operated in the boom raising direction, the hydraulic oil is introduced into the right pilot port of the control valve 175L and the hydraulic oil is introduced into the left pilot port of the control valve 175R. Further, when the right operation lever 26R is operated in the bucket closing direction, the hydraulic oil is introduced into the right pilot port of the control valve 174, and when the right operation lever 26R is operated in the bucket opening direction, the hydraulic oil is introduced into the left pilot port of the control valve 174.

The traveling lever 26D is used to operate the crawler 1C. Specifically, the left traveling lever 26DL is used to operate the left crawler 1CL. The traveling lever 26D may be configured to be interlocked with the left traveling pedal. When the left traveling lever 26DL is operated in the front-rear direction, the control pressure corresponding to the lever operation amount is introduced into the pilot port of the control valve 171 using the hydraulic oil discharged by the pilot pump 15. The right traveling lever 26DR is used to operate the right crawler 1CR. The right traveling lever 26DR may be configured to be interlocked with the right traveling pedal. When the right traveling lever 26DR is operated in the front-rear direction, the control pressure corresponding to the lever operation amount is introduced into the pilot port of the control valve 172 using the hydraulic oil discharged by the pilot pump 15.

The discharge pressure sensors 28 include a left discharge pressure sensor 28L and a right discharge pressure sensor 28R. The left discharge pressure sensor 28L detects the discharge pressure of the left main pump 14L and outputs the detected value to the controller 30. The same applies to the right discharge pressure sensor 28R.

The operation sensors 29 include operation sensors 29LA, 29LB, 29RA, 29RB, 29DL, and 29DR. The operation sensor 29LA electrically detects the content of an operation performed by an operator on the left operation lever 26L in the front-rear direction and outputs the detected value to the controller 30. The content of the operation is, for example, a lever operation direction, a lever operation amount (lever operation angle), or the like.

Similarly, the operation sensor 29LB electrically detects the content of an operation performed by the operator on the left operation lever 26L in the left-right direction, and outputs the detected value to the controller 30. The operation sensor 29RA electrically detects the content of an operation performed by the operator on the right operation lever 26R in the front-rear direction, and outputs the detected value to the controller 30. The operation sensor 29RB electrically detects the content of an operation performed by the operator on the right operation lever 26R in the left-right direction, and outputs the detected value to the controller 30. The operation sensor 29DL electrically detects the content of an operation performed by the operator on the left traveling lever 26DL in the front-rear direction, and outputs the detected value to the controller 30. The operation sensor 29DR electrically detects the content of an operation performed by the operator on the right traveling lever 26DR in the front-rear direction, and outputs the detected value to the controller 30.

The controller 30 receives the output of the operation sensor 29, outputs a control command to the regulator 13 as necessary, and changes the discharge amount of the main pump 14. Further, the controller 30 receives an output of a control pressure sensor 19 provided upstream of the throttle 18, outputs a control command to the regulator 13 as necessary, and changes the discharge amount of the main pump 14. The throttle 18 includes a left throttle 18L and a right throttle 18R, and the control pressure sensor 19 includes a left control pressure sensor 19L and a right control pressure sensor 19R.

In the left center bypass oil passage 40L, the left throttle 18L is disposed between the most downstream control valve 176L and the hydraulic oil tank. Therefore, the flow of the hydraulic oil discharged by the left main pump 14L is limited by the left throttle 18L. The left throttle 18L generates a control pressure for controlling the left regulator 13L. The left control pressure sensor 19L is a sensor for detecting the control pressure, and outputs the detected value to the controller 30. The controller 30 controls the discharge amount of the left main pump 14L by adjusting the swash plate tilt angle of the left main pump 14L in accordance with the control pressure. The controller 30 decreases the discharge amount of the left main pump 14L as the control pressure increases, and increases the discharge amount of the left main pump 14L as the control pressure decreases. The discharge amount of the right main pump 14R is also controlled in the same manner.

To be more specific, as illustrated in FIG. 3, in the case of a standby state in which none of the hydraulic actuators in the shovel 100 is operated, the hydraulic fluid discharged from the left main pump 14L passes through the left center bypass oil passage 40L and reaches the left throttle 18L. The flow of the working oil discharged by the left main pump 14L increases the control pressure generated upstream of the left throttle 18L. As a result, the controller 30 reduces the discharge amount of the left main pump 14L to the allowable minimum discharge amount, and suppresses the pressure loss (pumping loss) when the discharged working oil passes through the left center bypass oil passage 40L. On the other hand, when any of the hydraulic actuators is operated, the working oil discharged by the left main pump 14L flows into the hydraulic actuators to be operated via the control valves corresponding to the hydraulic actuators to be operated. Then, the flow of the working oil discharged by the left main pump 14L reduces or eliminates the amount of the working oil reaching the left throttle 18L, thereby reducing the control pressure generated upstream of the left throttle 18L.

As a result, the controller 30 increases the discharge amount of the left main pump 14L to circulate a sufficient amount of working oil to the hydraulic actuators to be operated, thereby ensuring the driving of the hydraulic actuators to be operated. The controller 30 controls the discharge amount of the right main pump 14R in the same manner.

With the above-described configuration, the hydraulic system of FIG. 3 can suppress wasteful energy consumption in the main pump 14 in the standby state. The wasteful energy consumption includes a pumping loss generated in the center bypass oil passage 40 by the hydraulic oil discharged by the main pump 14. In addition, in the hydraulic system of FIG. 3, when the hydraulic actuator is operated, a necessary and sufficient amount of hydraulic oil can be reliably supplied from the main pump 14 to the hydraulic actuators to be operated.

Figure 4A:
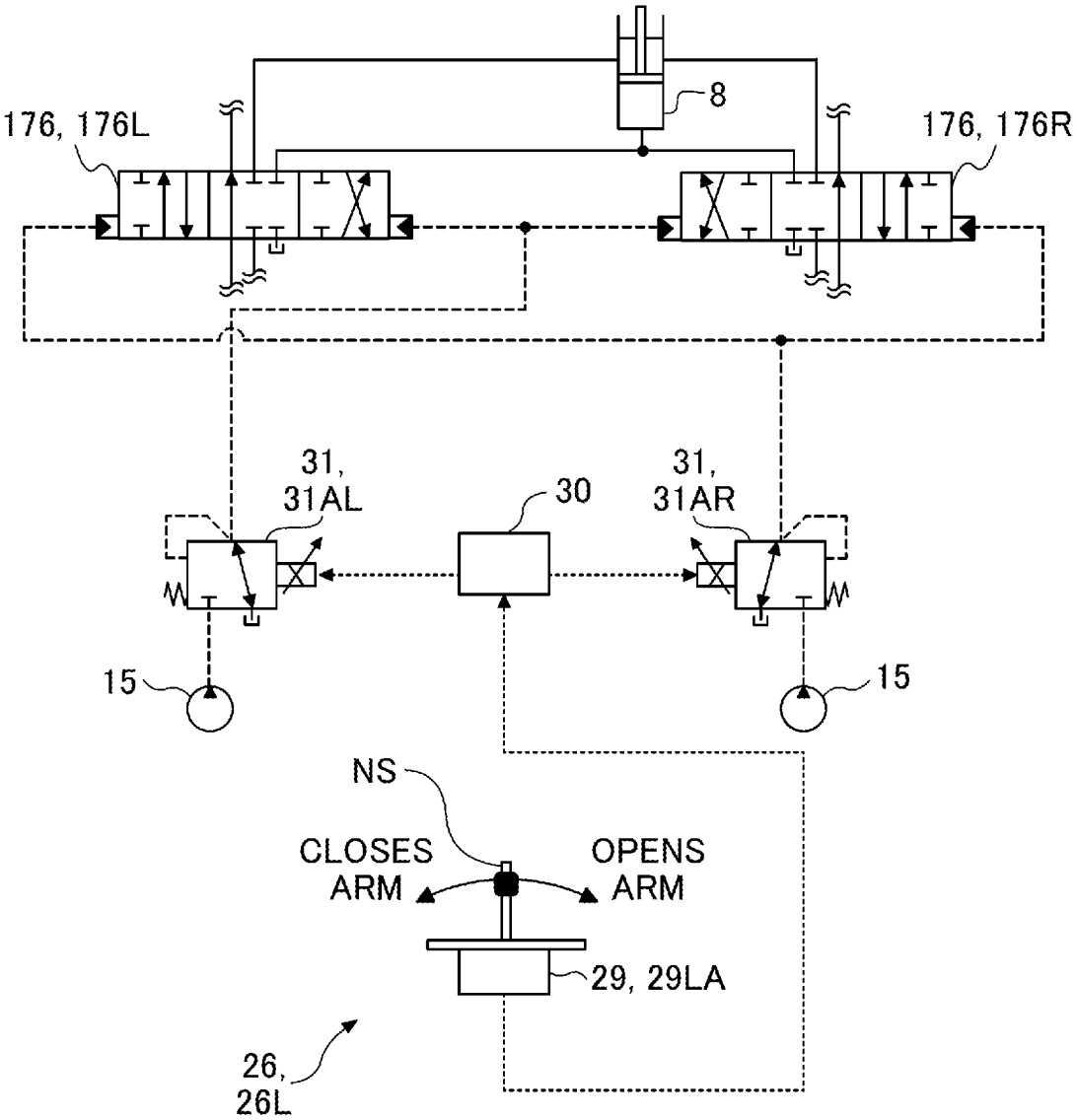
FIG. 4A is a view of a portion of a hydraulic system for an operation of an arm cylinder.
Figure 4B:
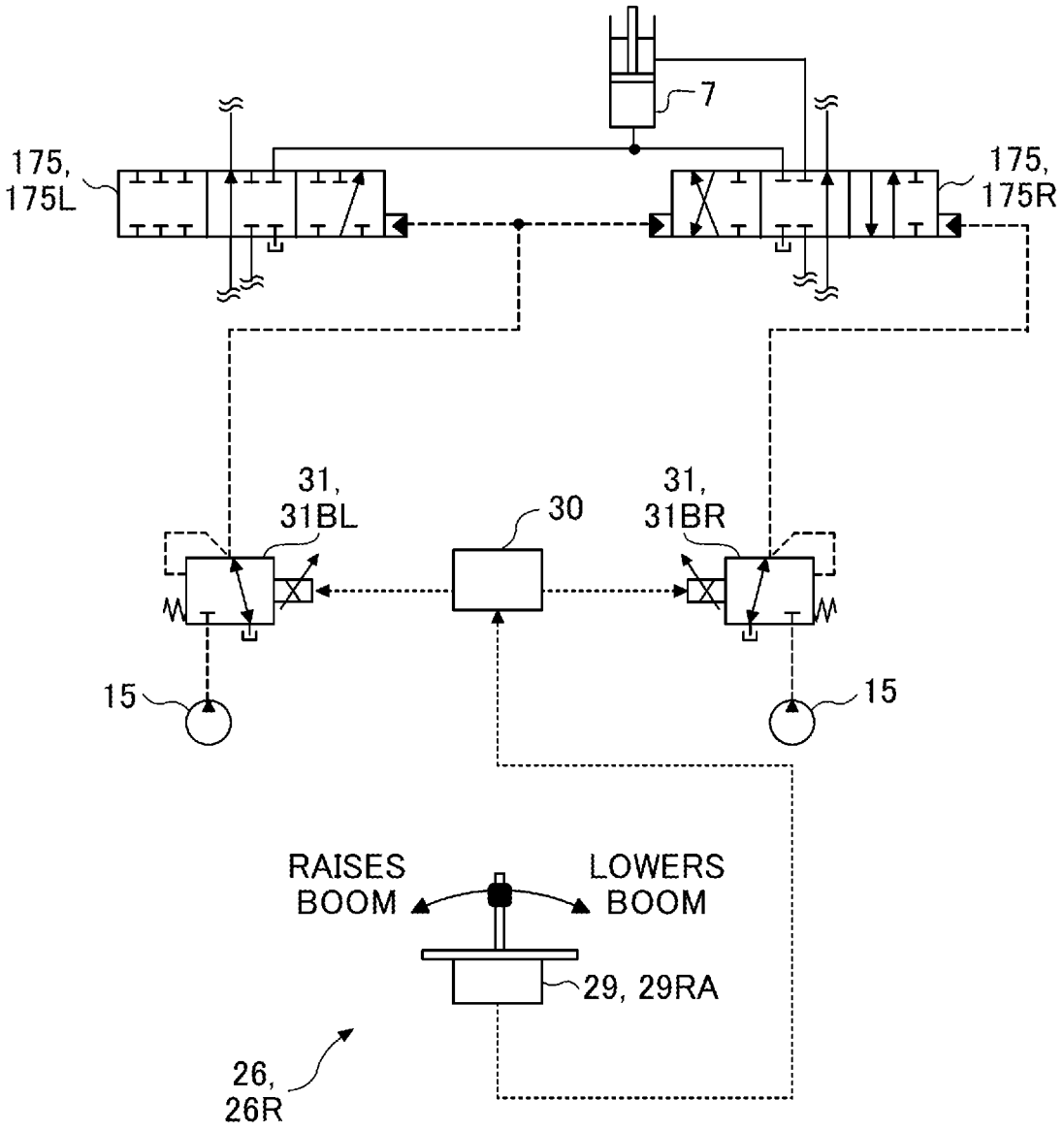
FIG. 4B is a view of a portion of a hydraulic system for a boom cylinder.
Figure 4C:
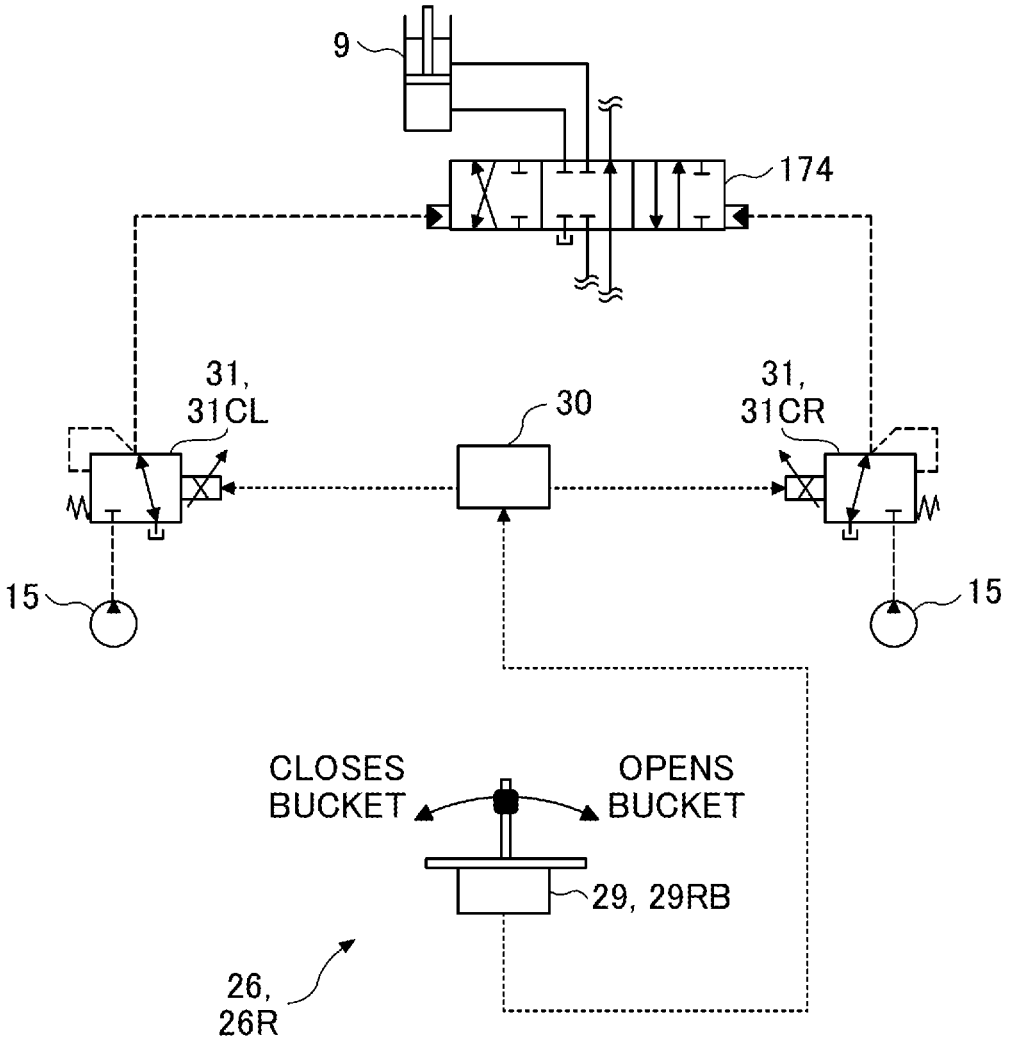
FIG. 4C is a view of a portion of a hydraulic system for a bucket cylinder.
Figure 4D:
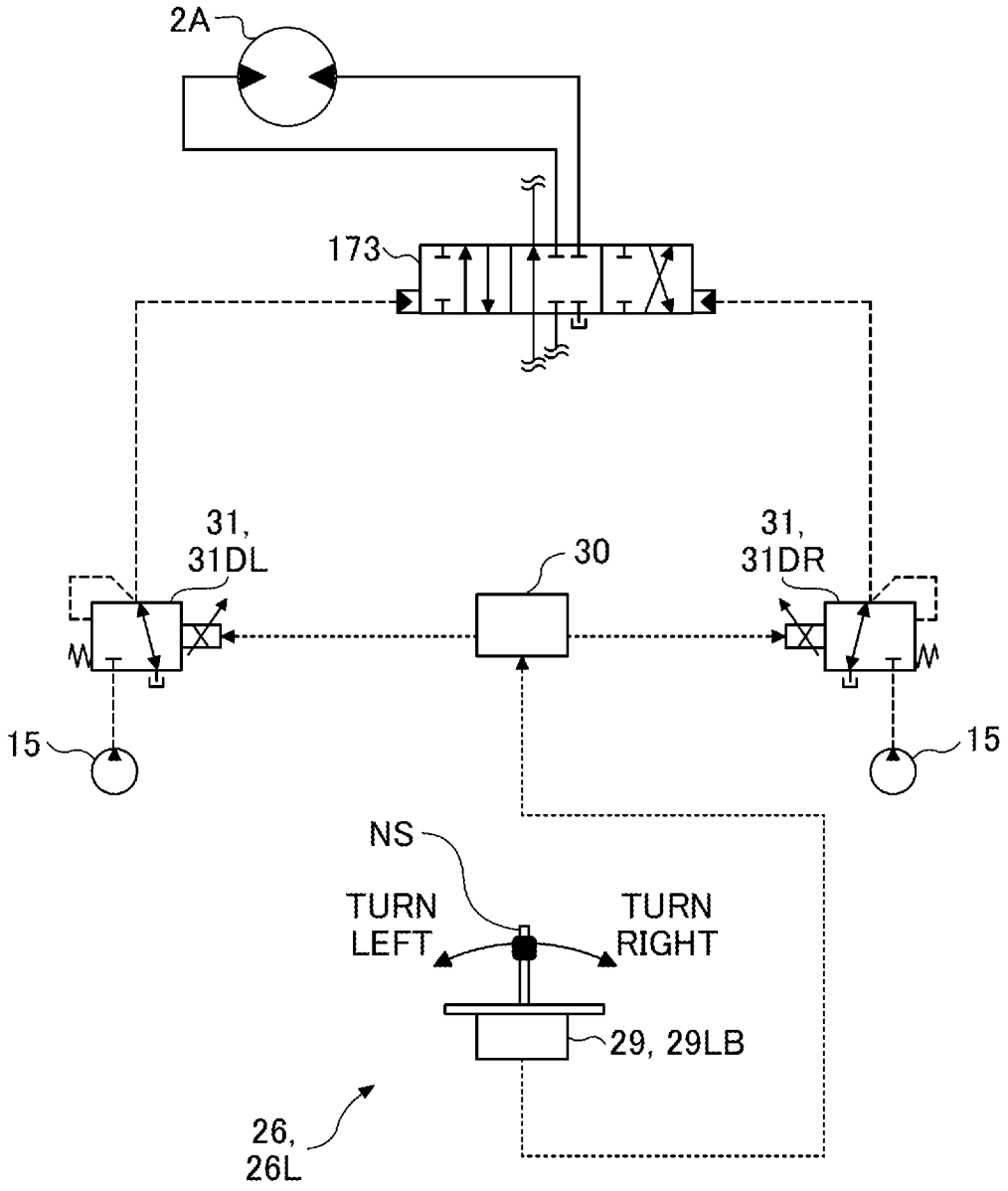
FIG. 4D is a view of a portion of a hydraulic system for a traveling hydraulic motor.

Next, a configuration in which the controller 30 operates the actuators by the machine control function will be described with reference to FIGS. 4A to 4D. FIGS. 4A to 4D are diagrams in which a part of the hydraulic system is extracted. To be specific, FIG. 4A is a diagram in which a hydraulic system portion related to the operation of the arm cylinder 8 is extracted, and FIG. 4B is a diagram in which a hydraulic system portion related to the operation of the boom cylinder 7 is extracted. FIG. 4C is a diagram in which a hydraulic system portion related to the operation of the bucket cylinder 9 is extracted, and FIG. 4D is a diagram in which a hydraulic system portion related to the operation of the turning hydraulic motor 2A is extracted.

As illustrated in FIGS. 4A to 4D, the hydraulic system includes proportional valves 31. The proportional valves 31 include proportional valves 31AL to 31DL and 31AR to 31DR.

The proportional valves 31 function as control valves for machine control. The proportional valves 31 are disposed in oil passages connecting the pilot pump 15 and pilot ports of corresponding control valves in the control valve unit 17, and are configured to be able to change a flow passage area of the oil passages. In the present embodiment, the proportional valves 31 operate in response to a control command output from the controller 30. Therefore, the controller 30 can supply the hydraulic oil discharged by the pilot pump 15 to the pilot port of the corresponding control valve in the control valve unit 17 via the proportional valves 31 regardless of the operation of the operation device 26 by the operator. Then, the controller 30 can apply the pilot pressure generated by the proportional valves 31 to the pilot port of the corresponding control valves.

With this configuration, even when a specific operation device 26 is not operated, the controller 30 can operate the hydraulic actuator corresponding to the specific operation device 26. In addition, even when a specific operation device 26 is operated, the controller 30 can forcibly stop the operation of the hydraulic actuator corresponding to the specific operation device 26.

For example, as illustrated in FIG. 4A, the left operation lever 26L is used to operate the arm 5. To be specific, the left operation lever 26L uses the hydraulic oil discharged by the pilot pump 15 to apply the pilot pressure corresponding to the operation in the front-rear direction to the pilot port of the control valve 176. To be more specific, when the left operation lever 26L is operated in the arm closing direction (rearward direction), the left operation lever 26L causes the pilot pressure corresponding to the operation amount to act on the right pilot port of the control valve 176L and the left pilot port of the control valve 176R. When the left control lever 26L is operated in the arm opening direction (forward direction), pilot pressure corresponding to the operation amount is applied to the left pilot port of control valve 176L and the right pilot port of control valve 176R.

A switch NS is provided on the left operation lever 26L. In the present embodiment, the switch NS is a push button switch provided at the tip of the left operation lever 26L. An operator can operate the left operation lever 26L while pressing the switch NS. The switch NS may be provided on the right operation lever 26R or may be provided at another position in the cabin 10.

The operation sensor 29LA detects the content of an operation performed by the operator on the left operation lever 26L in the front-rear direction and outputs the detected value to the controller 30.

The proportional valve 31AL operates in response to a control command (current command) output from the controller 30. The proportional valve 31AL adjusts the pilot pressure of the hydraulic oil introduced from the pilot pump 15 to the right pilot port of the control valve 176L and the left pilot port of the control valve 176R via the proportional valve 31AL. The proportional valve 31AR operates in response to a current command output from the controller 30. The proportional valve 31AR adjusts the pilot pressure of the hydraulic oil introduced from the pilot pump 15 to the left pilot port of the control valve 176L and the right pilot port of the control valve 176R via the proportional valve 31AR. The proportional valve 31AL can adjust the pilot pressure so that the control valves 176L and 176R can be stopped at arbitrary positions. In the similar manner, the proportional valve 31AR can adjust the pilot pressure so that the control valves 176L and 176R can be stopped at arbitrary positions.

With this configuration, the controller 30 can supply the hydraulic oil discharged from the pilot pump 15 to the right pilot port of the control valve 176L and the left pilot port of the control valve 176R via the proportional valve 31AL in response to the arm closing operation by the operator. In addition, the controller 30 can supply the hydraulic oil discharged from the pilot pump 15 to the right pilot port of the control valve 176L and the left pilot port of the control valve 176R via the proportional valve 31AL regardless of the arm closing operation by the operator. That is, the controller 30 can close the arm in response to the arm closing operation by the operator or independently of the arm closing operation by the operator.

In addition, the controller 30 can supply the hydraulic oil discharged from the pilot pump 15 to the left pilot port of the control valve 176L and the right pilot port of the control valve 176R via the proportional valve 31AR in response to the arm opening operation by the operator. Further, the controller 30 can supply the hydraulic oil discharged from the pilot pump 15 to the left pilot port of the control valve 176L and the right pilot port of the control valve 176R via the proportional valve 31AR regardless of the arm opening operation by the operator. That is, the controller 30 can open the arm 5 in response to the arm opening operation by the operator or independently of the arm opening operation by the operator.

With this configuration, even when the operator performs the arm closing operation, the controller 30 can forcibly stop the closing operation of the arm 5 by reducing the pilot pressure acting on the pilot port on the closing side of the control valve 176 (the left pilot port of the control valve 176L and the right pilot port of the control valve 176R) as necessary. The same applies to a case where the opening operation of the arm 5 is forcibly stopped when the operator performs the arm opening operation.

Alternatively, even when the operator performs the arm closing operation, the controller 30 may forcibly stop the closing operation of the arm 5 by controlling the proportional valves 31AR as necessary to increase the pilot pressures acting on the pilot ports (the right pilot port of the control valve 176L and the left pilot port of the control valve 176R) on the opening side of the control valve 176 on the opposite side of the pilot port on the closing side of the control valve 176 and forcibly returning the control valve 176 to the neutral position. The same applies to a case where the opening operation of the arm 5 is forcibly stopped when the operator performs the arm opening operation.

Although description with reference to the following FIGS. 4B to 4D is omitted, the same applies to a case where the operation of the boom 4 is forcibly stopped when the operator performs the boom raising operation or the boom lowering operation, a case where the operation of the bucket 6 is forcibly stopped when the operator performs the bucket closing operation or the bucket opening operation, and a case where the turning operation of the upper turning body 3 is forcibly stopped when the operator performs the turning operation. The same applies to a case where the traveling operation of the lower traveling body 1 is forcibly stopped when the traveling operation is performed by the operator.

As illustrated in FIG. 4B, the right operation lever 26R is used to operate the boom 4. To be more specific, the right operation lever 26R applies a pilot pressure corresponding to the operation in the front-rear direction to the pilot port of the control valve 175 using the hydraulic oil discharged by the pilot pump 15. To be more specific, when the right operation lever 26R is operated in the boom raising direction (rearward direction), the pilot pressure corresponding to the operation amount is applied to the right pilot port of the control valve 175L and the left pilot port of the control valve 175R. When the right operation lever 26R is operated in the boom lowering direction (forward direction), the pilot pressure corresponding to the operation amount is applied to the right pilot port of the control valve 175R.

The operation sensor 29RA detects the content of an operation performed by the operator on the right operation lever 26R in the front-rear direction, and outputs the detected value to the controller 30.

The proportional valve 31BL operates in response to a control command (current command) output from the controller 30. The proportional valve 31BL adjusts the pilot pressure of the hydraulic oil introduced from the pilot pump 15 to the right pilot port of the control valve 175L and the left pilot port of the control valve 175R via the proportional valve 31BL. The proportional valve 31BR operates in response to a control command (current command) output from the controller 30. The proportional valve 31BR adjusts the pilot pressure of the hydraulic oil introduced from the pilot pump 15 to the right pilot port of the control valve 175R via the proportional valve 31BR. The proportional valves 31BL can adjust the pilot pressure so that the control valves 175L and 175R can be stopped at arbitrary positions. Furthermore, the proportional valve 31BR can adjust the pilot pressure so that the control valve 175R can be stopped at arbitrary positions.

With this configuration, the controller 30 can supply the hydraulic oil discharged from the pilot pump 15 to the right pilot port of the control valve 175L and the left pilot port of the control valve 175R via the proportional valve 31BL in response to the boom raising operation by the operator. Further, the controller 30 can supply the hydraulic oil discharged from the pilot pump 15 to the right pilot port of the control valve 175L and the left pilot port of the control valve 175R via the proportional valve 31LB regardless of the boom raising operation by the operator. That is, the controller 30 can raise the boom 4 in response to the boom raising operation by the operator or independently of the boom raising operation by the operator.

Further, the controller 30 can supply the hydraulic oil discharged from the pilot pump 15 to the right pilot port of the control valve 175R via the proportional valve 31BR in response to the boom lowering operation by the operator. Further, the controller 30 can supply the hydraulic oil discharged from the pilot pump 15 to the right pilot port of the control valve 175R via the proportional valve 31BR regardless of the boom lowering operation by the operator. That is, the controller 30 can lower the boom 4 in response to the boom lowering operation by the operator or independently of the boom lowering operation by the operator.

As illustrated in FIG. 4C, the right operation lever 26R is also used to operate the bucket 6. To be specific, the right operation lever 26R uses the hydraulic oil discharged by the pilot pump 15 to apply the pilot pressure corresponding to the operation in the left-right direction to the pilot port of the control valve 174. To be more specific, when right operation lever 26R is operated in the bucket closing direction (left direction), the right operation lever 26R applies a pilot pressure corresponding to the operation amount to the left pilot port of control valve 174. In addition, when the right operation lever 26R is operated in the bucket opening direction (right direction), the pilot pressure corresponding to the operation amount is applied to the right pilot port of the control valve 174.

The operation sensor 29RB detects the content of an operation performed by the operator on the right operation lever 26R in the left-right direction, and outputs the detected value to the controller 30.

The proportional valve 31CL operates in response to a control command (current command) output from the controller 30. Then, the pilot pressure of the hydraulic oil introduced from the pilot pump 15 to the left pilot port of the control valve 174 via the proportional valve 31CL is adjusted. The proportional valve 31CR operates in response to a control command (current command) output from the controller 30. Then, the pilot pressure of the hydraulic oil introduced from the pilot pump 15 to the right pilot port of the control valve 174 via the proportional valve 31CR is adjusted. The proportional valve 31CL can adjust the pilot pressure so that the control valve 174 can be stopped at an arbitrary position. Similarly, the proportional valve 31CR can adjust the pilot pressure so that the control valve 174 can be stopped at an arbitrary position.

With this configuration, the controller 30 can supply the hydraulic oil discharged from the pilot pump 15 to the left pilot port of the control valve 174 via the proportional valve 31CL in response to the bucket closing operation by the operator. In addition, the controller 30 can supply the hydraulic oil discharged from the pilot pump 15 to the left pilot port of the control valve 174 via the proportional valve 31CL regardless of the bucket closing operation by the operator. That is, the controller 30 can close the bucket 6 in response to the bucket closing operation by the operator or independently of the bucket closing operation by the operator.

Further, the controller 30 can supply the hydraulic oil discharged from the pilot pump 15 to the right pilot port of the control valve 174 via the proportional valve 31CR in response to the bucket opening operation by the operator. Further, the controller 30 can supply the hydraulic oil discharged from the pilot pump 15 to the right pilot port of the control valve 174 via the proportional valve 31CR regardless of the bucket opening operation by the operator. That is, the controller 30 can open the bucket 6 in response to the bucket opening operation by the operator or independently of the bucket opening operation by the operator.

As illustrated in FIG. 4D, the left operation lever 26L is also used to operate the turning mechanism 2. To be specific, the left operation lever 26L uses the hydraulic oil discharged by the pilot pump to apply the pilot pressure corresponding to the operation in the left-right direction to the pilot port of the control valve 173. To be more specific, when the left operation lever 26L is operated in the left turning direction (left direction), the left operation lever 26L causes the pilot pressure corresponding to the operation amount to act on the left pilot port of the control valve 173. When the left operation lever 26L is operated in the right turning direction (right direction), the pilot pressure corresponding to the operation amount is applied to the right pilot port of the control valve 173.

The operation sensor 29LB detects the content of an operation performed by the operator on the left operation lever 26L in the left-right direction and outputs the detected value to the controller 30.

The proportional valve 31DL operates in response to a control command (current command) output from the controller 30. The proportional valve 31DL adjusts the pilot pressure of the hydraulic oil introduced from the pilot pump 15 to the left pilot port of the control valve 173 via the proportional valve 31DL. The proportional valve 31DR operates in response to a current command output from the controller 30. The proportional valve 31DR adjusts the pilot pressure of the hydraulic oil introduced from the pilot pump 15 to the right pilot port of the control valve 173 via the proportional valve 31DR. The proportional valves 31DL can adjust the pilot pressure so that the control valve 173 can be stopped at an arbitrary position. Similarly, the proportional valve 31DR can adjust the pilot pressure so that the control valve 173 can be stopped at an arbitrary position.

With this configuration, the controller 30 can supply the hydraulic oil discharged from the pilot pump 15 to the left pilot port of the control valve 173 via the proportional valve 31DL in response to the leftward turning operation by the operator. In addition, the controller 30 can supply the hydraulic oil discharged from the pilot pump 15 to the left pilot port of the control valve 173 via the proportional valve 31DL regardless of the leftward turning operation by the operator. That is, the controller 30 can turn the turning mechanism 2 to the left in response to the left turning operation by the operator or independently of the left turning operation by the operator.

In addition, the controller 30 can supply the hydraulic oil discharged from the pilot pump 15 to the right pilot port of the control valve 173 via the proportional valve 31DR in response to the operator's right turning operation. In addition, the controller can supply the hydraulic oil discharged from the pilot pump 15 to the right pilot port of the control valve 173 via the proportional valve 31DR regardless of the operator's right turning operation. That is, the controller 30 can turn the turning mechanism 2 to the right in response to the right turning operation by the operator or independently of the right turning operation by the operator.

The shovel 100 may have a configuration for automatically moving the lower traveling body 1 forward and backward. In this case, the hydraulic system portion related to the operation of the left traveling hydraulic motor 2ML and the hydraulic system portion related to the operation of the right traveling hydraulic motor 2MR may be configured in the same manner as the hydraulic system portion related to the operation of the boom cylinder 7 and the like.

In addition, the shovel 100 may include a configuration for automatically operating the bucket tilt mechanism. In this case, the hydraulic system portion related to the bucket tilt cylinder constituting the bucket tilt mechanism may be configured in the same manner as the hydraulic system portion related to the operation of the boom cylinder 7 or the like.

Although the electric operation lever has been described as the form of the operation device 26, a hydraulic operation lever may be employed instead of the electric operation lever. In this case, the lever operation amount of the hydraulic operation lever may be detected in the form of pressure by a pressure sensor and input to the controller 30. Further, an electromagnetic valve may be disposed between the operation device 26 as the hydraulic operation lever and the pilot port of each control valve. The electromagnetic valve is configured to operate in response to an electrical signal from the controller 30. With this configuration, when a manual operation using the operation device 26 as a hydraulic operation lever is performed, the operation device 26 can move each control valve by increasing or decreasing the pilot pressure according to the lever operation amount. Further, each control valve may be constituted by an electromagnetic spool valve. In this case, the electromagnetic spool valve operates in response to an electric signal from the controller 30 corresponding to the lever operation amount of the electric operation lever.

Figure 5:
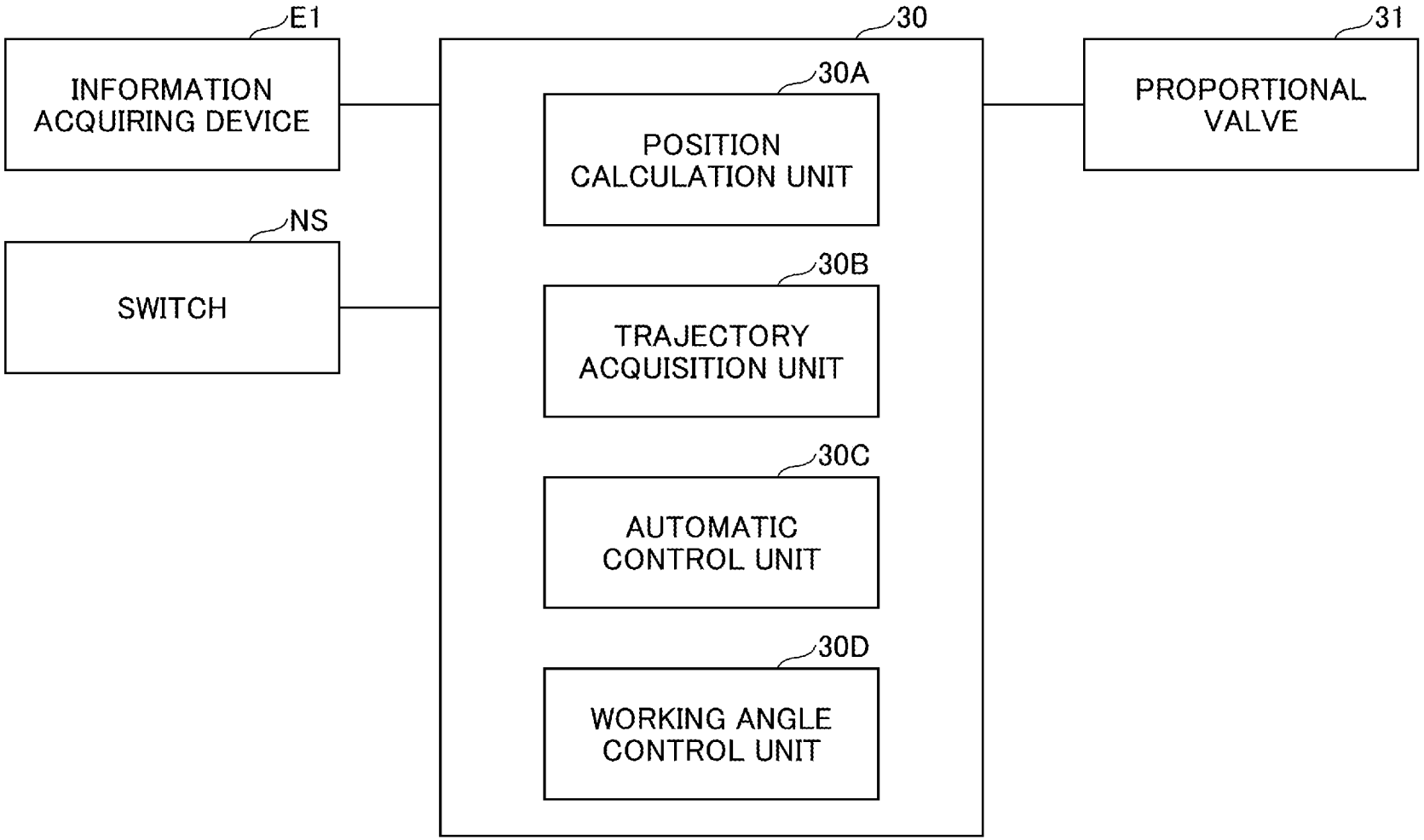
FIG. 5 is a diagram illustrating a configuration example of a controller.

Next, the function of the controller 30 will be described with reference to FIG. 5. FIG. 5 is a functional block diagram of the controller 30. In the example of FIG. 5, the controller 30 is configured to receive a signal output by at least one of the information acquiring device E1, the switch NS, and the like, execute various calculations, and output a control command to the proportional valves 31 and the like.

The information acquiring device E1 detects information on the shovel 100. In the present embodiment, the information acquiring device E1 includes at least one of a boom angle sensor S1, an arm angle sensor S2, a bucket angle sensor S3, a machine attitude sensor S4, a turning angle sensor S5, a boom rod pressure sensor, a boom bottom pressure sensor, an arm rod pressure sensor, an arm bottom pressure sensor, a bucket rod pressure sensor, a bucket bottom pressure sensor, a boom cylinder stroke sensor, an arm cylinder stroke sensor, a bucket cylinder stroke sensor, a discharge pressure sensor 28, an operation sensor 29, a space recognition device 70, a direction detection device 71, an information input device 72, a position measuring device 73, and a communication device T1. The information acquiring device E1 acquires, for example, at least one of a boom angle, arm angle, bucket angle, machine body inclination angle, turning angular velocity, boom rod pressure, boom bottom pressure, arm rod pressure, arm bottom pressure, bucket rod pressure, bucket bottom pressure, boom stroke amount, arm stroke amount, bucket stroke amount, discharge pressure of the main pump 14, operation amount of the operation device 26, information on an object existing in a three dimensional space around the shovel 100, information on a relative relationship between the direction of the upper turning body 3 and the direction of the lower traveling body 1, information input to the controller 30, and information on a current position as information on the shovel 100. The information acquiring device E1 may acquire information from another machine (a construction machine, a flying object for acquiring site information, or the like).

The controller 30 includes a position calculation unit 30A, a trajectory acquisition unit 30B, and an automatic control unit 30C as functional elements. Each functional element may be configured by hardware or may be configured by software. Although the position calculation unit 30A, the trajectory acquisition unit 30B, the automatic control unit 30C, and a working angle control unit 30D are illustrated as being distinguished from each other for ease of description, they need not be physically distinguished from each other, and may be entirely or partially configured by common software components or hardware components.

The position calculation unit 30A is configured to calculate the position of the measurement target. In the present embodiment, the position calculation unit 30A calculates a coordinate point of a predetermined portion of the attachment AT in the reference coordinate system. The predetermined portion is, for example, a claw tip of the bucket 6. Specifically, the claw tip of the bucket 6 is the tip of the claw at the center among the plurality of claws attached to the tip of the bucket 6. However, the claw tip of the bucket 6 may be the tip of the claw at the left end among the plurality of claws attached to the tip of the bucket 6, or may be the tip of the claw at the right end among the plurality of claws attached to the tip of the bucket 6. The origin of the reference coordinate system is, for example, an intersection point between the pivot axis and the ground contact surface of the shovel 100. The reference coordinate system is, for example, an XYZ orthogonal coordinate system, and has an X-axis parallel to the longitudinal axis of the shovel 100, a Y-axis parallel to the lateral axis of the shovel 100, and a Z-axis parallel to the pivot axis of the shovel 100. The position calculation unit 30A calculates, for example, the coordinate point of the claw tip of the bucket 6 from the rotation angle of each of the boom 4, the arm 5, and the bucket 6. The position calculation unit 30A may calculate not only the coordinate point of the tip of the claw at the center but also the coordinate point of the tip of the claw at the left end and the coordinate point of the tip of the claw at the right end. In this case, the position calculation unit 30A may use the output of the machine attitude sensor S4. Further, the predetermined portion may be one point on the bottom surface of the bucket 6 or one point on the opening surface of the bucket 6.

The trajectory acquisition unit 30B is configured to obtain a target trajectory which is a trajectory followed by a predetermined portion of the attachment AT when the shovel 100 is automatically operated. In the present embodiment, the trajectory acquisition unit 30B acquires a target trajectory used when the automatic control unit 30C automatically operates the shovel 100. To be specific, the trajectory acquisition unit 30B derives the target trajectory based on a design surface stored in the non-volatile storage device. The trajectory acquisition unit 30B may derive the target trajectory based on information related to the topography around the shovel 100 recognized by the space recognition device 70. Alternatively, the trajectory acquisition unit 30B may derive information on the past trajectory of the claw tip of the bucket 6 from the past output of the attitude detecting device stored in the volatile storage device, and derive the target trajectory based on the information. Alternatively, the trajectory acquisition unit 30B may derive the target trajectory based on the current position of the predetermined portion of the attachment AT and the design surface.

The automatic controller 30C is configured to be able to automatically operate the shovel 100. In the present embodiment, when a predetermined start condition is satisfied, a predetermined portion of the attachment AT is moved along the target trajectory acquired by the trajectory acquisition unit 30B. Specifically, when the operation device 26 is operated in a state where the switch NS is pressed, the shovel 100 is automatically operated so that the predetermined portion moves along the target trajectory.

In the present embodiment, the automatic control unit 30C is configured to support manual operation of the shovel 100 by the operator by automatically operating the actuators. For example, when the operator manually performs the arm closing operation while pressing the switch NS, the automatic control unit 30C may automatically extend and contract at least one of the boom cylinder 7, the arm cylinder 8, and the bucket cylinder 9 so that the target trajectory and the position of the claw tip of the bucket 6 coincide with each other. In this case, for example, only by operating the left operation lever 26L in the arm closing direction, the operator can close the arm 5 while causing the claw tip of the bucket 6 to coincide with the target trajectory.

In the present embodiment, the automatic control unit 30C can automatically operate the actuators by giving control commands (current commands) to the proportional valves 31 and individually adjusting the pilot pressures acting on the control valves corresponding to the actuators. For example, at least one of the boom cylinder 7 and the bucket cylinder 9 can be operated regardless of whether or not the right operation lever 26R is tilted.

The working angle control unit 30D is configured to be able to control the working angle θ. The working angle θ is an angle formed by a plane or a line determined based on the shape of the bucket 6 and a design surface. In the present embodiment, the working angle control unit 30D is configured to execute control for causing the working angle θ to follow the target angle 6T (for example, causing the working angle θ to coincide with the target angle θT, as described below).

Figure 6A:
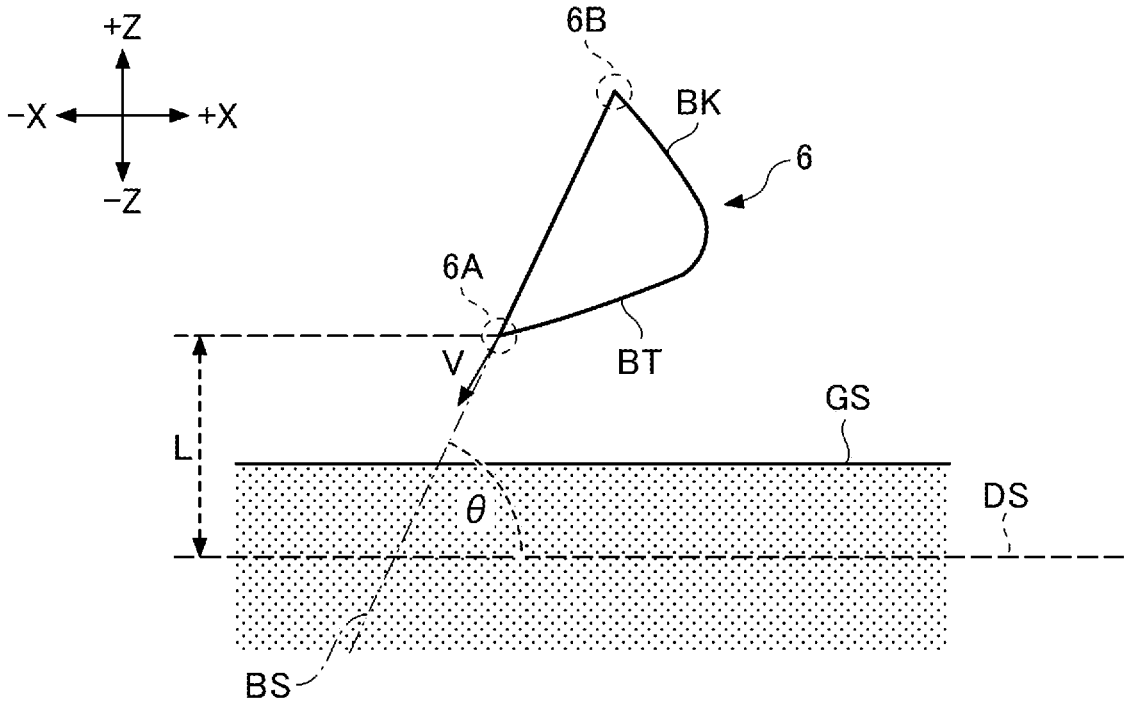
FIG. 6A is a side view of a bucket.
Figure 6B:
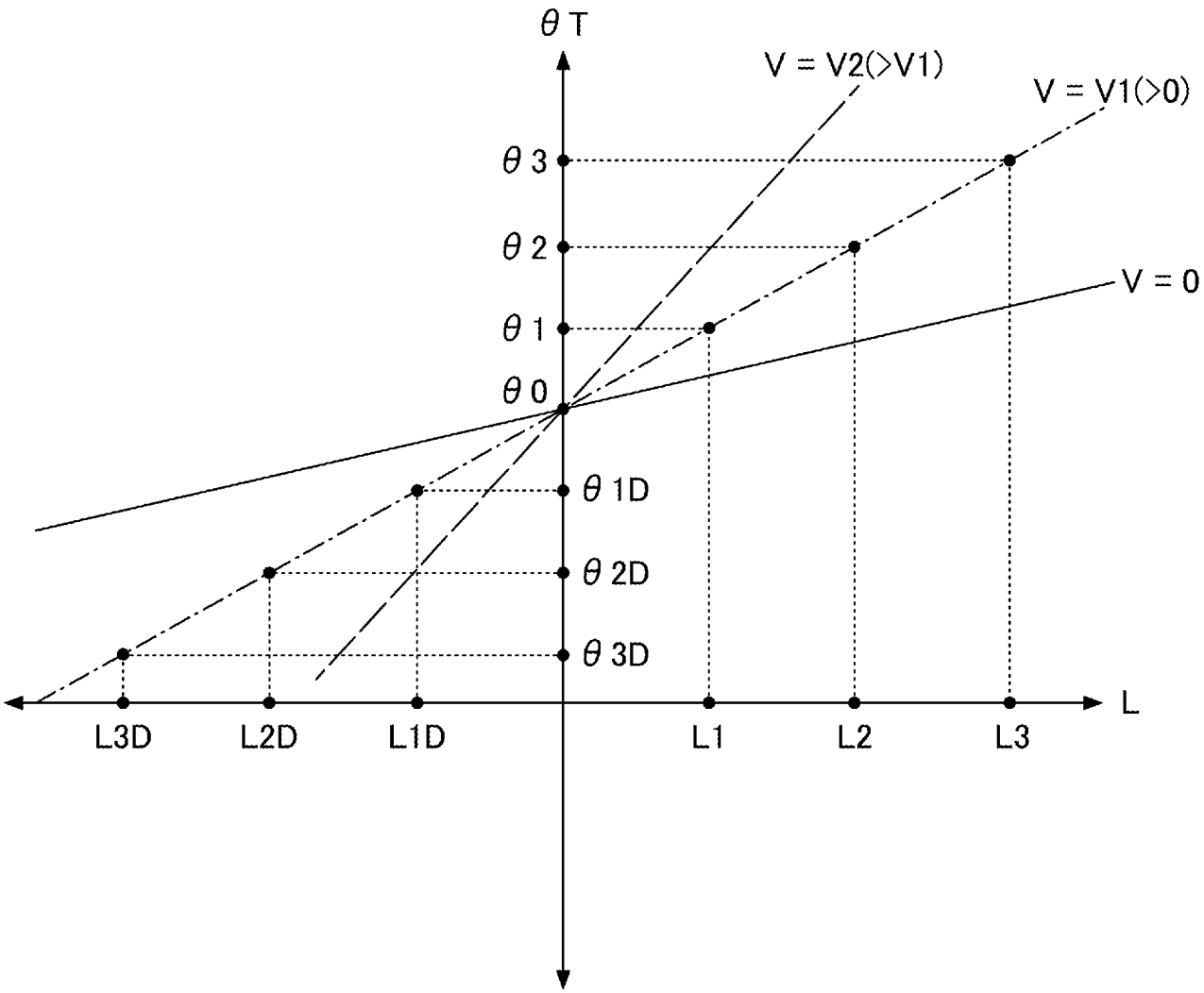
FIG. 6B is a graph illustrating a relationship between a target angle of a work angle, an operation speed, and a separation distance.

Here, the working angle θ will be described with reference to FIG. 6A and FIG. 6B. FIGS. 6A and 6B are diagrams illustrating a relationship between the working angle θ, the operation speed V, and the separation distance L. To be specific, FIG. 6A is a side view of the bucket 6 when the bucket 6 is viewed from the −Y direction on the Y axis, and FIG. 6B is a graph illustrating a relationship between the target angle 6T of the work angle θ, the operation speed V, and the separation distance L.

The working angle θ is an angle formed by a plane or a line determined based on the shape of the bucket 6 and the design surface DS. In the example illustrated in FIG. 6A, the design surface DS is located below the ground surface GS. The working angle θ is an angle formed between a virtual surface BS including the opening surface of the bucket 6 and the design surface DS. However, the working angle θ may be an angle formed between a virtual plane including the bottom surface BT of the bucket 6 and the design surface DS, or may be an angle formed between the virtual plane including the back surface BK of the bucket 6 and the design surface DS. In the example illustrated in FIG. 6A, the bucket 6 is at a position higher than the ground surface to be worked, and the design surface DS is covered with earth and sand and is not yet exposed.

The operation speed V is a moving speed at the control reference point. The control reference point is a point serving as a reference when executing control of the working angle θ, and corresponds to, for example, a point at a predetermined portion of the attachment AT. In the example illustrated in FIGS. 6A and 6B, the predetermined portion of the attachment AT is the claw tip 6A of the bucket 6. To be more specific, the claw tip 6A is the tip of the claw located at the center among the plurality of claws attached to the tip of the bucket 6. In the examples illustrated in FIGS. 6A and 6B, the operator of the shovel 100 performs the arm closing operation. Therefore, the bucket 6 moves downward and in a direction approaching the upper turning body 3. That is, the operation speed V of the claw tip 6A is represented by a vector having components in the −X direction on the X axis and the −Z direction on the Z axis.

The separation distance L is a distance between the control reference point and the design surface DS. In the examples illustrated in FIGS. 6A and 6B, the separation distance L is the vertical distance between the claw tip 6A of the bucket 6 and the design surface DS. However, the separation distance L may be a distance (path) along the trajectory of the claw tip 6A when the claw tip 6A approaches the design surface DS.

The working angle control unit 30D calculates the working angle θ, the operation speed V, and the separation distance L based on the output of the information acquiring device E1. To be specific, the working angle control unit 30D calculates the coordinate point of the claw tip 6A of the bucket 6 based on the output of the information acquiring device E1. Then, the working angle control unit 30D calculates an operation speed V (a moving distance per unit time) which is a moving speed of the claw tip 6A based on the coordinate point of the claw tip 6A at the first time point and the coordinate point of the claw tip 6A at the second time point. The working angle control unit 30D calculates the coordinate point of the bucket pin 6B based on the output of the information acquiring device E1. The bucket pin 6B is a pin for coupling the arm 5 and the bucket 6. The working angle control unit 30D calculates the separation distance L based on the coordinate point of the claw tip 6A and the design surface DS stored in the non-volatile storage device.

In the examples illustrated in FIGS. 6A and 6B, the working angle control unit 30D is configured to derive the target angle θT of the working angle θ based on the current operation speed V and the current separation distance L. To be specific, the working angle control unit 30D refers to the database that stores a correspondence relationship between the target angle θT, the operation speed V, and the separation distance L as illustrated in FIG. 6B, and derives the target angle θT corresponding to the current operation speed V and the current separation distance L.

The graph illustrated in FIG. 6B is a graph in which the vertical axis represents the target angle θT and the horizontal axis represents the separation distance L. In addition, in the graph illustrated in FIG. 6B, the correspondence relationship between the separation distance L and the target angle θT at each of the three stages of the operation speed V is illustrated by a solid line, a one dot chain line, and a broken line. The graph illustrated in FIG. 6B indicates that when the bucket 6 is at a position higher than the design surface DS (when the separation distance L is a positive value), the target angle θT increases as the absolute value of the separation distance L increases, and the target angle θT increases as the absolute value of the operation speed V increases. Further, the graph illustrated in FIG. 6B indicates that when the bucket 6 is at a position lower than the design surface DS (when the separation distance L is a negative value), the target angle θT decreases as the absolute value of the separation distance L increases, and the target angle θT decreases as the absolute value of the operation speed V increases. That is, the graph illustrated in FIG. 6B indicates that the bucket 6 is opened as the bucket 6 is separated upward from the design surface DS, and the bucket 6 is closed as the bucket 6 is separated downward from the design surface DS. The graph illustrated in FIG. 6B indicates that when the separation distance L is 0, that is, when the claw tip 6A of the bucket 6 and the design surface DS are in contact with each other, the target angle θT becomes the value θ0 regardless of the magnitude of the operation speed V. In the example illustrated in FIG. 6B, the operation speed V is represented in three stages for the sake of clarity, but in actuality, the operation speed V is represented in more stages.

Here, an example of a process in which the working angle control unit 30D sets (changes) the target angle θT will be described with reference to FIG. 6B and FIGS. 7A to 7D. FIGS. 7A to 7D are side views of the bucket 6 when work such as finishing excavation work or horizontal pulling work is performed, and indicate the transition of the position of the bucket 6. In addition, in the examples illustrated in FIGS. 7A to 7D, the design surface DS is positioned below the ground surface GS.

Figure 7A:
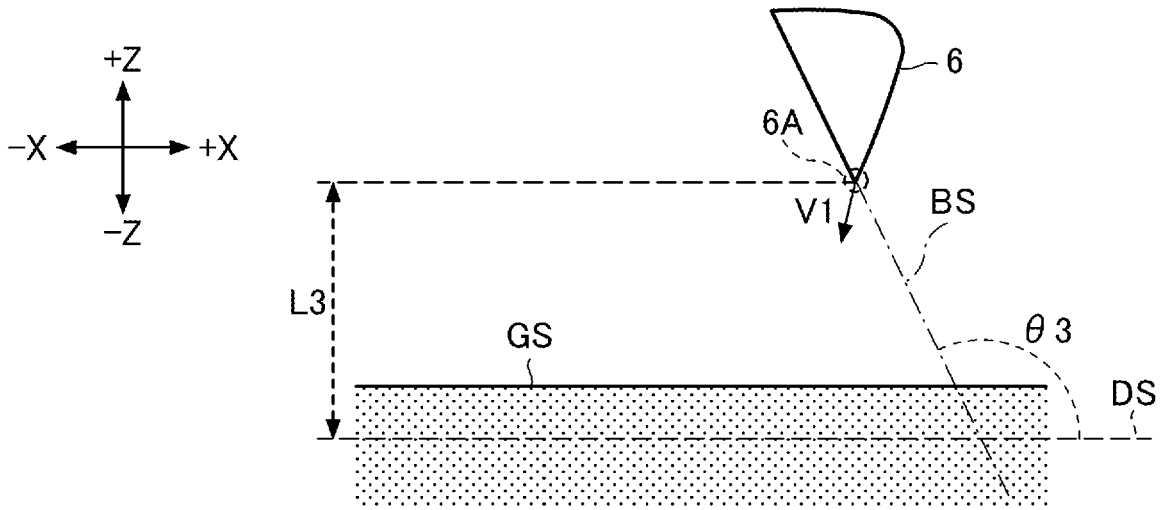
FIG. 7A is a side view of the bucket in a position higher than the design surface.
Figure 7B:
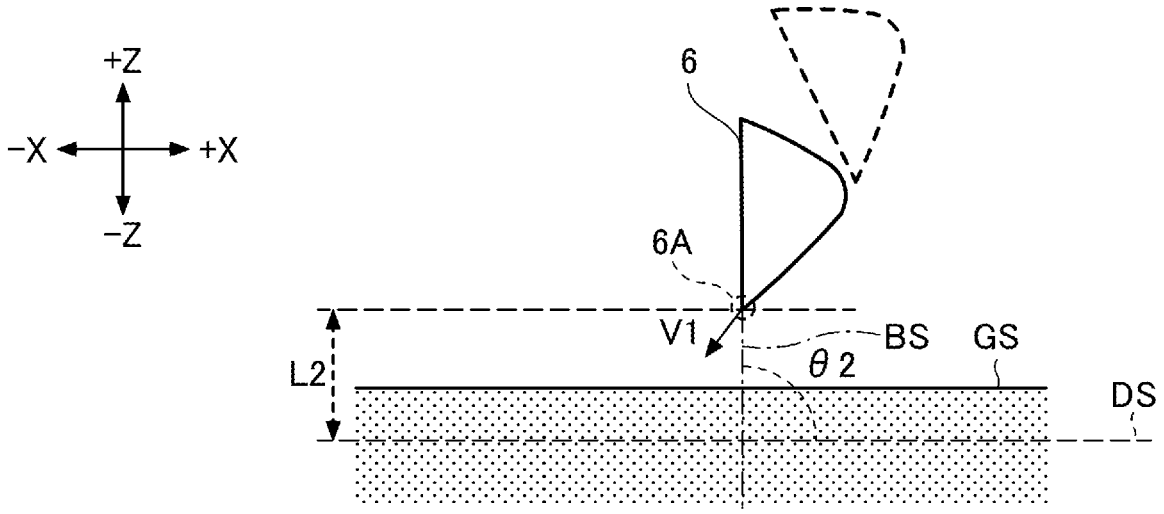
FIG. 7B is a side view of the bucket in a position higher than the design surface.
Figure 7C:
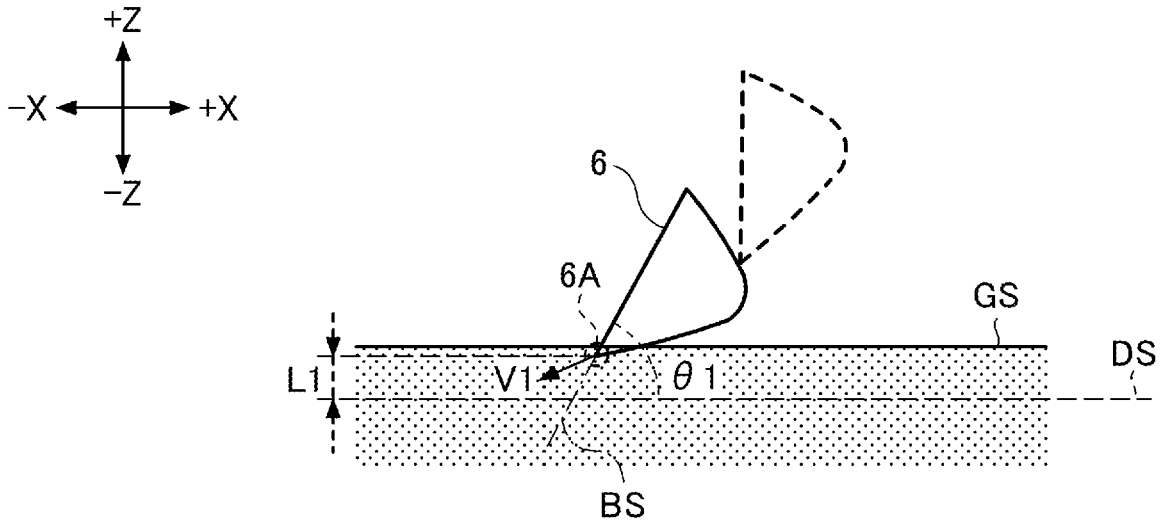
FIG. 7C is a side view of the bucket in a position higher than the design surface.
Figure 7D:
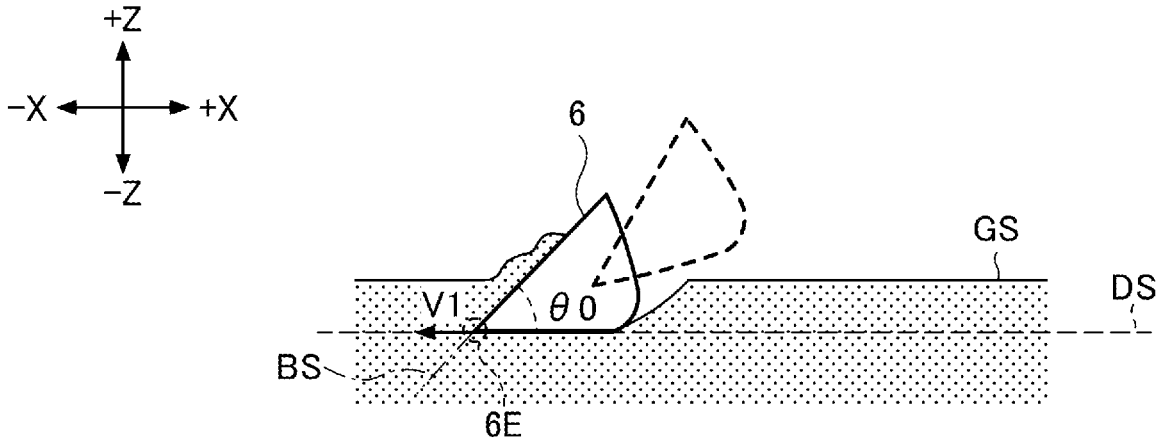
FIG. 7D is a side view of the bucket in a position higher than the design surface.

To be more specific, FIG. 7A indicates the position of the bucket 6 at the time t1, FIG. 7B indicates the position of the bucket 6 at the time t2 after the time t1, FIG. 7C indicates the position of the bucket 6 at the time t3 after the time t2, and FIG. 7D indicates the position of the bucket 6 at the time t4 after the time t3. In addition, the figure of the bucket 6 represented by the dotted line in FIG. 7B indicates the position of the bucket 6 at a past time (time t1). The same applies to FIGS. 7C and 7D.

At time t1, the bucket 6 is located at the position illustrated in FIG. 7A, and the working angle control unit 30D derives the value θ3 of the target angle θT related to the working angle θ based on the current value V1 of the operation speed V, the current value L3 of the separation distance L, and the database storing the correspondence illustrated in FIG. 6B. Then, the working angle control unit 30D executes control to make the working angle θ coincide with the value θ3 of the target angle θT. To be specific, the working angle control unit 30D outputs a control command to at least one of the proportional valves 31CL and 31CR to open and close the bucket 6, thereby causing the working angle θ to coincide with the value θ3 of the target angle θT. The working angle control unit 30D may cause the working angle θ to coincide with the value θ3 of the target angle θT by executing at least one of raising and lowering the boom 4, opening and closing the arm 5, and opening and closing the bucket 6. The working angle control unit 30D may cause the working angle θ to coincide with the value θ3 of the target angle θT without opening and closing the bucket 6.

At time t2, the bucket 6 is at the position illustrated in FIG. 7B, and the working angle control unit 30D derives the value θ2 of the target angle θT related to the working angle θ based on the current value V1 of the operation speed V, the current value L2 of the separation distance L, and the database storing the correspondence illustrated in FIG. 6B. Then, the working angle control unit 30D executes control to make the working angle θ coincide with the value θ2 of the target angle θT.

At time t3, the bucket 6 is at the position illustrated in FIG. 7C, and the working angle control unit 30D derives the value θ1 of the target angle θT related to the working angle θ based on the current value V1 of the operation speed V, the current value L1 of the separation distance L, and the database storing the correspondence illustrated in FIG. 6B. Then, the working angle control unit 30D executes control to make the working angle θ coincide with the value θ1 of the target angle θT.

Similarly, at time t4, the bucket 6 is at the position illustrated in FIG. 7D, and the working angle control unit 30D derives the value θ0 of the target angle θT related to the working angle θ based on the current value V1 of the operation speed V, the current value 0 of the separation distance L, and the database storing the correspondence illustrated in FIG. 6B. Then, the working angle control unit 30D executes control to make the working angle θ coincide with the value θ0 of the target angle θT. In the present embodiment, when the working angle θ is the value θ0, as illustrated in FIG. 7D, the bottom surface of the bucket 6 and the design surface DS coincide with each other (are parallel to each other). Therefore, the operator can expose the design surface DS by pulling the bucket 6 toward the upper turning body 3 side while keeping the attitude (the attitude at the time t4) as it is. However, the value θ0 may be an arbitrary value that is preset or dynamically set by the operator or the like of the shovel 100. In addition, there is an allowable range of about several tens of millimeters in coincidence between the bottom surface of the bucket 6 and the design surface DS. When the bottom surface of the bucket 6 is positioned within a predetermined allowable width with respect to the design surface DS, the controller 30 determines that the bottom surface of the bucket 6 coincides with the design surface DS.

In the correspondence relationship illustrated in FIG. 6B, the operation speed V is the moving speed of the claw tip 6A of the bucket 6, that is, the norm (magnitude) of the moving speed of the claw tip 6A, but the operation speed V may be the norm (magnitude) of the horizontal components of the moving speed of the claw tip 6A or may be the norm (magnitude) of the vertical components of the moving speed of the claw tip 6A.

In addition, although the correspondence relationship illustrated in FIG. 6B is set such that the target angle θT linearly increases in accordance with an increase in the separation distance L, the correspondence relationship may be set such that the target angle θT non-linearly increases.

In addition, although the correspondence relationship illustrated in FIG. 6B is set such that the ratio of the increase in the target angle θT to the increase in the separation distance L increases linearly in accordance with the increase in the operation speed V, the ratio may be set such that the ratio increases nonlinearly.

In addition, although the correspondence relationship illustrated in FIG. 6B is stored in the non-volatile storage device as a database, the correspondence relationship may be represented using a mathematical expression. For example, the target angle θT related to the working angle θ may be expressed as a function having the separation distance L and the operation speed V as arguments.

Further, in the above-described embodiment, the claw tip 6A of the bucket 6 is adopted as the control reference point, but a portion other than the claw tip 6A of the bucket 6 may be adopted as the control reference point. In the embodiment described above, the vertical distance between the control reference point (the claw tip 6A of the bucket 6) and the design surface DS is adopted as the separation distance L. However, a distance other than the vertical distance may be adopted as the separation distance L.

Figure 8A:
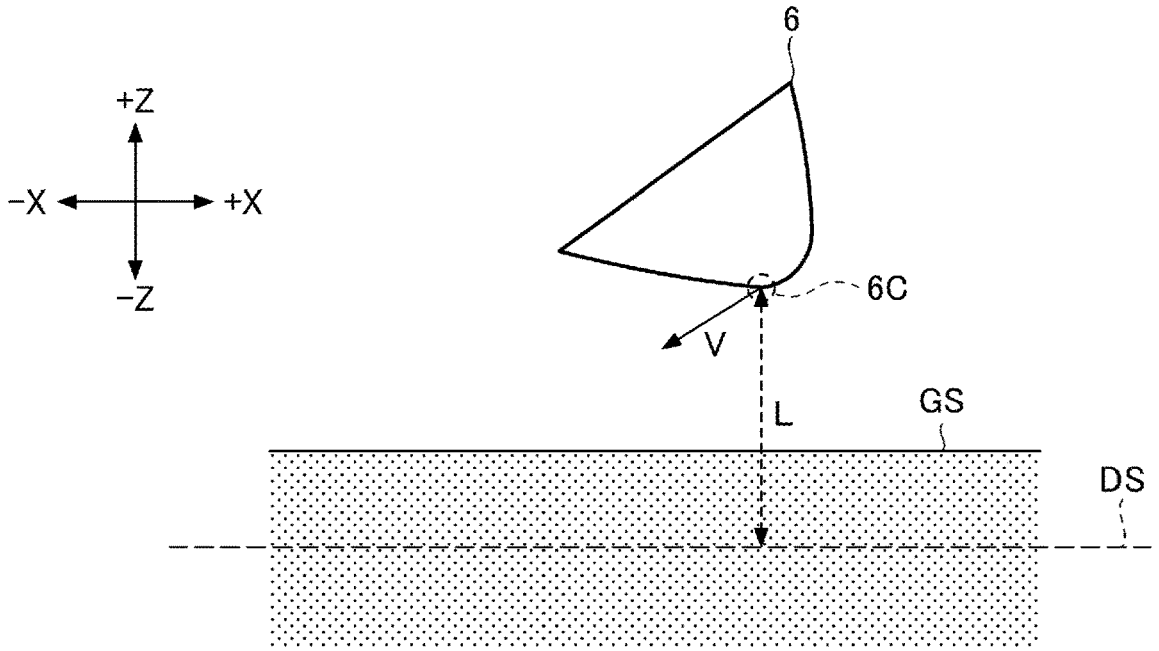
FIG. 8A is a side view of the bucket in a position higher than the design surface.
Figure 8B:
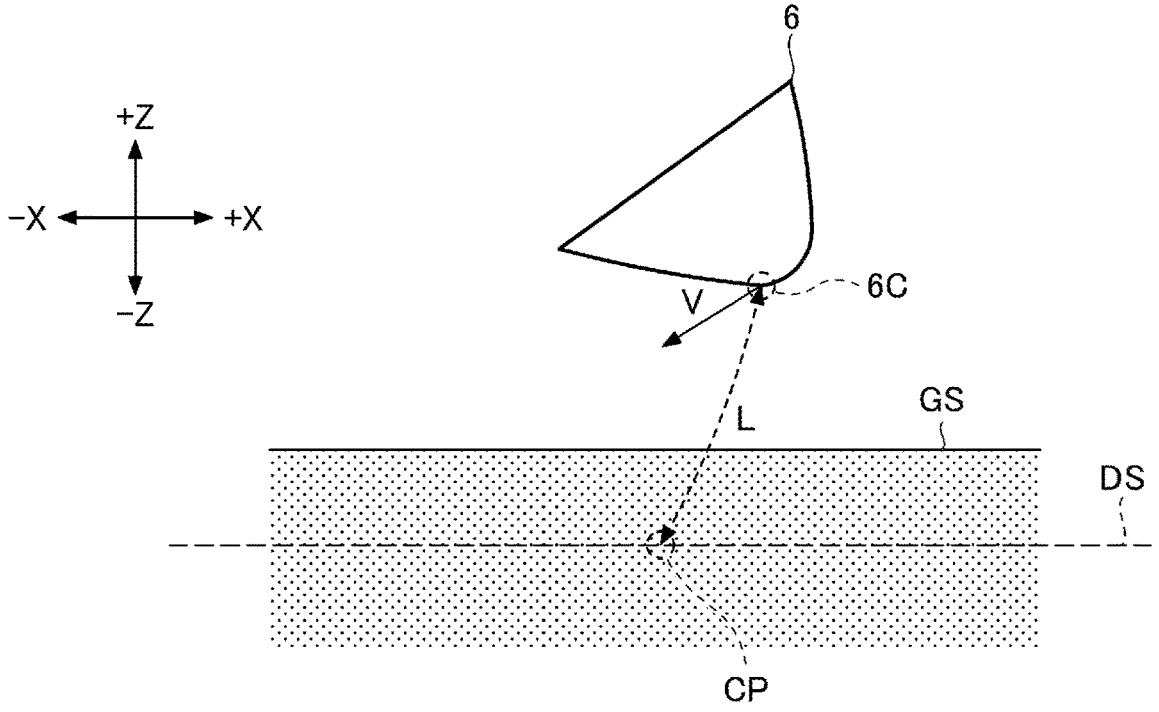
FIG. 8B is a side view of the bucket in a position higher than the design surface.

Here, another example of the control reference point and the separation distance L will be described with reference to FIGS. 8A and 8B. FIGS. 8A and 8B are side views of the bucket 6 at a position higher than the design surface DS. To be specific, FIG. 8A illustrates another example of the control reference point, and FIG. 8B illustrates another example of the separation distance L. In the examples illustrated in FIGS. 8A and 8B, the design surface DS is located below the ground surface GS.

In the example illustrated in FIG. 8A, a point (nearest neighbor point 6C) closest to the design surface DS among a plurality of points on the outer surface of the bucket 6 is adopted as the control reference point. The separation distance L is a vertical distance between the nearest neighbor point 6C and the design surface DS. At the time point illustrated in FIG. 8A, the nearest neighbor point 6C is a point corresponding to the rear end of the bottom surface BT of the bucket 6, but the point on the attachment AT (bucket 6) corresponding to the nearest neighbor point 6C differs depending on the attitude of the bucket 6 at each time. However, the controller 30 may continuously set the point on the attachment AT (bucket 6) that has become the nearest neighbor point 6C at a predetermined time point as the nearest neighbor point 6C even after the point is no longer the actual closest point.

In the example illustrated in FIG. 8B, as in the case of FIG. 8A, the nearest neighbor point 6C located at the rear end of the bottom surface BT of the bucket 6 is adopted as the control reference point. The distance between the nearest neighbor point 6C and the intersection point CP is adopted as the separation distance L. In the example illustrated in FIG. 8B, the intersection point CP is an intersection point between the design surface DS and a circumferential line of a circle centered on the boom foot pin and passing through the control reference point (nearest neighbor point 6C).

Next, another example of the process in which the working angle control unit 30D sets (changes) the target angle θT will be described with reference to FIGS. 9A to 9D. FIGS. 9A to 9D are side views of the bucket 6 when work such as finishing excavation work or horizontal pulling work is performed, and indicate the transition of the position of the bucket 6. In the examples illustrated in FIGS. 9A to 9D, the design surface DS is located below the ground surface GS.

Figure 9A:
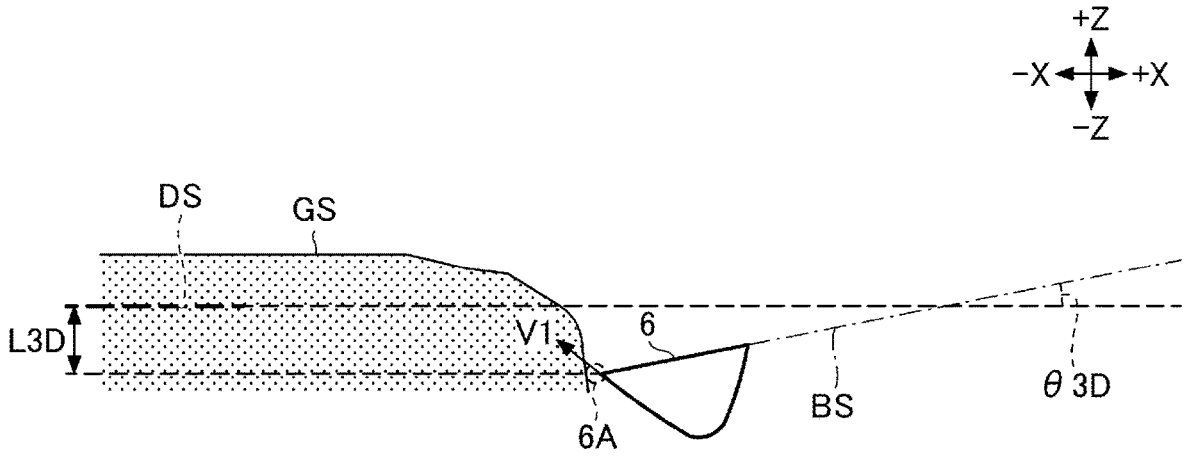
FIG. 9A is a side view of the bucket in a position lower than the design surface.
Figure 9B:
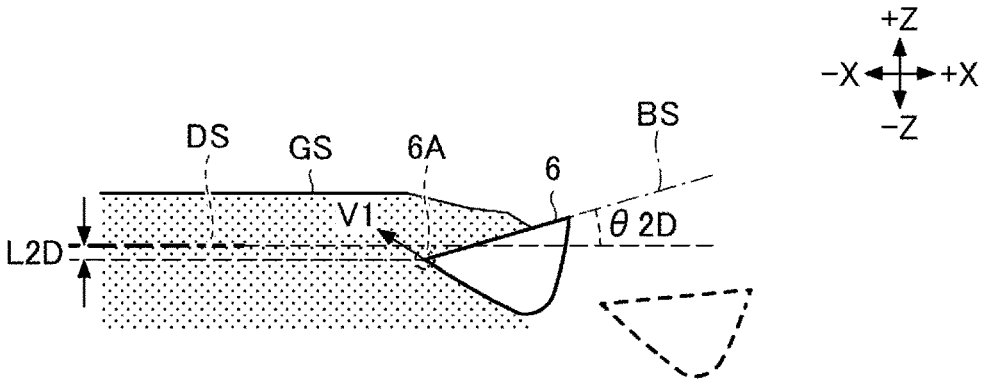
FIG. 9B is a side view of the bucket in a position lower than the design surface.
Figure 9C:
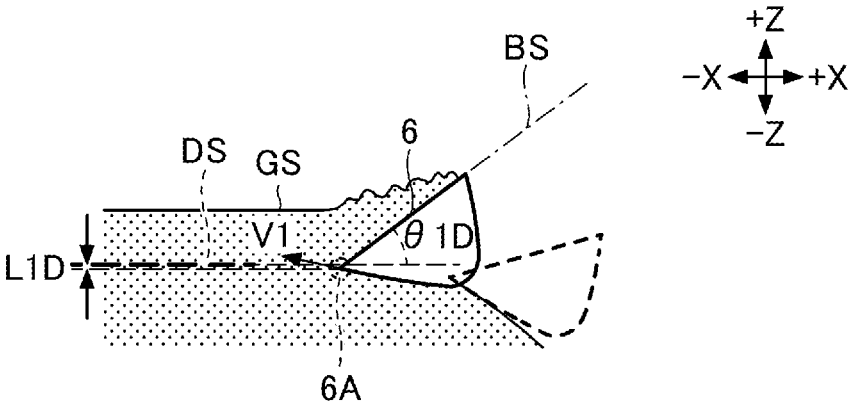
FIG. 9C is a side view of the bucket in a position lower than the design surface.
Figure 9D:
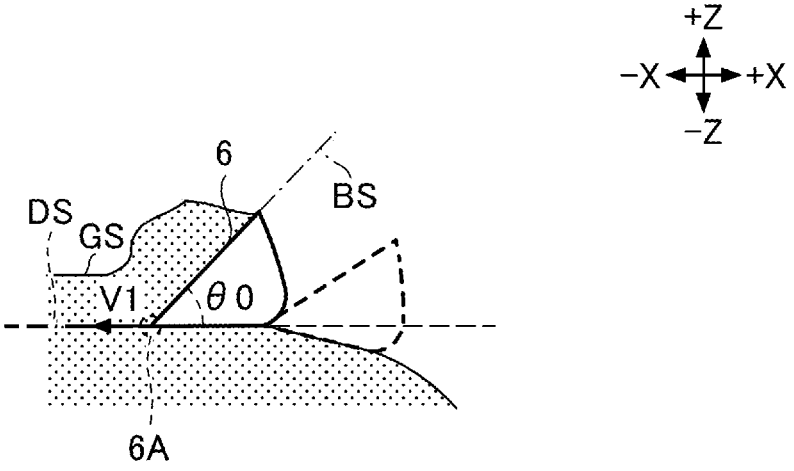
FIG. 9D is a side view of the bucket in a position lower than the design surface.

To be more specific, FIG. 9A indicates the position of the bucket 6 at the time t1, FIG. 9B indicates the position of the bucket 6 at the time t2 after the time t1, FIG. 9C indicates the position of the bucket 6 at the time t3 after the time t2, and FIG. 9D indicates the position of the bucket 6 at the time t4 after the time t3. In addition, the figure of the bucket 6 represented by the dotted line in FIG. 9B indicates the position of the bucket 6 at a past time (time t1). The same applies to FIGS. 9C and 9D.

The examples illustrated in FIGS. 9A to 9D differ from the examples illustrated in FIGS. 7A to 7D in that the control reference point (the claw tip 6A of the bucket 6) is located at a position lower than the virtual plane including the design surface DS. Therefore, the value L3D, the value L2D, and the value L1D of the separation distance L in FIGS. 9A to 9C are negative values. In the examples illustrated in FIGS. 7A to 7D, the control reference point (the claw tip 6A of the bucket 6) is located at a position higher than the virtual plane including the design surface DS. Therefore, the value L3, the value L2, and the value L1 of the separation distance L in FIGS. 7A to 7C are positive values.

At the time t1, the bucket 6 is at the position illustrated in FIG. 9A, and the working angle control unit 30D derives the value θ3D of the target angle θT related to the working angle θ based on the current value V1 of the operation speed V, the current value L3D of the separation distance L, and the database storing the correspondence illustrated in FIG. 6B. Then, the working angle control unit 30D executes control to make the working angle θ coincide with the value θ3D of the target angle θT. To be specific, the working angle control unit 30D outputs a control command to at least one of the proportional valves 31CL and 31CR to open and close the bucket 6, thereby causing the working angle θ to coincide with the value θ3D of the target angle θT. The working angle control unit 30D may cause the working angle θ to coincide with the value θ3 of the target angle θT by executing at least one of raising and lowering the boom 4, opening and closing the arm 5, and opening and closing the bucket 6.

At the time t2, the bucket 6 is at the position illustrated in FIG. 9B, and the working angle control unit 30D derives the value θ2D of the target angle θT related to work angle θ based on the current value V1 of the operation speed V, the current value L2D of the separation distance L, and the database storing the correspondence illustrated in FIG. 6B. Then, the working angle control unit 30D executes control to make the working angle θ coincide with the value θ2D of the target angle θT.

At the time t3, the bucket 6 is at the position illustrated in FIG. 9C, and the working angle control unit 30D derives the value θ1D of the target angle θT related to the work angle θ based on the current value V1 of the operation speed V, the current value L1D of the separation distance L, and the database storing the correspondence illustrated in FIG. 6B. Then, the working angle control unit 30D executes control to make the working angle θ coincide with the value θ1D of the target angle θT.

Similarly, at the time t4, the bucket 6 is at the position illustrated in FIG. 9D, and the working angle control unit 30D derives the value θ0 of the target angle θT related to the working angle θ based on the current value V1 of the operation speed V, the current value 0 of the separation distance L, and the database storing the correspondence illustrated in FIG. 6B. Then, the working angle control unit 30D executes control to make the working angle θ coincide with the value θ0 of the target angle θT. In the present embodiment, when the working angle θ is the value θ0, as illustrated in FIG. 9D, the bottom surface of the bucket 6 and the design surface DS coincide with each other (are parallel to each other). Therefore, the operator can expose the design surface DS by pulling the bucket 6 toward the upper turning body 3 while keeping the bucket 6 in the same attitude. However, the value θ0 may be an arbitrary value that is preset or dynamically set by an operator or the like of the shovel 100.

As described above, the shovel 100 according to the embodiment of the present disclosure includes the lower traveling body 1, the upper turning structure 3 turnably mounted on the lower traveling body 1, the excavation attachment which is an example of the attachment AT attached to the upper turning structure 3, the attitude detection device (the boom angle sensor S1, the arm angle sensor S2, the bucket angle sensor S3, the machine attitude sensor S4, and the turning angle sensor S5) which detects the attitude of the attachment AT, and the controller 30 as a control device for calculating the target angle θT related to the working angle θ formed by a plane or a line determined based on the shape of the bucket 6 included in the attachment AT (for example, the virtual plane BS containing the opening plane of the bucket 6 in FIG. 6A) and the designed surface DS. The controller 30 is configured to change the target angle θT according to the attitude of the attachment AT and the information about the design surface DS. The information about the design surface DS is, for example, information about the position of the design surface DS.

According to this configuration, since the working angle θ of the attachment AT can be automatically adjusted, a smoother work can be realized. For example, with this configuration, even in a case where a horizontal pulling operation is performed in which the bucket 6 is pulled horizontally toward the machine side along a horizontally extending target trajectory (design surface DS), when the bucket 6 is brought closer to the target trajectory (design surface DS) in the vertical direction, the attitude of the claw tip 6A of the bucket 6 can be set to an attitude in which the bucket 6 is easily stuck into the ground. Therefore, in this configuration, even when earth and sand remain on the design surface DS, the claw tip 6A of the bucket 6 can be caused to penetrate into the earth and sand at an appropriate penetration angle. In this configuration, the direction of the claw tip 6A is gradually brought closer to the horizontal direction after the claw tip 6A is penetrated into the earth and sand, and when the claw tip 6A and the design surface DS coincide with each other, the claw tip 6A can be directed to the horizontal direction. That is, this configuration can control the attitude of the attachment AT such that the angle formed between the bottom surface of the bucket 6 and the design surface DS decreases as the bucket 6 approaches the design surface DS, and can further control the attitude of the attachment AT such that the bottom surface of the bucket 6 and the design surface DS become parallel to each other when the claw tip 6A and the design surface DS coincide with each other. In this way, with this configuration, it is possible to prevent the function of turning the claw tip 6A of the bucket 6 horizontally for the horizontal pulling work from becoming an obstacle when excavating the earth and sand remaining on the design surface DS.

The controller 30 may be configured to change the target angle θT in accordance with the distance (separation distance L) between the bucket 6 and the design surface DS. Further, the controller 30 may be configured to change the target angle θT according to the operation speed V of the bucket 6. The controller 30 may be configured to change the target angle θT regardless of the operation speed V of the bucket 6.

Further, the controller 30 may be configured to execute control for causing the working angle θ to track the target angle θT. For example, the controller 30 may be configured to control the attachment AT such that the bucket 6 located at a position higher than the design surface DS is closed as the bucket 6 approaches the design surface DS, as illustrated in FIGS. 7A to 7D. Specifically, the controller 30 may automatically extend the bucket cylinder 9 so that the bucket 6 is closed as the bucket 6 at a position higher than the design surface DS approaches the design surface DS. Alternatively, the controller 30 may automatically close the arm 5 so that the bucket 6 is closed as the bucket 6 at a position higher than the design surface DS approaches the design surface DS. Alternatively, the controller 30 may automatically close each of the arm 5 and the bucket 6 so that the bucket 6 is closed as the bucket 6 at a position higher than the design surface DS approaches the design surface DS.

The controller 30 may control the attachment AT such that the bucket 6 is opened as the bucket 6 located at a position lower than the design surface DS approaches the design surface DS, as illustrated in FIGS. 9A to 9D. For example, the controller 30 may automatically contract the bucket cylinder 9 so that the bucket 6 is opened as the bucket 6 at a position lower than the design surface DS approaches the design surface DS. Alternatively, the controller 30 may automatically open the arm 5 so that the bucket 6 is opened as the bucket 6 at a position lower than the design surface DS approaches the design surface DS. Alternatively, the controller 30 may automatically open each of the arm 5 and the bucket 6 so that the bucket 6 is opened as the bucket 6 at a position lower than the design surface DS approaches the design surface DS. This configuration brings about an effect that the claw tip 6A can be smoothly returned to the target trajectory (design surface DS) when the claw tip 6A is dug excessively from the design surface DS, that is, when the claw tip 6A deviates downward from the target trajectory (design surface DS), for example. Further, this configuration brings about an effect that further over-digging can be prevented.

Next, another embodiment will be described with reference to the drawings.

For example, there is known a technique of changing an angle of a bucket in accordance with a work environment (hardness of ground to be excavated).

However, in the conventional technique, the angle of the bucket is only automatically changed. Therefore, for example, when a machine control (MC) function causes an attachment to perform an excavation operation in a fully automatic or semi-automatic manner, it is necessary to set a target trajectory of a bucket in accordance with a work environment.

Therefore, it is desirable to provide a technique capable of easily setting a target trajectory of a bucket during excavation by a shovel.

The shovel 100 according to another embodiment described below can easily set the target trajectory of the bucket 6 during excavation.

[Overview of Shovel]

First, an overview of a shovel 100 according to another embodiment will be described with reference to FIGS. 1 and 2.

FIGS. 1 and 2 are a top view and a side view, respectively, of the shovel 100 according to another embodiment.

As illustrated in FIGS. 1 and 2, the shovel 100 according to another embodiment includes a lower traveling body 1, an upper turning body 3 mounted on the lower traveling body 1 so as to be turnable via a turning mechanism 2, an attachment AT for performing various kinds of work, and a cabin 10. Hereinafter, the front side of the shovel 100 (upper turning body 3) corresponds to a direction in which the attachment to the upper turning body 3 extends when the shovel 100 is viewed in a plan view (top view) from directly above along the pivot axis of the upper turning body 3. The left side and the right side of the shovel 100 (the upper turning body 3) correspond to the left side and the right side as viewed from an operator seated on the cockpit in the cabin 10, respectively.

As will be described later, the cabin 10 may be omitted when the shovel 100 is operated by remote control or fully automatic operation.

The lower traveling body 1 includes, for example, a pair of left and right crawlers 1C. In particular, the crawler 1C includes a left crawler 1CL and a right crawler 1CR. In the lower traveling body 1, the left crawler 1CL and the right crawler 1CR are hydraulically driven by a left traveling hydraulic motor 2ML and a right traveling hydraulic motor 2MR (see FIG. 3), respectively, so that the shovel 100 travels.

The upper turning structure 3 turns with respect to the lower traveling body 1 by the turning mechanism 2 being hydraulically driven by the turning hydraulic motor 2A.

The attachment AT (an example of a work attachment) includes a boom 4, an arm 5, and a bucket 6.

The boom 4 is attached to the center of the front portion of the upper turning body 3 so as to be able to rise and fall, the arm 5 is attached to the distal end of the boom 4 so as to be able to rotate up and down, and the bucket 6 is attached to the distal end of the arm 5 so as to be able to rotate up and down.

The bucket 6 is an example of an end attachment. The bucket 6 is used for, for example, excavation work or the like. In addition, instead of the bucket 6, another end attachment may be attached to the distal end of the arm 5 depending on the work content or the like. The other end attachments may be other types of buckets such as, for example, large buckets, slope buckets, dredging buckets, or the like. In addition, the other end attachment may be an end attachment of a type other than a bucket, such as an agitator, a breaker, or a grapple.

The boom 4, the arm 5, and the bucket 6 are hydraulically driven by a boom cylinder 7, an arm cylinder 8, and a bucket cylinder 9 as hydraulic actuators, respectively.

It should be noted that the shovel 100 may be configured such that some of the driven elements such as the lower traveling body 1, the upper turning body 3, the boom 4, the arm 5, and the bucket 6 are electrically driven. That is, the shovel 100 may be a hybrid shovel, an electric shovel, or the like in which a part of driven elements is driven by an electric actuator.

The cabin 10 is a cockpit in which an operator rides, and is mounted on the front left side of the upper turning body 3.

As will be described later, the cabin 10 may be omitted when the shovel 100 is operated by remote control or fully automatic operation.

The shovel 100 may be equipped with, for example, a communication device T1, and may be capable of communicating with an external device via a predetermined communication line.

The communication line includes, for example, a wide area network (WAN). The wide area network may include, for example, a mobile communication network terminated by a base station. The wide area network may include, for example, a satellite communication network that uses a communication satellite above the shovel 100. The wide area network may include, for example, the Internet. In addition, the communication line may include, for example, a local area network (LAN) of a facility or the like in which the external device is installed. The local network may be a wireless line, a wired line, or a line including both of them. The communication line may include, for example, a short-range communication line based on a predetermined wireless communication scheme such as WiFi or Bluetooth (registered trademark).

The external device is, for example, a management device that manages (monitors) a working state, an operation state, and the like of the shovel 100. Accordingly, the shovel 100 can transmit (upload) various types of information to the management device and receive various types of signals (for example, information signals and control signals) and the like from the management device.

The management device is, for example, a cloud server or an on-premise server installed in a remote place different from the work site of the shovel 100. In addition, the management device may be, for example, an edge server installed inside the work site of the shovel 100 (for example, an administrative office of the work site or the like) or at a place relatively close to the work site (for example, communication facilities such as nearby base stations). Further, the management device may be a terminal device for management used in a work site.

The external device may be, for example, a terminal device (user terminal) used by a user of the shovel 100. The user of the shovel 100 includes, for example, an operator, a serviceman, a manager, an owner, and the like of the shovel 100. As a result, the shovel 100 can transmit various kinds of information to the user terminal and provide the user of the shovel 100 with information on the shovel 100.

The shovel 100 operates an actuator (for example, a hydraulic actuator) in accordance with an operation of an operator who rides in the cabin 10, and drives operation elements (hereinafter, "driven elements") such as the lower traveling body 1, the upper turning body 3, the boom 4, the arm 5, the bucket 6, and the like.

Further, instead of or in addition to being configured to be operable by the operator of the cabin 10, the shovel 100 may be configured to be remotely operable from the outside of the shovel 100. When the shovel 100 is remotely operated, the inside of the cabin 10 may be in an unmanned state. Hereinafter, description will be made on the assumption that the operation of the operator includes at least one of an operation on the operation device 26 by the operator of the cabin 10 and a remote operation by an external operator.

The remote operation includes, for example, an aspect in which the shovel 100 is operated by an input from a user (operator) regarding an actuator of the shovel 100 performed by a predetermined external device (for example, the above-described management device). In this case, for example, the shovel 100 may transmit image information (hereinafter, "peripheral image") of the periphery of the shovel 100 based on an output of a space recognition device 70 (imaging device) described later to the external device, and the image information may be displayed on a display device (hereinafter, "display device for remote operation") provided in the external device. Various information images (information screens) displayed on the display device D1 in the cabin 10 of the shovel 100 may also be displayed on the remote control display device of the external device. Accordingly, the operator of the external device can remotely operate the shovel 100 while checking display contents such as a peripheral image representing a state of the periphery of the shovel 100 and various information images displayed on the remote operation display device, for example. Then, the shovel 100 may operate the actuator in accordance with a remote operation signal indicating the content of the remote operation received from the external device and drive the driven elements such as the lower traveling body 1, the upper turning body 3, the boom 4, the arm 5, the bucket 6, and the like.

The remote operation may include, for example, an aspect in which the shovel 100 is operated by a voice input, a gesture input, or the like from the outside to the shovel 100 by a person (for example, an operator) around the shovel 100. Specifically, the shovel 100 recognizes a voice uttered by a nearby worker or the like, a gesture performed by the worker or the like, through a voice input device (for example, a microphone), an imaging device, or the like mounted on the shovel 100 (reference machine). Then, the shovel 100 may operate the actuator in accordance with the content of the recognized voice, gesture, or the like to drive the driven elements such as the lower traveling body 1, the upper turning body 3, the boom 4, the arm 5, the bucket 6, and the like.

In addition, the shovel 100 may automatically operate the actuator regardless of the content of the operation by the operator. Thus, the shovel 100 realizes a function of automatically operating at least a part of the driven elements such as the lower traveling body 1, the upper turning body 3, the boom 4, the arm 5, the bucket 6, and the like that is, a so-called "automatic operation function" or "machine control function".

The automatic operation function may include a function of automatically operating a driven element (actuator) other than the driven element (actuator) to be operated in response to an operator's operation or remote operation on the operation device 26, that is, a so-called "semi-automatic operation function" or "operation-assisted machine control function". In addition, the automatic operation function may include a function of automatically operating at least a part of a plurality of driven elements (hydraulic actuators) on the assumption that there is no operation or remote operation of the operation device 26 by the operator, that is, a so-called "fully automatic operation function" or "fully automatic machine control function". When the fully automated driving function is enabled in the shovel 100, the inside of the cabin 10 may be in an unmanned state. In addition, the semi-autonomous driving function, the fully autonomous driving function, or the like may include an aspect in which the operation content of a driven element (actuator) that is a target of autonomous driving is automatically determined in accordance with a rule defined in advance. In addition, the semi-autonomous driving function, the fully autonomous driving function, or the like may include an aspect (so-called "autonomous driving function") in which the shovel 100 autonomously performs various determinations and the operation content of a driven element (hydraulic actuator), which is a target of autonomous driving, is autonomously determined according to the determination result.

<Configuration of Shovel>

Next, the configuration of the shovel 100 will be described with reference to FIGS. 3 and 10 in addition to FIGS. 1 and 2.

FIG. 3 is a diagram illustrating an example of a configuration of a hydraulic system of the shovel 100 according to another embodiment. FIG. 10 is a diagram illustrating an example of a configuration of a control system of the shovel 100 according to another embodiment.

The shovel 100 includes components such as a hydraulic drive system related to hydraulic drive of a driven element, an operation system related to operation of the driven element, a user interface system related to exchange of information with a user, a communication system related to communication with the outside, and a control system related to various controls.

<Hydraulic Drive System>

As illustrated in FIG. 3, the hydraulic drive system of the shovel 100 according to another embodiment includes hydraulic actuators that hydraulically drive the respective driven elements such as the lower traveling body 1 (the left crawler 1CL and the right crawler 1CR), the upper turning body 3, the boom 4, the arm 5, the bucket 6, and the like as described above. The hydraulic actuators include a left traveling hydraulic motor 2ML, a right traveling hydraulic motor 2MR, a turning hydraulic motor 2A, a boom cylinder 7, an arm cylinder 8, a bucket cylinder 9, and the like. Further, the hydraulic drive system of the shovel 100 according to another embodiment includes the engine 11, the regulator 13, the main pump 14, and the control valve unit 17.

The engine 11 is a prime mover and is a main power source in the hydraulic drive system. The engine 11 is, for example, a diesel engine that uses light oil as fuel. The engine 11 is mounted on, for example, a rear portion of the upper turning body 3. The engine 11 constantly rotates at a preset target rotation speed under direct or indirect control by a controller 30 described later, and drives the main pump 14 and the pilot pump 15.

Instead of or in addition to the engine 11, another prime mover may be mounted on the shovel 100. The other prime mover is, for example, an electric motor capable of driving the main pump 14 and the pilot pump 15.

The regulator 13 controls (adjusts) the discharge amount of the main pump 14 under the control of the controller 30. For example, the regulator 13 adjusts an angle of a swash plate of the main pump 14 (hereinafter, referred to as a "tilt angle") in response to a control command from the controller 30. The regulators 13 include, for example, a left regulator 13L and a right regulator 13R corresponding to a left main pump 14L and a right main pump 14R described later, respectively.

The main pump 14 supplies hydraulic oil to the control valve unit 17 through a high-pressure hydraulic line. The main pump 14 is mounted on the rear portion of the upper turning body 3, for example, similarly to the engine 11. As described above, the main pump 14 is driven by the engine 11. The main pump 14 is, for example, a variable displacement hydraulic pump, and as described above, under the control of the controller 30, the tilting angle of the swash plate is adjusted by the regulator 13 to adjust the stroke length of the piston, thereby controlling the discharge flow rate (discharge pressure). The main pump 14 includes, for example, a left main pump 14L and a right main pump 14R.

The control valve unit 17 is a hydraulic control device that controls the hydraulic actuator in accordance with the content of an operation or a remote operation performed on the operation device 26 by an operator or an operation command related to an automatic operation function output from the controller 30. The control valve unit 17 is mounted on, for example, a central portion of the upper turning body 3. As described above, the control valve unit 17 is connected to the main pump 14 via the high-pressure hydraulic line, and selectively supplies the hydraulic oil supplied from the main pump 14 to each of the hydraulic actuators in accordance with an operation of an operator or an operation command output from the controller 30. Specifically, the control valve unit 17 includes a plurality of control valves (also referred to as "direction switching valves") 171 to 176 that control the flow rate and the flow direction of the hydraulic oil supplied from the main pump 14 to each of the hydraulic actuators.

As illustrated in FIG. 3, in the hydraulic drive system, the hydraulic oil is circulated from each of the left main pump 14L and the right main pump 14R driven by the engine 11 to the hydraulic oil tank via the left center bypass oil passage 40L, the right center bypass oil passage 40R, the left parallel oil passage 42L, and the right parallel oil passage 42R.

The left center bypass oil passage 40L starts from the left main pump 14L, sequentially passes through the control valves 171, 173, 175L, and 176L disposed in the control valve unit 17, and reaches the hydraulic oil tank.

The right center bypass oil passage 40R starts from the right main pump 14R, sequentially passes through the control valves 172, 174, 175R, and 176R disposed in the control valve unit 17, and reaches the hydraulic oil tank.

The control valve 171 is a spool valve that supplies the hydraulic oil discharged from the left main pump 14L to the left traveling hydraulic motor 2ML and discharges the hydraulic oil discharged from the left traveling hydraulic motor 2ML to the hydraulic oil tank.

The control valve 172 is a spool valve that supplies the hydraulic oil discharged from the right main pump 14R to the right traveling hydraulic motor 2MR and discharges the hydraulic oil discharged from the right traveling hydraulic motor 2MR to the hydraulic oil tank.

The control valve 173 is a spool valve that supplies the hydraulic oil discharged from the left main pump 14L to the turning hydraulic motor 2A and discharges the hydraulic oil discharged from the turning hydraulic motor 2A to the hydraulic oil tank.

The control valve 174 is a spool valve that supplies the hydraulic oil discharged from the right main pump 14R to the bucket cylinder 9 and discharges the hydraulic oil in the bucket cylinder 9 to the hydraulic oil tank.

The control valve 175 includes control valves 175L and 175R. The control valves 175L and 175R are spool valves that supply the hydraulic oil discharged from the left main pump 14L and the right main pump 14R to the boom cylinder 7 and discharge the hydraulic oil in the boom cylinder 7 to the hydraulic oil tank.

The control valve 176 includes control valves 176L and 176R. The control valves 176L and 176R are spool valves that supply the hydraulic oil discharged from the left main pump 14L and the right main pump 14R to the arm cylinder 8 and discharge the hydraulic oil in the arm cylinder 8 to the hydraulic oil tank.

Each of the control valves 171, 172, 173, 174, 175L, 175R, 176L, and 176R adjusts the flow rate of the hydraulic oil supplied to and discharged from the hydraulic actuators or switches the flow direction in accordance with the pilot pressure acting on the pilot port.

The left parallel oil passage 42L supplies the hydraulic oil of the left main pump 14L to the control valves 171, 173, 175L, and 176L in parallel with the left center bypass oil passage 40L. To be specific, the left parallel oil passage 42L is branched from the left center bypass oil passage 40L on the upstream side of the control valve 171, and is configured to be able to supply the hydraulic oil of the left main pump 14L in parallel to each of the control valves 171, 173, 175L, and 176R. Accordingly, when the flow of the hydraulic oil passing through the left center bypass oil passage 40L is limited or blocked by any one of the control valves 171, 173, and 175L, the left parallel oil passage 42L can supply the hydraulic oil to the control valve further downstream.

The right parallel oil passage 42R supplies the hydraulic oil of the right main pump 14R to the control valves 172, 174, 175R, and 176R in parallel with the right center bypass oil passage 40R. To be specific, the right parallel oil passage 42R is branched from the right center bypass oil passage 40R on the upstream side of the control valve 172, and is configured to be able to supply the working oil of the right main pump 14R in parallel to each of the control valves 172, 174, 175R, and 176R. When the flow of the hydraulic oil passing through the right center bypass oil passage 40R is limited or blocked by any one of the control valves 172, 174, and 175R, the right parallel oil passage 42R can supply the hydraulic oil to the control valve further downstream.

In the left center bypass oil passage 40L and the right center bypass oil passage 40R, a left throttle 18L and a right throttle 18R are provided between the most downstream control valves 176L and 176R and the hydraulic oil tank, respectively. Accordingly, the flow of the hydraulic oil discharged by the left main pump 14L and the right main pump 14R is limited by the left throttle 18L and the right throttle 18R. The left throttle 18L and the right throttle 18R generate control pressures for controlling the left regulator 13L and the right regulator 13R.

<Operation System>

Figure 10:
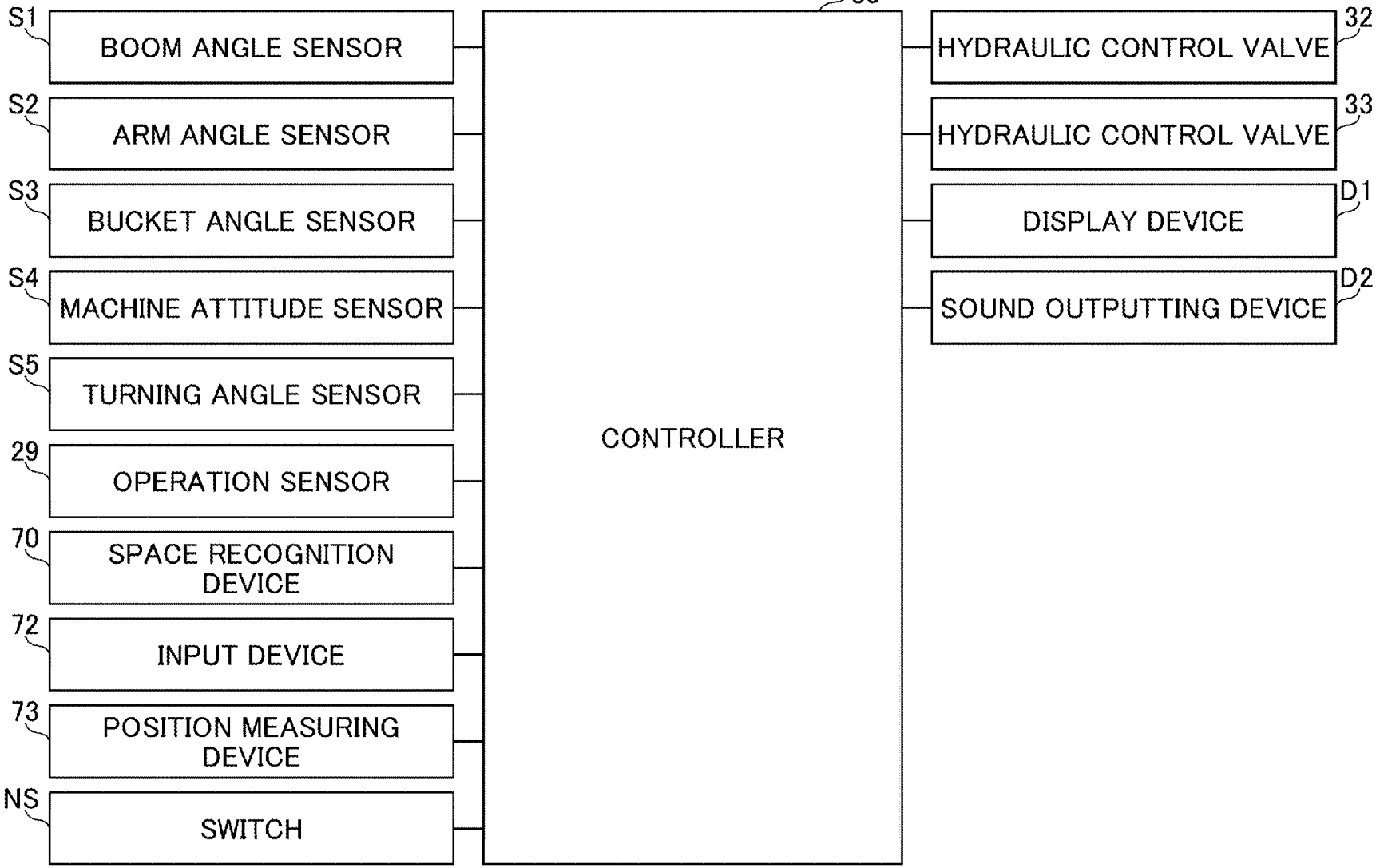
FIG. 10 is a diagram illustrating an example of a configuration of a control system of the shovel.

As illustrated in FIGS. 3 and 10, the operation system of the shovel 100 according to another embodiment includes the pilot pump 15, the operation device 26, the hydraulic control valve 32, and the hydraulic control valve 33.

The pilot pump 15 supplies a pilot pressure to various hydraulic devices via a pilot line 25. The pilot pump 15 is mounted on, for example, a rear portion of the upper turning body 3 similarly to the engine 11. The pilot pump 15 is, for example, a fixed displacement hydraulic pump, and is driven by the engine 11 as described above.

It should be noted that the pilot pump 15 may be omitted. In this case, a relatively low-pressure hydraulic oil obtained by reducing the pressure of a relatively high-pressure hydraulic oil discharged from the main pump 14 by a predetermined pressure reducing valve is supplied to various hydraulic devices as a pilot pressure.

The operation device 26 is provided in the vicinity of a cockpit of the cabin 10 and is used by an operator to operate various driven elements (the lower traveling body 1, the upper turning body 3, the boom 4, the arm 5, the bucket 6, and the like). In other words, the operation device 26 is used by the operator to operate the hydraulic actuators that drive the respective driven elements (that is, the left traveling hydraulic motor 2ML, the right traveling hydraulic motor 2MR, the turning hydraulic motor 2A, the boom cylinder 7, the arm cylinder 8, the bucket cylinder 9, and the like).

As illustrated in FIG. 3, the operation device 26 is, for example, a hydraulic pilot type. The operation device 26 is connected to the control valve unit 17 via a shuttle valve (not illustrated) provided in a pilot line on the secondary side of the operation device 26. Thus, the pilot pressure corresponding to the operation state of each driven element in the operation device 26, that is, each hydraulic actuator can be input to the control valve unit 17 via the shuttle valve. Therefore, the control valve unit 17 can drive each driven element (hydraulic actuator) in accordance with the operation state of the operation device 26. The operation device 26 includes a left operation lever 26L and a right operation lever 26R for operating the arm 5 (arm cylinder 8) and the upper turning body 3 (turning hydraulic motor 2A), and the boom 4 (boom cylinder 7) and the bucket 6 (bucket cylinder 9). The operation device 26 includes a traveling lever 26D for operating the lower traveling body 1. The traveling lever 26D includes a left traveling lever 26DL for operating the left crawler 1CL and a right traveling lever 26DR for operating the right crawler 1CR.

The left operation lever 26L is used for a turning operation of the upper turning body 3 and an operation of the arm 5.

Operations of the left operation lever 26L in the forward direction and the rearward direction as viewed from the operator in the cabin 10 (that is, the forward direction and the rearward direction of the upper turning body 3) correspond to operations of the arm 5 in the opening direction and the closing direction, respectively. When the left operation lever 26L is operated in the forward direction, the control pressure (pilot pressure) corresponding to the lever operation amount is output to the pilot line on the secondary side corresponding to the arm opening operation, using hydraulic oil discharged from the pilot pump 15. Further, when the left operation lever 26L is operated in the backward direction, the pilot pressure corresponding to the lever operation amount is output to the pilot line on the secondary side corresponding to the arm closing operation using the hydraulic oil discharged from the pilot pump 15. The pilot lines on the secondary side of the left operation lever 26L corresponding to arm opening and arm closing are connected to pilot ports corresponding to arm opening and arm closing of the control valves 176L and 176R via shuttle valves (not illustrated) for arm opening and arm closing, respectively.

Operations of the left operation lever 26L in the left direction and the right direction as viewed from the operator in the cabin 10 (that is, the left direction and the right direction of the upper turning body 3) correspond to operations of the left turning and the right turning of the upper turning body 3, respectively. When the left operation lever 26L is operated in the left direction, the left operation lever 26L uses the hydraulic oil discharged from the pilot pump 15 to output a pilot pressure corresponding to the lever operation amount to the pilot line on the secondary side corresponding to the left turning of the upper turning body 3. When the left operation lever 26L is operated in the right direction, the left operation lever 26L outputs a pilot pressure corresponding to the lever operation amount to the pilot line on the secondary side corresponding to the right turning of the upper turning body 3 by using the hydraulic oil discharged from the pilot pump 15. The pilot lines on the secondary side of the left operation lever 26L corresponding to the left turning and the right turning of the upper turning body 3 are connected to pilot ports corresponding to the left turning and the right turning of the control valve 173 via shuttle valves (not illustrated) for left turning and right turning, respectively.

The right operation lever 26R is used to operate the boom 4 and the bucket 6.

Operations of the right operation lever 26R in the forward direction and the backward direction correspond to operations of the boom 4 in the lowering direction and the raising direction, respectively. When the right operation lever 26R is operated in the forward direction, the right operation lever 26R uses the hydraulic oil discharged from the pilot pump 15 to output the pilot pressure corresponding to the lever operation amount to the pilot line on the secondary side corresponding to the boom lowering operation. When the right operation lever 26R is operated in the rearward direction, the right operation lever 26R outputs a pilot pressure corresponding to the lever operation amount to the pilot line on the secondary side corresponding to the boom raising operation by using the hydraulic oil discharged from the pilot pump 15. The pilot lines on the secondary side of the right operation lever 26R corresponding to boom raising and boom lowering are connected to pilot ports corresponding to boom raising and boom lowering of the control valves 175L and 175R via shuttle valves (not illustrated) for boom raising and boom lowering, respectively.

Operations of the right operation lever 26R in the left direction and the right direction correspond to operations of the bucket 6 in the closing direction and the opening direction, respectively. When the right operation lever 26R is operated in the left direction, the pilot pressure corresponding to the lever operation amount is output to the pilot line on the secondary side corresponding to the bucket closing operation by using the hydraulic oil discharged from the pilot pump 15. When the right operation lever 26R is operated in the right direction, the pilot pressure corresponding to the lever operation amount is output to the pilot line on the secondary side corresponding to the bucket opening operation by using the hydraulic oil discharged from the pilot pump 15. The pilot lines on the secondary side of the right operation lever 26R corresponding to bucket closing and bucket opening are connected to pilot ports corresponding to bucket closing and bucket opening of the control unit 174 via shuttle valves (not illustrated) for bucket closing and bucket opening, respectively.

As described above, the left traveling lever 26DL is used to operate the left crawler 1CL. The left traveling lever 26DL may be configured to interlock with a left traveling pedal (not illustrated). The operation of the left traveling lever 26DL in the forward direction and the rearward direction corresponds to the operation of the left crawler 1CL in the forward movement and the rearward movement, respectively. When the left traveling lever 26DL is operated in the forward direction, the left traveling lever 1CL uses the hydraulic oil discharged from the pilot pump 15 to output a pilot pressure corresponding to the lever operation amount to the pilot line on the secondary side corresponding to the forward movement operation of the left crawler 1CL. When the left traveling lever 26DL is operated in the rearward direction, the left traveling lever 26DL uses the hydraulic oil discharged from the pilot pump 15 to output a pilot pressure corresponding to the lever operation amount to the pilot line on the secondary side corresponding to the rearward movement operation of the left crawler 1CL. The pilot lines on the secondary side of the left traveling lever 26DL corresponding to forward travel and backward travel of the left crawler 1CL are connected to pilot ports corresponding to left forward travel and left backward travel of the control valve 171 via shuttle valves (not illustrated) for left forward travel and left backward travel, respectively.

As described above, the right traveling lever 26DR is used to operate the right crawler 1CR. The right traveling lever 26DR may be configured to interlock with a right traveling pedal which is not illustrated. Operations of the right traveling lever 26DR in the forward direction and the rearward direction correspond to operations of the right crawler 1CR in the forward movement and the rearward movement, respectively. When the right traveling lever 26DR is operated in the forward direction, the right traveling lever 26DR uses the hydraulic oil discharged from the pilot pump 15 to output a pilot pressure corresponding to the lever operation amount to the pilot line on the secondary side corresponding to the forward movement operation of the right crawler 1CR. When the right traveling lever 26DR is operated in the rearward direction, the right traveling lever 26DR outputs a pilot pressure corresponding to the lever operation amount to the pilot line on the secondary side corresponding to the rearward movement operation of the right crawler 1CR by using the hydraulic oil discharged from the pilot pump 15. The pilot lines on the secondary side of the right traveling lever 26DR corresponding to forward travel and backward travel of the right crawler 1CR are connected to pilot ports corresponding to right forward travel and right backward travel of the control valve 171 via shuttle valves (not illustrated) for right forward travel and right backward travel, respectively.

The hydraulic control valve 32 is provided in a pilot line connecting between the pilot pump 15 and the above-described shuttle valve. The hydraulic control valve 32 outputs a pilot pressure corresponding to a control command (control current) from the controller 30 to the pilot line on the secondary side by using the hydraulic oil discharged from the pilot pump 15. The hydraulic control valve 32 is, for example, an electromagnetic proportional valve configured to be able to change a flow path area thereof in response to a control command (control current) from the controller 30. The pilot line on the secondary side of the hydraulic control valve 32 is connected to the control valve unit 17 (pilot ports of the control valves 171 to 176) through the above-described shuttle valve. A pilot line on the secondary side of the operation device 26 is connected to one inlet port of the shuttle valve, and a pilot line on the secondary side of the hydraulic control valve 32 is connected to the other inlet port. Thus, the controller 30 can cause the pilot pressure of the hydraulic control valve 32 to act on the control valve unit 17 via the shuttle valve by causing the hydraulic control valve 32 to output a pilot pressure greater than the pilot pressure on the secondary side of the operation device 26. Therefore, the controller 30 can drive the hydraulic actuator regardless of the operation of the operation device 26.

The operation device 26 (the left operation lever 26L, the right operation lever 26R, the left traveling lever 26DL, and the right traveling lever 26DR) may be an electric type that outputs an electric signal (hereinafter, "operation signal") corresponding to an operation content. In this case, the above-described shuttle valve may be omitted, and the output (operation signal) of the operation device 26 may be taken into the controller 30, for example, and the controller 30 may output a control command corresponding to the operation signal, that is, a control command corresponding to the operation content of the operation device 26 to the hydraulic control valve 32. The hydraulic control valve 32 may output the pilot pressure corresponding to the control command from the controller 30 by using the hydraulic oil supplied from the pilot pump 15, and directly apply the pilot pressure to the pilot port of the control valve corresponding to the operation content of the control valve unit 17. As a result, the controller 30 can control the hydraulic control valve 32 to reflect the operation content of the operation device 26 on the operation of the control valve unit 17. Therefore, the controller 30 can realize operations of various driven elements in accordance with the operation content of the electric operation device 26.

In addition, for example, the controller 30 may realize remote control of the shovel 100 using the hydraulic control valve 32. Specifically, the controller 30 may output a control command corresponding to the content of the remote operation designated by the remote operation signal received from the external device to the hydraulic control valve 32. The hydraulic control valve 32 may output the pilot pressure corresponding to the control command from the controller 30 using the hydraulic oil supplied from the pilot pump 15, and apply the pilot pressure to the pilot port of the control valve of the control valve unit 17 corresponding to the control command. As a result, the controller 30 can control the hydraulic control valve 32 and reflect the content of the remote operation on the operation of the control valve unit 17. Therefore, the shovel 100 can realize operations of various driven elements in accordance with the content of the remote operation by the hydraulic actuator.

Further, for example, the controller 30 may control the hydraulic control valve 32 to realize an automatic operation function. Specifically, the controller 30 outputs a control signal corresponding to an operation command related to the automatic operation function to the hydraulic control valve 32 regardless of whether or not the operation device 26 is operated. As a result, the controller 30 causes the hydraulic control valve 32 to supply the pilot pressure corresponding to the operation command related to the automatic operation function to the control valve unit 17, and can realize the operation of the shovel 100 based on the automatic operation function.

The hydraulic control valve 32 is provided for each driven element (hydraulic actuator) to be operated by the operation device 26 and for each operating direction of the driven element. That is, two hydraulic control valves 32 corresponding to two operation directions are provided for each of the plurality of hydraulic actuators. For example, the arm closing and arm opening hydraulic control valves 32 are connected to the other inlet ports of the arm closing and arm opening shuttle valves described above, respectively. Further, for example, the hydraulic control valves 32 for left turning and right turning are connected to the other inlet ports of the hydraulic control valves 32 for left turning and right turning, respectively. Further, for example, the hydraulic control valves 32 for boom raising and boom lowering are connected to the other inlet ports of the hydraulic control valves 32 for boom raising and boom lowering, respectively. For example, the hydraulic control valve 32 for bucket closing and bucket opening is connected to the other inlet port of the shuttle valve for bucket closing and bucket opening described above. Further, for example, the hydraulic control valves 32 for left forward movement and left backward movement are connected to the other inlet ports of the shuttle valves for left forward movement and right backward movement, respectively. Further, for example, the hydraulic control valve 32 for right forward movement and right backward movement is connected to the other inlet port of the hydraulic control valve 32 for right forward movement and right backward movement.

When the operation device 26 is an electric type, the control valves 171 to 176 of the control valve unit 17 may be electromagnetic solenoid type spool valves. In this case, the hydraulic control valve 32 is omitted, and the output (operation signal) of the operation device 26 is directly input to the electromagnetic solenoid type spool valve.

The hydraulic control valve 33 is provided in a pilot line connecting the operation device 26 and the above-described shuttle valve. The hydraulic control valve 33 operates in response to a control command input from the controller 30. The hydraulic control valve 33 is, for example, an electromagnetic proportional valve configured to be able to change a flow path area thereof in response to a control command (control current) from the controller 30. Thus, when the operation device 26 is operated by the operator, the controller 30 can forcibly reduce the pilot pressure output from the operation device 26. Therefore, even when the operation device 26 is operated, the controller 30 can forcibly decelerate or stop the operation of the hydraulic actuator corresponding to the operation of the operation device 26. For example, when the operation device 26 is operated, the controller 30 can reduce the pilot pressure output from the operation device 26 to be lower than the pilot pressure output from the hydraulic pressure control valve 32. Therefore, by controlling the hydraulic pressure control valve 32 and the hydraulic pressure control valve 33, the controller 30 can reliably apply a desired pilot pressure to the pilot port of the control valve of the control valve unit 17 regardless of the operation content of the operation device 26, for example. Therefore, for example, the controller 30 can more appropriately realize the automatic operation function and the remote operation function of the shovel 100 by controlling the hydraulic control valve 33 in addition to the hydraulic control valve 32.

When the operation device 26 is of an electric type, the hydraulic control valve 33 may be omitted.

<User Interface System>

As illustrated in FIGS. 3 and 10, the user interface system of the shovel 100 according to another embodiment includes the operation device 26, the input device 72, the display device D1, the sound outputting device D2, and the switch NS.

The input device 72 is provided in a range close to an operator seated in the cabin 10, receives various inputs from the operator, and a signal corresponding to the received input is taken into the controller 30.

For example, the input device 72 is an operation input device that receives an operation input. The operation input device may include a touch panel mounted on the display device D1, a touch pad, a button switch, a lever, a toggle provided around the display device D1, and a knob switch and the like provided in the operation device 26 (lever device).

In addition, for example, the input device 72 may be a voice input device that receives voice input of an operator. The voice input device includes, for example, a microphone.

In addition, for example, the input device 72 may be a gesture input device that receives a gesture input of an operator. The gesture input device includes, for example, an imaging device (indoor camera) installed in the cabin 10.

The display unit D1 is provided at a location that is easily visible to the seated operator in the cabin 10, displays various information images, and outputs various information by a visual method. The display device D1 is, for example, a liquid-crystal display or an organic electroluminescence (EL) display.

In addition to the display device, a lighting device or the like capable of outputting various kinds of information by a visual method may be provided inside the cabin 10. The lighting device is, for example, a warning lamp or the like.

The sound outputting device D2 outputs various kinds of information by an auditory method. Examples of the sound outputting device D2 include a buzzer, an alarm, a speaker, and the like.

It should be noted that an output device capable of outputting various kinds of information by a method other than the visual method and the auditory method, for example, a tactile method such as vibration of the cockpit may be provided inside the cabin 10.

The switch NS is, for example, a push-button switch provided at the tip of the left operation lever 26L. The operator can operate the left operation lever 26L while pressing the switch NS. For example, when an operation of the arm 5 of the left operation lever 26L (that is, a tilting operation of the left operation lever 26L in the front-rear direction) is performed in a state where the switch NS is pressed, the operation-assisted machine control function may be enabled. For example, when the switch NS is pressed in a state where the machine control function is disabled, the machine control function may be enabled, and when the switch NS is pressed in a state where the machine control function is enabled, the machine control function may be disabled. The switch NS may be provided on the right operation lever 26R, or may be provided at another position in the cabin 10. A signal corresponding to the operation state of the switch NS is taken into the controller 30.

<Communication System>

Figure 12:
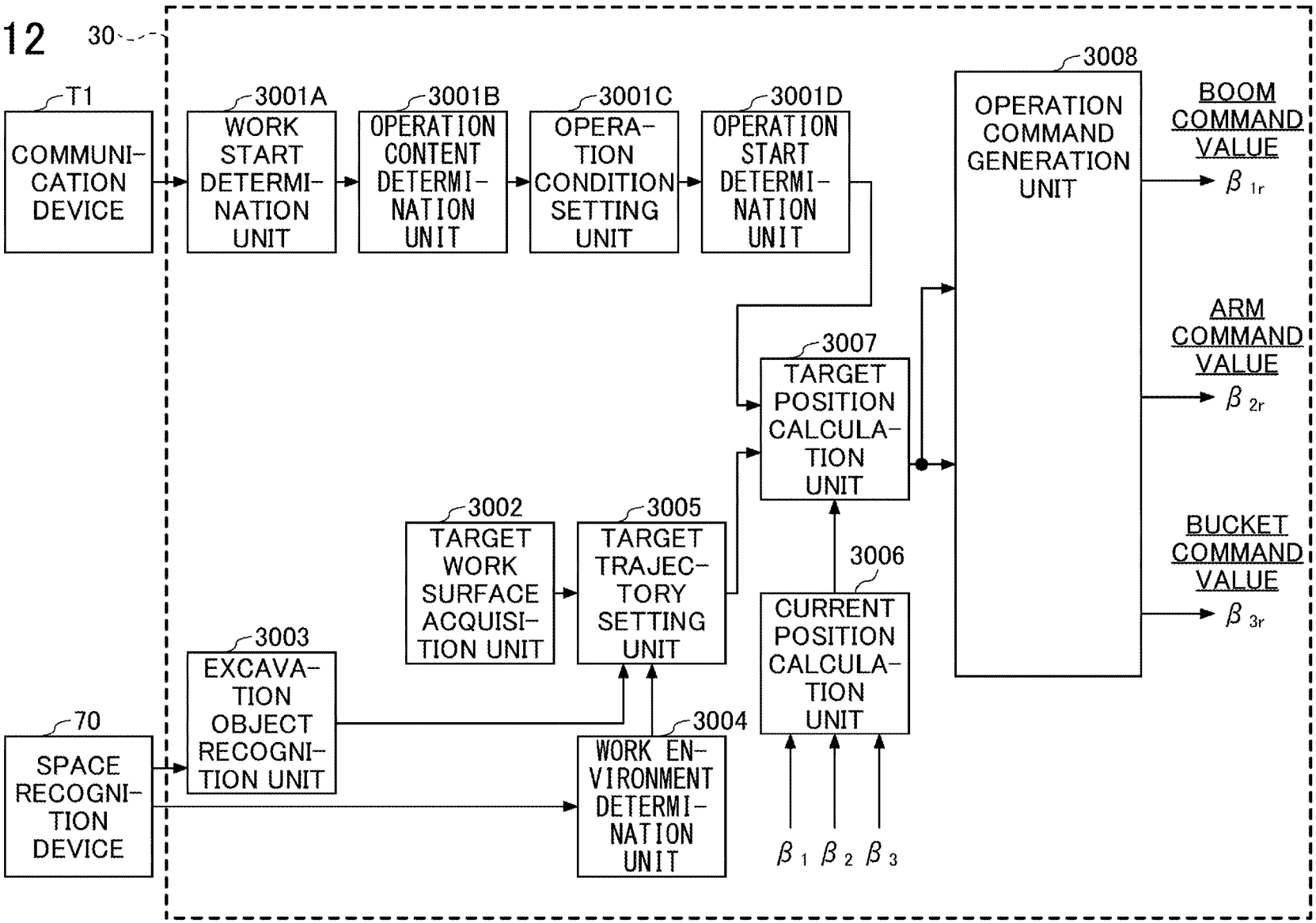
FIG. 12 is a functional block diagram illustrating another example of the functional configuration for the machine control function of the shovel.

As illustrated in FIG. 12, the communication system of the shovel 100 according to another embodiment includes a communication device T1.

The communication device T1 is connected to a predetermined communication line and communicates with a device (for example, a management device) provided separately from the shovel 100. The device provided separately from the shovel 100 may include a portable terminal device brought into the cabin 10 by the user of the shovel 100 in addition to a device provided outside the shovel 100. The communication device T1 may include, for example, a mobile communication module conforming to a standard such as 4th Generation (4G) or 5th Generation (5G). The communication device T1 may also include, for example, a satellite communications module. In addition, the communication device T1 may include, for example, a WiFi communication module, a Bluetooth communication module, or the like. In addition, the communication device T1 may include, for example, a communication module or the like capable of performing wired communication with a device or the like connected through a cable connected to a predetermined connector.

<Control System>

As illustrated in FIGS. 3 and 10, the control system of the shovel 100 according to another embodiment includes a controller 30. Further, the control system of the shovel 100 according to another embodiment includes the control pressure sensor 19, the discharge pressure sensor 28, the operation sensor 29, the space recognition device 70, and the position measuring device 73. A control system of the shovel 100 according to another embodiment includes a boom angle sensor S1, an arm angle sensor S2, a bucket angle sensor S3, a machine attitude sensor S4, and a turning angle sensor S5.

The controller 30 (an example of a control device) performs various types of control related to the shovel 100. The functions of the controller 30 may be realized by arbitrary hardware, a combination of arbitrary hardware and software, or the like. For example, the controller 30 is mainly configured by a computer including a central processing unit (CPU), a memory device such as a random access memory (RAM), a non-volatile auxiliary storage device such as a read only memory (ROM), interface devices for various input and output, and the like. For example, the controller realizes various functions by loading a program installed in the auxiliary storage device into the memory device and executing the program on the CPU.

For example, the controller 30 controls the left main pump 14L and the right main pump 14R.

To be specific, the controller 30 may control the left regulator 13L and the right regulator 13R in accordance with the discharge pressures of the left main pump 14L and the right main pump 14R detected by the left discharge pressure sensor 28L and the right discharge pressure sensor 28R to adjust the discharge amounts of the left main pump 14L and the right main pump 14R. For example, the controller 30 may decrease the discharge amount by controlling the left regulator 13L and adjusting the swash plate tilt angle of the left main pump 14L in accordance with an increase in the discharge pressure of the left main pump 14L. The same applies to the right regulators 13R. As a result, the controller 30 can perform the total horsepower control of the left main pump 14L and the right main pump 14R so that the absorption horsepower of the left main pump 14L and the right main pump 14R represented by the product of the discharge pressure and the discharge amount does not exceed the power horsepower of the engine 11.

Further, the controller 30 may adjust the discharge amounts of the left main pump 14L and the right main pump 14R by controlling the left regulator 13L and the right regulator 13R in accordance with the control pressures detected by the left control pressure sensor 19L and the right control pressure sensor 19R. For example, the controller 30 decreases the discharge amounts of the left main pump 14L and the right main pump 14R as the control pressure increases, and increases the discharge amounts of the left main pump 14L and the right main pump 14R as the control pressure decreases.

In a standby state (see FIG. 3) in which none of the hydraulic actuators in the shovel 100 is operated, the hydraulic oil discharged from the left main pump 14L and the right main pump 14R reaches the left throttle 18L and the right throttle 18R through the left center bypass oil passage 40L and the right center bypass oil passage 40R. The flow of the hydraulic oil discharged from the left main pump 14L and the right main pump 14R increases the control pressure generated upstream of the left throttle 18L and the right throttle 18R. As a result, the controller 30 reduces the discharge amounts of the left main pump 14L and the right main pump 14R to the allowable minimum discharge amount, and suppresses the pumping loss when the discharged hydraulic oil passes through the left center bypass oil passage 40L and the right center bypass oil passage 40R.

On the other hand, when any of the hydraulic actuators is operated, the hydraulic oil discharged from the left main pump 14L and the right main pump 14R flows into the hydraulic actuators to be operated via the control valves corresponding to the hydraulic actuators to be operated. The flow of the hydraulic oil discharged from the left main pump 14L and the right main pump 14R reduces or eliminates the amount of the hydraulic oil reaching the left throttle 18L and the right throttle 18R to reduce the control pressure generated upstream of the left throttle 18L and the right throttle 18R. As a result, the controller 30 can increase the discharge amounts of the left main pump 14L and the right main pump 14R, circulate a sufficient amount of hydraulic oil to the hydraulic actuators to be operated, and reliably drive the hydraulic actuators to be operated.

In addition, the controller 30 controls operation of a hydraulic actuator (driven element) of the shovel 100, for example, with the hydraulic control valve 32 as a control target.

Specifically, when the operation device 26 is an electric type, the controller 30 may control the hydraulic control valve 32 as a control target and control the operation of the hydraulic actuator (driven element) of the shovel 100 based on the operation of the operation device 26.

Further, the controller 30 may control a remote operation of the hydraulic actuator (driven element) of the shovel 100 with the hydraulic control valve 32 as a control target. That is, the operation of the hydraulic actuator (driven element) of the shovel 100 may include a remote operation of the hydraulic actuator from the outside of the shovel 100.

In addition, the controller 30 may control the automatic operation function of the shovel 100 with the hydraulic control valve 32 as a control target. That is, the operation of the hydraulic actuator of the shovel 100 may include an operation command of the hydraulic actuator of the shovel 100 output based on the automatic operation function.

In addition, the controller 30 controls, for example, a periphery monitoring function. In the periphery monitoring function, entry of a monitoring target object into a predetermined range (hereinafter, referred to as a "monitoring range") around the shovel 100 is monitored based on information acquired by the space recognition device 70. The process of determining the entry of the monitoring target object into the monitoring range may be performed by the space recognition device 70 or may be performed by the outside (for example, the controller 30) of the space recognition device 70. Objects to be monitored may include, for example, people, trucks, other construction equipment, utility poles, suspended loads, pylons, buildings, and the like.

In addition, the controller 30 controls, for example, an object detection notification function. In the object detection notification function, when it is determined that the object to be monitored is present in the monitoring range by the periphery monitoring function, the presence of the object to be monitored with respect to the operator in the cabin 10 and the periphery of the shovel 100 is notified. The controller 30 may realize the object detection notification function using, for example, the display device D1 or the sound outputting device D2.

In addition, for example, the controller 30 controls an operation restriction function. In the operation restriction function, for example, when it is determined by the periphery monitoring function that an object to be monitored is present in the monitoring targets, the operation of the shovel 100 is restricted.

For example, when it is determined that a person is present within a predetermined range (monitoring range) from the shovel 100 based on the information acquired by the space recognition device 70 before the actuator operates, the controller 30 may restrict the operation of the actuator to an inoperable state or an operation in a slow speed state even if the operator operates the operation device 26. Specifically, when it is determined that a person is present within the monitoring range, the controller 30 can disable the actuator by setting the gate lock valve to the locked state. In the case of an electrical operation device 26, the actuator can be disabled by disabling the signal from the controller 30 to the hydraulic control valve 32. The same applies to the case where the hydraulic control valve 32 that outputs a pilot pressure corresponding to a control command from the controller 30 and causes the pilot pressure to act on a pilot port of a corresponding control valve in the control valve unit 17 is used in the operation device 26 of another type. When it is desired to operate the actuator at a very low speed, the control signal from the controller 30 to the hydraulic control valve 32 is limited to a content corresponding to a relatively small pilot pressure, so that the operation of the actuator can be brought into a very low speed state. As described above, when it is determined that the detected object to be monitored is present in the monitoring range, the actuator is not driven even when the operation device 26 is operated, or is driven at an operation speed (slow speed) lower than the operation speed corresponding to the operation input to the operation device 26. Furthermore, when it is determined that a person is present within the monitoring range while the operator is operating the operation device 26, the operation of the actuator may be stopped or decelerated regardless of the operation by the operator. Specifically, when it is determined that a person is present within the monitoring range, the actuator may be stopped by setting the gate lock valve to the locked state. When a hydraulic control valve 32 that outputs a pilot pressure corresponding to a control command from the controller 30 and applies the pilot pressure to a pilot port of a corresponding control valve in the control valve is used, the actuator can be disabled or limited to operation in a slow speed state by disabling a signal from the controller 30 to the hydraulic control valve 32 or outputting a deceleration command to the hydraulic control valve 32. When the detected object to be monitored is a truck, the control related to the stop or deceleration of the actuator may not be performed. For example, the actuator may be controlled to avoid the detected truck. In this way, the type of detected object may be recognized and the actuator may be controlled based on that recognition.

Further, for example, the controller 30 controls a machine guidance function and a machine control function (automatic operation function). Details will be described later.

A part of the functions of the controller may be realized by another controller (control device). That is, the functions of the controller 30 may be realized by a plurality of controllers in a distributed manner.

The control pressure sensor 19 includes a left control pressure sensor 19L and a right control pressure sensor 19R. The left control pressure sensor 19L and the right control pressure sensor 19R detect control pressures of the left throttle 18L and the right throttle 18R, respectively, and detection signals corresponding to the detected control pressures are taken into the controller 30.

The discharge pressure sensor 28 includes a left discharge pressure sensor 28L and a right discharge pressure sensor 28R. The left discharge pressure sensor 28L and the right discharge pressure sensor 28R detect the discharge pressures of the left main pump 14L and the right main pump 14R, respectively, and detection signals corresponding to the detected discharge pressures are taken into the controller 30.

The operation sensor 29 detects a pilot pressure on the secondary side of the hydraulic pilot type operation device 26, that is, a pilot pressure corresponding to an operation state of each driven element (hydraulic actuator) in the operation device 26. A detection signal of a pilot pressure corresponding to an operation state of the lower traveling body 1, the upper turning body 3, the boom 4, the arm 5, the bucket 6, and the like in the operation device 26 by the operation sensor 29 is taken into the controller 30. The operation sensor 29 includes operation sensors 29LA, 29LB, 29RA, 29RB, 29DL, and 29DR.

The operation sensor 29LA detects an operation content (for example, an operation direction and an operation amount) in the front-rear direction with respect to the left operation lever 26L by the operator in the form of a hydraulic oil pressure (hereinafter, referred to as an "operation pressure") of the pilot line on the secondary side of the left operation lever 26L.

The operation sensor 29LB detects an operation content (for example, an operation direction and an operation amount) in the left-right direction with respect to the left operation lever 26L by the operator in the form of an operation pressure of the pilot line on the secondary side of the left operation lever 26L.

The operation sensor 29RA detects an operation content (for example, an operation direction and an operation amount) in the front-rear direction with respect to the right operation lever 26R by the operator in the form of an operation pressure of the pilot line on the secondary side of the right operation lever 26R.

The operation sensor 29RB detects an operation content (for example, an operation direction and an operation amount) in the left-right direction with respect to the right operation lever 26R by the operator in the form of an operation pressure of the pilot line on the secondary side of the right operation lever 26R.

The operation sensor 29DL detects an operation content (for example, an operation direction and an operation amount) in the front-rear direction with respect to the left traveling lever 26DL by the operator in the form of an operation pressure of the pilot line on the secondary side of the left traveling lever 26DL.

The operation sensor 29DR detects an operation content (for example, an operation direction and an operation amount) in the front-rear direction with respect to the right traveling lever 26DR by the operator in the form of an operation pressure of the pilot line on the secondary side of the right traveling lever 26DR.

The operation content of the operation device 26 (the left operation lever 26L, the right operation lever 26R, the left traveling lever 26DL, and the right traveling lever 26DR) may be detected by sensors other than the operation sensor 29 (for example, potentiometers attached to the right operation lever 26R, the left traveling lever 26DL, and the right traveling lever 26DR). When the operation device 26 is an electric type, the operation sensor 29 is omitted. In this case, the controller 30 can grasp the operation state of each driven element (hydraulic actuator) based on the operation signal taken in from the electric operation device 26.

The space recognition device 70 is configured to recognize an object existing in a three dimensional space around the shovel 100 and to measure (calculate) a positional relationship such as a distance from the space recognition device 70 or the shovel 100 to the recognized object. The space recognition device 70 may include, for example, a distance sensor capable of measuring a distance to an object around the shovel 100, such as an ultrasonic sensor, a millimeter wave radar, an infrared sensor, or light detecting and ranging (LIDAR). The space recognition device 70 may include, for example, an imaging device such as a monocular camera, a stereo camera, a distance image camera, or a depth camera.

As illustrated in FIGS. 1 and 2, the space recognition device 70 includes a front sensor 70F attached to the front end of the upper surface of the cabin 10, a rear sensor 70B attached to the rear end of the upper surface of the upper turning body 3, a left sensor 70L attached to the left end of the upper surface of the upper turning body 3, and a right sensor 70R attached to the right end of the upper surface of the upper turning body 3. Further, an upper sensor that recognizes an object present in a space above the upper turning body 3 may be attached to the shovel 100.

The position measuring device 73 measures a position and a direction of the upper turning body 3. The position measuring device 73 is, for example, a global navigation satellite system (GNSS) compass and detects the position and the direction of the upper turning body 3, and a detection signal corresponding to the position and the direction of the upper turning body 3 is taken into the controller 30. Further, among the functions of the position measuring device 73, the function of detecting the direction of the upper turning body 3 may be replaced by a direction sensor attached to the upper turning body 3.

The boom angle sensor S1 acquires detection information related to an attitude angle (hereinafter referred to as a "boom angle") of the boom 4 with respect to a predetermined reference (for example, a horizontal plane, a state of one of both ends of a movable angle range of the boom 4, or the like). The boom angle sensor S1 may include, for example, a rotary encoder, an accelerometer, an angular velocity sensor, a six-axis sensor, an inertial measurement unit (IMU), or the like. Further, the boom angle sensor S1 may include a cylinder sensor capable of detecting the extension and contraction position of the boom cylinder 7.

The arm angle sensor S2 acquires detection information related to an attitude angle of the arm 5 (hereinafter referred to as an "arm angle") with respect to a predetermined reference (for example, a straight-line connecting connection points at both ends of the boom 4, a state of one of both ends of a movable angle range of the arm 5, or the like). The arm angle sensor S2 may include, for example, a rotary encoder, an accelerometer, an angular velocity sensor, a six-axis sensor, an IMU, or the like. Further, the arm angle sensor S2 may include a cylinder sensor capable of detecting the extension and contraction position of the arm cylinder 8.

The bucket angle sensor S3 acquires detection information related to an attitude angle (hereinafter referred to as a "bucket angle") of the bucket 6 with respect to a predetermined reference (for example, a straight-line connecting connection points at both ends of the arm 5, a state of one of both ends of a movable angle range of the bucket 6, or the like). The bucket angle sensor S3 may include, for example, a rotary encoder, an accelerometer, an angular velocity sensor, a six-axis sensor, an IMU, or the like. Further, the bucket angle sensor S3 may include a cylinder sensor capable of detecting the extension and contraction position of the bucket cylinder 9.

The machine attitude sensor S4 acquires detection information on an attitude state of the machine body including the lower traveling body 1 and the upper turning body 3. The attitude state of the machine body includes an inclination state of the machine body. The inclination state of the machine body includes, for example, an inclination state in the front-rear direction corresponding to an attitude state around the left-right axis of the upper turning body 3 and an inclination state in the left-right direction corresponding to an attitude state around the front-rear axis of the upper turning body 3. The attitude state of the machine body includes a turning state of the upper turning body 3 corresponding to an attitude state around the pivot axis of the upper turning body 3. The machine body attitude sensor S4 is mounted on, for example, the upper turning body 3, and acquires (outputs) detection information regarding attitude angles (hereinafter referred to as "front-rear inclination angle" and "left-right inclination angle") about the front-rear axis, the left-right axis, and the turning axes of the upper turning body 3. As a result, the body attitude sensor S4 can acquire detection information regarding the orientation of the upper turning body 3 with respect to the ground (turning attitude about the turning shaft). The orientation of the upper turning body 3 means, for example, a direction in which the attachment AT extends in a top view, that is, a front side viewed from the upper turning body 3. The machine attitude sensor S4 may include, for example, an accelerometer sensor (inclination sensor), an angular velocity sensor, a six-axis sensor, an IMU, or the like.

It should be noted that the information on the direction of the upper turning body 3 with respect to the ground may be acquired from another device instead of or in addition to the machine attitude sensor S4. For example, a geomagnetic sensor may be mounted on the upper turning body 3. In this case, the controller 30 can acquire information on the direction of the upper turning body 3 with respect to the ground from the geomagnetic sensor. In addition, for example, the controller 30 may determine the direction of the upper turning body 3 with respect to the ground by determining the direction in which a surrounding object (in particular, a fixed object such as a utility pole or a tree) is present on the basis of the output (captured image) of the space recognition device 70 (imaging device). That is, the information on the direction of the upper turning body 3 with respect to the ground may be acquired from the space recognition device 70 (imaging device).

The turning angle sensor S5 acquires detection information on a relative turning angle of the upper turning body 3 with respect to the lower traveling body 1. As a result, the turning angle sensor S5 acquires the detection information regarding the turning angle of the upper turning body 3 with respect to, for example, a predetermined reference (for example, a state in which the forward movement direction of the lower turning body 1 coincides with the front of the upper turning body 3). The turning angle sensor S5 includes, for example, a potentiometer, a rotary encoder, a resolver, or the like. The turning angle sensor S5 may include, for example, a combination of a geomagnetic sensor attached to the lower traveling body 1 and a geomagnetic sensor attached to the upper turning body 3. The turning angle sensor S5 may include a combination of a GNSS receiver attached to the lower traveling body 1 and a GNSS receiver attached to the upper turning body 3.

The information on the direction of the upper turning body 3 with respect to the lower traveling body 1 may be acquired from another device instead of or in addition to the turning angle sensor S5. For example, the direction of the upper turning body 3 with respect to the lower turning body 1 may be determined by determining the direction of the reflected lower turning body 1 based on a captured image of the space recognition device 70 (imaging device) attached to the upper turning body 3. Specifically, the controller 30 extracts the image of the lower traveling body 1 included in the captured image by performing known image processing. Then, the controller 30 may specify the longitudinal direction of the lower traveling body 1 using a known image recognition technique, and derive an angle formed between the direction of the longitudinal axis of the upper turning body 3 and the longitudinal direction of the lower traveling body 1. At this time, the direction of the longitudinal axis of the upper turning body 3 can be derived from the attachment position of the space recognition device 70 that has acquired the captured image. In particular, since the crawler 1C protrudes from the upper turning body 3, the controller can specify the longitudinal direction of the lower traveling body 1 by extracting the image of the crawler 1C. In addition, the direction of the upper turning body 3 with respect to the ground and the orientation of the upper turning body 3 with respect to the lower traveling body 1 may be simply assumed to be substantially the same. In this case, the turning angle sensor S5 may be omitted.

[Overview of Machine Guidance Function and Machine Control Function of Shovel]

Next, an outline of the machine guidance function and the machine control function of the shovel 100 will be described with reference to FIG. 10.

The controller 30 executes, for example, control of the shovel 100 related to a machine guidance function of guiding a manual operation of the shovel 100 by an operator.

For example, the controller 30 transmits work information such as a distance between the target work surface and the tip end portion of the attachment AT, that is, a predetermined work site of the bucket 6 (for example, a claw tip of the bucket 6, a back surface of the bucket 6, or the like) (hereinafter, simply referred to as a "work site") to the operator through the display device D1, the sound outputting device D2, or the like. To be specific, the controller acquires information from the boom angle sensor S1, the arm angle sensor S2, the bucket angle sensor S3, the machine attitude sensor S4, the turning angle sensor S5, the space recognition device 70, the position measuring device 73, the input device 72, and the like. Then, for example, the controller 30 may calculate the distance between the bucket 6 and the target work surface based on the acquired information, and notify the operator of the calculated distance by an image displayed on the display device D1 or a sound outputted from the sound outputting device D2. The data related to the target work surface is stored in an internal memory, an external storage device connected to the controller 30, or the like, for example, based on a setting input through the input device 72 by the operator or by being downloaded from the outside (for example, a predetermined management server). The data related to the target work surface is represented by, for example, a reference coordinate system. The reference coordinate system is, for example, the world geodetic system. The world geodetic system is a three dimensional orthogonal XYZ coordinate system in which the origin is located at the center of gravity of the earth, the X-axis is in the direction of the intersection of the Greenwich meridian and the equator, the Y-axis is in the direction of 90 degrees east longitude, and the Z-axis is in the direction of the north pole. For example, an operator may determine an arbitrary point of the construction site as a reference point, and may set the target work surface based on a relative positional relationship with the reference point through the input device 72. Accordingly, the controller 30 can notify the operator of the work information through the display device D1, the sound outputting device D2, and the like, and guide the operator to operate the shovel 100 through the operation device 26.

In addition, the controller 30 executes control of the shovel 100 related to a machine control function of assisting manual operation of the shovel 100 by an operator or causing the shovel 100 to operate fully automatically or autonomously, for example.

The controller 30 automatically operates at least one of the boom 4, the arm 5, and the bucket 6 so that the target work surface coincides with a position serving as a control reference (hereinafter, simply referred to as a "control reference") set for the distal end portion of the attachment AT, specifically, the work part of the bucket 6, for example, when an operator is manually performing ground excavation operations, leveling operations, or the like. The control reference can include, for example, a plane or a curved surface constituting a claw tip as a work part of the bucket 6, a line segment defined on the plane or the curved surface, a point defined on the plane or the curved surface, and the like. In addition, the control reference may include, for example, a plane or a curved surface constituting the back surface as the work part of the bucket 6, a line segment defined on the plane or the curved surface, a point defined on the plane or the curved surface, and the like. To be more specific, when the operator operates the arm 5 through the left operation lever 26L while operating (pushing) the switch NS, the controller 30 automatically operates the boom 4, the arm 5, and the bucket 6 so that the target work surface and the control reference of the bucket 6 coincide with each other in response to the operation of the arm 5 by the operator. More specifically, as described above, the controller 30 controls the hydraulic control valve 32 to automatically operate the boom 4, the arm 5, and the bucket 6. Accordingly, the operator can cause the shovel 100 to perform the excavation work, the leveling work, or the like along the target work surface only by operating the left operation lever 26L in the front-rear direction.

The work part of the bucket 6 may be set, for example, according to a setting input through the input device 72 by an operator or the like. Further, the work part of the bucket 6 may be automatically set in accordance with the work content of the shovel 100, for example. Specifically, the work part of the bucket 6 may be set at the claw tip of the bucket 6 when the work content of the shovel 100 is excavation work or the like, and may be set at the back surface of the bucket 6 when the work content of the shovel 100 is leveling work, rolling work, or the like. In this case, the work content of the shovel 100 may be automatically determined on the basis of the captured image or the like of the imaging device included in the space recognition device 70 (front sensor 70F), or may be set in accordance with the selection content or the input content by selection or input by the operator or the like through the input device 72.

For example, when the work part is the claw tip of the bucket 6, the control reference in the work part of the bucket 6 (hereinafter simply referred to as "the control reference of the bucket 6") may be set to one point on a curved surface or a plane constituting the claw tip of a specific one of the plurality of claws of the bucket 6. Further, for example, when the work part is the back surface of the bucket 6, the control reference of the bucket 6 can be arbitrarily set on a curved surface or a plane surface constituting the back surface of the bucket 6. In this case, the controller 30 may set the control reference for the back surface of the bucket 6 in accordance with a setting operation performed by an operator or the like through the input device 72, or may automatically set (change) the control reference for the back surface of the bucket 6 based on a predetermined condition as described later.

[Configuration Relating to Operation-Assisted Machine Control Function]

Next, with reference to FIG. 11, a functional configuration related to the operation-assisted machine control function (semi-automatic operation function) will be described.

Figure 11:
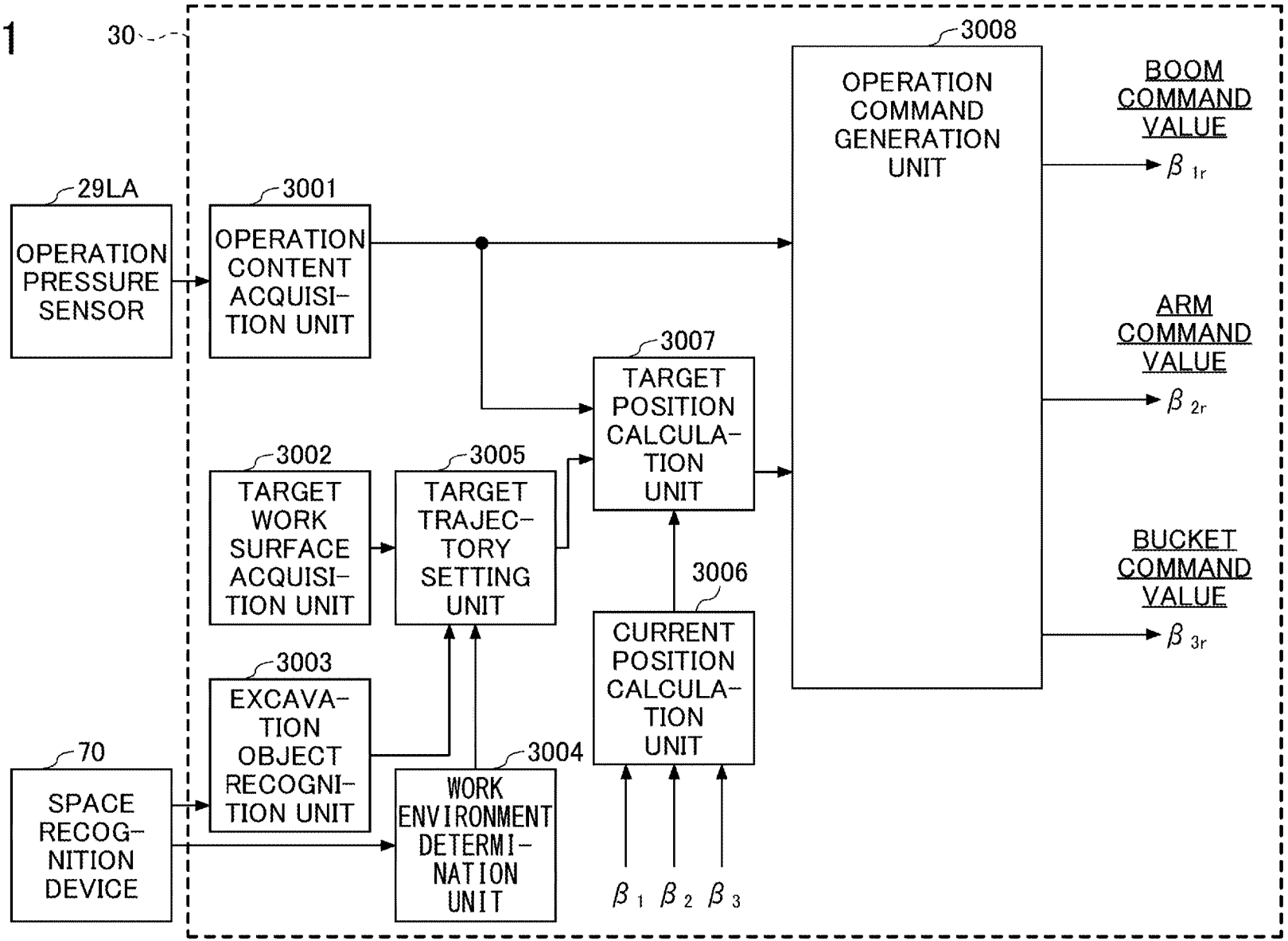
FIG. 11 is a functional block diagram illustrating an example of a functional configuration for a machine control function of the shovel.

FIG. 11 is a functional block diagram illustrating an example of a functional configuration related to a machine control function of the shovel 100 according to another embodiment. Specifically, FIG. 11 is a functional block diagram illustrating a specific example of a functional configuration related to the operation-assisted machine control function of the shovel 100.

The controller 30 includes an operation content acquisition unit 3001, a target work surface acquisition unit 3002, an excavation object recognition unit 3003, a work environment determination unit 3004, a target trajectory setting unit 3005, a current position calculation unit 3006, a target position calculation unit 3007, and an operation command generation unit 3008 as functional units related to the operation-assisted machine control function.

The operation content acquisition unit 3001 acquires an operation content related to an operation (that is, a tilting operation in the front-rear direction) of the arm 5 in the left operation lever 26L based on a detection signal taken in from the operation sensor 29LA. For example, the operation content acquisition unit 3001 acquires (calculates) the operation direction (the arm opening operation or the arm closing operation) and the operation amount as the operation content.

For example, the target work surface acquisition unit 3002 acquires data related to the target work surface from an internal memory, a predetermined external storage device, or the like. The data relating to the target work surface may be manually input by the operator through the input device 72, for example, or may be input (received) from the management device or the like through the communication device T1.

The excavation target recognition unit 3003 recognizes the shape of the ground as an excavation target based on the output of the space recognition device 70.

The excavation target recognition unit 3003 may recognize the shape of the ground surface as an excavation target based on an output of a space recognition device outside the shovel 100. The space recognition device outside the shovel 100 may include, for example, a space recognition device fixed to a utility pole or the like at a construction site or a space recognition device mounted on a drone (for example, a multicopter) flying over a construction site. In addition, the excavation target recognition unit 3003 may recognize the shape of the ground as the excavation target based on the movement trajectory of the work part of the bucket 6 at the time of the immediately previous (the most recent) excavation.

The work environment determination unit 3004 determines (specifies) the work environment of the shovel 100 for setting the target trajectory. The work environment of the shovel 100 includes a type of work site, a type of work target, a type of weather, and the like. The type of work target includes the type (difference) of the soil quality, hardness, and the like of the ground.

For example, the work environment determination unit 3004 determines (specifies) the work portion of the shovel 100. Specifically, the work environment determination unit 3004 may specify one work site from among a plurality of work site candidates registered in advance on the basis of an output of the space recognition device 70 (an example of an acquisition device) and on the basis of a captured image of the work site and three dimensional data of topography. The work environment determination unit 3004 may communicate with a predetermined device installed in the work site through the communication device T1 and determine (specify) the work site based on a signal returned from the device.

In addition, the work environment determination unit 3004 may determine the soil quality, hardness, weather, or the like of the ground of the work target in detail using the output or the like of the space recognition device 70, for example.

The target trajectory setting unit 3005 sets a target trajectory of a work part (control reference) of the bucket 6 based on the shape of the excavation target (ground surface) recognized by the excavation target recognition unit 3003, the determination result of the work environment determination unit 3004, data related to the target work surface, and the like. For example, when rough excavation is performed in a state in which the distance between the actual landform and the target work surface is relatively large, the target trajectory setting unit 3005 sets the target trajectory of the work part of the bucket 6 within a range that does not go below the target work surface. The target trajectory setting unit 3005 sets the target trajectory of the work part of the bucket 6 so that the work part of the bucket 6 moves along the target work surface, for example, when finishing excavation work is performed or when leveling work or rolling work is performed in a state where the distance between the actual topography and the target work surface is relatively small. A method of setting the target trajectory during excavation will be described later (see FIGS. 13 and 14).

The current position calculation unit 3006 calculates a control reference position (current position) of the bucket 6. To be more specific, the current position calculation unit 3006 may calculate the control reference position of the bucket 6 based on the boom angle $\beta_1$, the arm angle $\beta_2$, and the bucket angle $\beta_3$ acquired based on the outputs of the boom angle sensor S1, the arm angle sensor S2, and the bucket angle sensor S3.

The target position calculation unit 3007 calculates the control reference target position of the bucket 6 based on the operation content (operation direction and operation amount) related to the operation of the arm 5 in the left operation lever 26L, the information related to the set target trajectory, and the control reference current position of the bucket 6. The target position is a position on a target work surface (in other words, a target trajectory) to be an arrival target in the current control cycle when it is assumed that the arm 5 operates in accordance with the operation direction and the operation amount of the arm 5 in the left operation lever 26L. The target position calculation unit 3007 may calculate the control reference target position of the bucket 6 using, for example, a map, an arithmetic expression, or the like stored in advance in a non-volatile internal memory or the like.

The operation command generation unit 3008 generates a command value $\beta_{1r}$ related to the operation of the boom 4

(hereinafter referred to as a "boom command value"), a command value $\beta_{2r}$ related to the operation of the arm 5 (hereinafter referred to as an "arm command value"), and a command value $\beta_{3r}$ related to the operation of the bucket 6 (hereinafter referred to as a "bucket command value") based on the target position of the control reference of the bucket 6. For example, the boom command value $\beta_{1r}$, the arm command value $\beta_{2r}$, and the bucket command value $\beta_{3r}$ are a boom angle, an arm angle, and a bucket angle, respectively, when the control reference of the bucket 6 can realize the target position. As a result, the controller 30 can realize a machine control function by converting the boom command value $\beta_{1r}$, the arm command value $\beta_{2r}$, and the bucket command value $\beta_{3r}$ into operation commands for the boom 4, the arm 5, and the bucket 6 and controlling the hydraulic control valve 32.

It should be noted that the boom command value, the arm command value, and the bucket command value may be angular velocities or angular accelerations of the boom 4, the arm 5, and the bucket 6 required for the control reference of the bucket 6 to realize the target position.

[Configuration Regarding Fully Automatic Machine Control Function]

Next, with reference to FIG. 12, a functional configuration related to a fully automatic machine control function (fully automatic operation function) will be described.

FIG. 12 is a functional block diagram illustrating another example of the functional configuration related to the machine control function of the shovel 100 according to another embodiment. Specifically, FIG. 12 is a diagram illustrating a specific example of a functional configuration related to a fully automatic machine control function of the shovel 100. Hereinafter, portions different from the above-described example (FIG. 11) will be mainly described.

In this example, the controller 30 realizes a fully automatic machine control function (autonomous driving function) in response to a signal received from a predetermined external device (for example, a management device or the like) by the communication device T1.

The controller 30 includes a work start determination unit 3001A, an operation content determination unit 3001B, an operation condition setting unit 3001C, and an operation start determination unit 3001D as functional units related to the machine control function. As in the case of the above-described example (FIG. 11), the controller 30 includes, as functional units related to the machine control function, a target work surface acquisition unit 3002, an excavation object recognition unit 3003, a work environment determination unit 3004, a target trajectory setting unit 3005, a current position calculation unit 3006, a target position calculation unit 3007, and an operation command generation unit 3008.

The work start determination unit 3001A determines the start of a predetermined work of the shovel 100. The predetermined work is, for example, excavation work or the like. For example, when a start command is input from an external device through the communication device T1, the work start determination unit 3001A determines the start of the work designated by the start command. In addition, in a case where a start command is input from an external device through the communication device T1, the work start determination unit 3001A may determine the start of the work designated by the start command when it is determined by the periphery monitoring function that there is no object to be monitored in the monitoring range around the shovel 100.

When the start of work is determined by the work start determination unit 3001A, the operation content determination unit 3001B determines the current operation content. For example, the operation content determination unit 3001B determines whether or not the shovel 100 is performing an operation corresponding to a plurality of operations constituting the predetermined work based on the current position of the control reference of the bucket 6. For example, the plurality of operations constituting the predetermined work include an excavation operation, a boom raising and turning operation, a dumping operation, a boom lowering and turning operation, and the like, in a case where the predetermined work is excavation work.

The operation condition setting unit 3001C sets an operation condition related to execution of a predetermined work by the autonomous driving function. For example, when the predetermined work is excavation work, the operation condition may include a condition related to an excavation depth, an excavation length, or the like.

The operation start determination unit 3001D determines the start of a predetermined operation constituting the predetermined work determined to be started by the work start determination unit 3001A. The operation start determination unit 3001D may determine that the excavation operation can be started, for example, when the operation content determination unit 3001B determines that the boom lowering turning operation has ended and the control reference (claw tip) of the bucket 6 has reached the excavation start position. When it is determined that the excavation work can be started, the operation start determination unit 3001D causes the target position calculation unit 3007 to input operation commands for operation elements (actuators) corresponding to the autonomous driving function generated in accordance with the setup of the predetermined work. Thus, the target position calculation unit 3007 can calculate the target position of the work part (control reference) of the bucket 6 in accordance with the operation command corresponding to the autonomous driving function.

As described above, in this example, the controller 30 can cause the shovel 100 to autonomously perform a predetermined operation (for example, an excavation operation) on the basis of a fully automatic machine control function (autonomous driving function).

[Method of Setting Target Trajectory of Bucket at Time of Excavation]

Next, with reference to FIGS. 13 and 14, a description will be given of a method of setting a target function of a work part (claw tip) of the bucket 6 during excavation.

Figure 13:
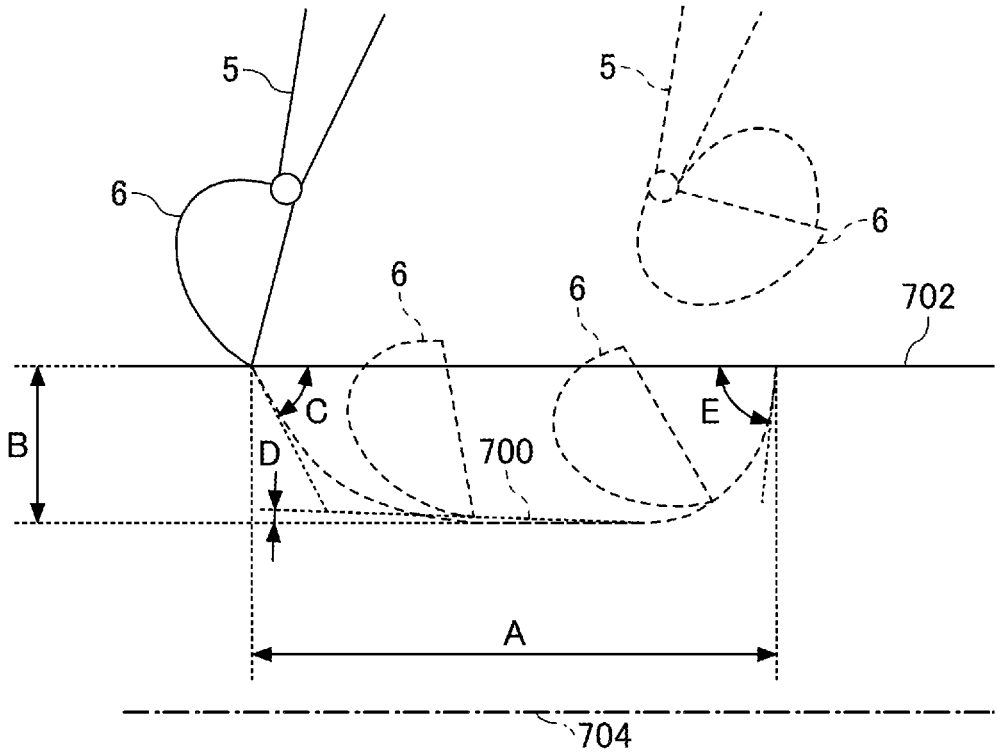
FIG. 13 is a diagram illustrating an example of a parameter for a trajectory of a claw tip of the bucket during excavation.

FIG. 13 is a diagram illustrating an example of parameters related to a trajectory 700 of the claw tip of the bucket 6 during excavation. In FIG. 13, the trajectory 700 of the claw tip of the bucket 6 during excavation is represented by a broken line. FIG. 14 is a diagram illustrating an example of table information (table information 800) related to parameters for each work site.

In this example, the controller 30 (the target trajectory setting unit 3005) sets the target trajectory of the work part (the claw tip) of the bucket 6 at the time of excavation by setting a parameter related to the trajectory of the claw tip of the bucket 6 at the time of excavation with reference to a predetermined template.

For example, as illustrated in FIG. 13, the controller 30 sets a part or all of the parameters A to E, thereby setting the target trajectory of the work part (claw tip) of the bucket 6 during excavation. The parameters A and B are parameters that define the dimensions of the trajectory 700 of the bucket 6 with respect to the ground 702 during excavation.

The trajectory 700 corresponding to the target trajectory of the bucket 6 during excavation is set in a range above the target work surface 704 or along the target work surface 704. That is, the trajectory 700 corresponding to the target trajectory of the bucket 6 during excavation is set so as not to go below the target work surface 704 as described above. In addition, as described above, the controller grasps the shape of the ground 702 which is the excavation target based on the output of the space recognition device 70. In addition, as described above, the controller 30 may grasp the shape of the ground 702 which is an excavation target based on an output of a space recognition device installed outside the shovel 100, for example, a multicopter, a utility pole, or the like instead of the space recognition device 70. In addition, as described above, the controller 30 may grasp the shape of the ground 702 which is the excavation target on the basis of the trajectory of the work site (for example, the tip of the bucket 6) at the time of the previous excavation.

The parameter A represents the excavation length. The excavation length means a length (distance) in the horizontal direction from when the claw tip of the bucket 6 penetrates the ground 702 to when the claw tip of the bucket 6 is separated from the ground by scooping up earth and sand.

The parameter B represents the excavation depth. The excavation depth means the depth to the deepest point from the ground 702 in the trajectory of the claw tip of the bucket 6 during excavation.

The parameters C to E are parameters that define the angle of the trajectory of the bucket 6 with respect to the reference surface during excavation.

The parameter C represents the penetration angle. The penetration angle means an angle formed by a horizontal plane or a trajectory with respect to the ground 702 when the claw tip of the bucket 6 penetrates the ground 702.

The parameter D represents the horizontal pulling angle. The horizontal pulling angle means an angle formed by the trajectory with respect to the horizontal plane or the ground 702 in a state (during horizontal pulling) in which the movement of the bucket 6 in the horizontal direction is dominant between the time when the claw tip of the bucket 6 penetrates into the ground 702 and the time when the bucket 6 is lifted from the ground 702.

The parameter E represents the scooping angle. The scooping angle means an angle formed by a horizontal plane or a trajectory with respect to the ground 702 when the tip of the bucket 6 is separated from the ground 702 when the bucket 6 scoops earth and sand.

The target trajectory setting unit 3005 may simply set the target trajectory of the claw tip of the bucket 6 by setting the parameters A and B, for example. The target trajectory setting unit 3005 may set a more detailed target trajectory of the claw tip of the bucket 6, for example, by setting at least one of the parameters C to E in addition to the parameters A and B. That is, by setting some or all of the parameters A to E, the target trajectory setting unit 3005 changes the trajectory of the template in accordance with the setting contents of the parameters A to E and sets the target trajectory.

It should be noted that the target trajectory setting unit 3005 may set another parameter instead of or in addition to the parameters A to E to change the trajectory of the template in accordance with the setting content of another parameter and set the target trajectory. The other parameters may include, for example, a relative attitude angle of the bucket 6 with respect to the ground or the trajectory of the claw tip. In this case, for example, one or a plurality of parameters corresponding to the attitude angle of the bucket 6 at the time of penetration of the claw tip of the bucket 6 into the ground, at the time of horizontal pulling, at the time of scooping, or the like may be defined.

The target trajectory setting unit 3005 sets a part or all of the parameters A to E based on the determination result of the work environment determination unit 3004, that is, in accordance with the work environment of the shovel 100.

For example, the target trajectory setting unit 3005 may set the parameters A to E depending on the work site determined (specified) by the work environment determination unit 3004. Specifically, the target trajectory setting unit 3005 may set the parameters A to E in accordance with the work site specified by the work environment determination unit 3004 using table information in which the parameters A to E for each work site are defined. The table information is received from, for example, a predetermined external device (for example, a management device) through the communication device T1, and is stored in, for example, an internal memory (an example of a storage device) of the controller 30 such as an auxiliary storage device or an external storage device (an example of a storage device) communicable with the controller 30.

For example, as illustrated in FIG. 14, the table information 800 defines values of parameters A to E for each work site.

To be more specific, at the work site of "No. 1", the parameter A, the parameter B, the parameter C, the parameter D, and the parameter E are defined as a predetermined value PA1, a predetermined value PB1, a predetermined value PC1, a predetermined value PD1, and a predetermined value PE1, respectively.

When the work environment determination unit 3004 determines that the work site of the shovel 100 is the site of "No. 1", the target trajectory setting unit 3005 may refer to the table information 800 and set the above-described parameters A to E to the above-described predetermined values PA1 to PE1.

In addition, at the work site of "No. 2", the parameter A, the parameter B, the parameter C, the parameter D, and the parameter E are defined as a predetermined value PA2, a predetermined value PB2, a predetermined value PC2, a predetermined value PD2, and a predetermined value PE2, respectively.

When the work environment determination unit 3004 determines that the work site of the shovel 100 is the site of "No. 2", the target trajectory setting unit 3005 may refer to the table information 800 and set the above-described parameters A to E to the above-described predetermined values PA2 to PE2.

In addition, at the work site of "No. 3", the parameter A, the parameter B, the parameter C, the parameter D, and the parameter E are defined as a predetermined value PA3, a predetermined value PB3, a predetermined value PC3, a predetermined value PD3, and a predetermined value PE3, respectively.

When the work environment determination unit 3004 determines that the work site of the shovel 100 is the site of "No. 3", the target trajectory setting unit 3005 may refer to the table information 800 and set the above-described parameters A to E to the above-described predetermined values PA3 to PE3.

The values of the parameters A to E for each work site in the table information 800 are defined in advance in consideration of work efficiency, energy consumption efficiency, machine damage level, and the like in accordance with characteristics (soil quality, ground hardness, and the like) for each work site. Thus, by using the table information 800, the controller 30 can cause the shovel 100 to perform more efficient work in terms of work efficiency, energy consumption efficiency, degree of mechanical damage, and the like in accordance with the work environment of the work site of the shovel 100.

For example, when the ground (excavation target) of the work site is relatively hard, the value of the parameter B (excavation depth) is defined to be relatively small, and the parameter A (excavation length) is defined to be relatively large (long). This is because the shovel 100 cannot excavate deeply due to the hardness of the object to be excavated, but a relatively long excavation length is secured to secure an excavation volume. Further, for example, in this case, the parameter C (penetration angle) is defined to be relatively close to perpendicular to the ground. This is to maximize the force acting on the ground in the vertical direction.

In addition, for example, when the ground surface (excavation target) of the work site is relatively soft, the excavation depth is defined to be relatively large, that is, to be close to a predetermined maximum value, and the excavation length is defined to be relatively small (short). This is because the shovel 100 can excavate more deeply depending on the softness of the excavation target.

The target trajectory setting unit 3005 may update the parameters A to E by performing reinforcement learning related to the parameters A to E in accordance with the progress of the actual excavation work with the parameters A to E set based on the table information 800 as a starting point. For example, the target trajectory setting unit 3005 performs reinforcement learning regarding the parameters A to E and updates the parameters A to E in accordance with the progress of the actual work so as to maximize the work time, the energy consumption rate (for example, the fuel consumption rate), the degree of mechanical damage, and the like as the evaluation index (reward). Thus, the controller 30 can update the parameters A to E in accordance with the actual work environment of the work site.

As described above, in this example, the controller 30 sets predetermined parameters (for example, the parameters A to E) related to the trajectory of the bucket 6 during excavation, and sets the target trajectory of the bucket 6 (for example, the target trajectory of the claw tip) on the basis of the predetermined parameters.

Thus, the controller 30 can set the target trajectory of the bucket 6 by setting the predetermined parameter. Therefore, the controller 30 can automatically and easily set the target trajectory of the bucket 6 in accordance with, for example, the work environment of the work site of the shovel 100.

In addition, in the present example, the predetermined parameter is set based on a type of work environment of the shovel 100 including a type of work site of the shovel 100 or a type of excavation target.

Thus, the controller 30 can specifically set the target trajectory of the bucket 6 in accordance with the work environment of the shovel 100. The target trajectory may include a target surface (design surface) serving as a construction target.

In the present example, the predetermined parameter is learned so that the evaluation index related to the excavation work becomes relatively high when the excavation work is actually executed.

Accordingly, the controller 30 can update the predetermined parameter to more appropriate content in accordance with the actual work environment of the shovel 100.

In the present example, the predetermined parameter includes at least one of a parameter (for example, parameters A and B) related to the dimension of the trajectory of the claw tip of the bucket 6 during excavation with respect to the ground surface, a parameter (for example, parameters C to D) related to the angle of the trajectory of the claw tip of the bucket 6 during excavation with respect to the reference surface, and a parameter related to the attitude of the bucket 6 during excavation.

Thus, for example, the controller 30 can specifically set the target trajectory of the claw tip of the bucket 6 during excavation by changing the template representing the predetermined trajectory in accordance with the setting content of the predetermined parameter.

Further, in this example, the controller 30 sets the predetermined parameter based on the information on the work environment of the shovel 100 acquired by the space recognition device 70.

As a result, the controller 30 can determine the work environment (work site) of the shovel 100 based on the output of the space recognition device 70, and specifically set a predetermined parameter in accordance with the work environment.

For example, the controller 30 sets a predetermined parameter in accordance with the work environment of the shovel 100 by using information (for example, table information 800) related to the predetermined parameter for each work environment of the shovel 100 stored in the internal memory or the like.

Thus, the controller 30 can specifically set a predetermined parameter in accordance with the work environment of the shovel 100.

The preferred embodiments of the present invention have been described above in detail. However, the present invention is not limited to the embodiments described above. Various modifications, substitutions, or the like can be applied to the above-described embodiments without departing from the scope of the present invention. In addition, features described separately may be combined as long as no technical contradiction arises.

The invention claimed is:

1. A shovel comprising:

a lower traveling body;

an upper turning body turnably mounted on the lower traveling body;

an attachment attached to the upper turning body, the attachment including a bucket; and a hardware processor configured to change a working angle formed by a plane or a line determined based on a shape of the bucket and a target surface, wherein the hardware processor is configured to change the working angle in accordance with a positional relationship between the bucket and the target surface during execution of a machine control function, and wherein the hardware processor is configured to change a target angle relating to the working angle in accordance with a change in a distance between the bucket and the target surface and a change in an operation speed of the bucket, and to control the working angle to follow the changed target angle.

2. The shovel according to claim 1, wherein the hardware processor is configured to control the attachment to close the bucket as the bucket at a position higher than the target surface approaches the target surface.

3. The shovel according to claim 1, wherein the hardware processor is configured to control the attachment to open the bucket as the bucket at a position lower than the target surface approaches the target surface.

4. The shovel according to claim 1, wherein the hardware processor is configured to set a predetermined angle or a predetermined dimension relating to a trajectory of the bucket during excavation, and to set a target trajectory of the bucket based on the predetermined angle or the predetermined dimension, and wherein the target trajectory includes the target surface.

5. The shovel according to claim 4, wherein the hardware processor is configured to set the predetermined angle or the predetermined dimension based on a working environment of the shovel, the working environment including a type of work site of the shovel or a type of excavation target.

6. The shovel according to claim 4, wherein the hardware processor is configured to learn the predetermined angle or the predetermined dimension so that an evaluation index relating to an excavation work increases as the excavation work is actually performed.

7. The shovel according to claim 4, wherein the predetermined dimension includes a dimension of the trajectory of the bucket with respect to a ground during excavation, and the predetermined angle includes an angle of the trajectory of the bucket with respect to a reference surface during excavation.

8. The shovel according to claim 1, wherein the hardware processor is configured to set a predetermined angle or a predetermined dimension relating to a trajectory of the bucket during excavation, and to set a target trajectory of the bucket based on the predetermined angle or the predetermined dimension.

9. The shovel according to claim 8, wherein the hardware processor is configured to learn the predetermined angle or the predetermined dimension so that an evaluation index relating to an excavation work increases as the excavation work is actually performed.

10. A control device for a shovel, the shovel including a lower traveling body, an upper turning body turnably mounted on the lower traveling body, and an attachment attached to the upper turning body and including a bucket, the control device comprising:

a hardware processor configured to change a working angle formed by a plane or a line determined based on a shape of the bucket and a target surface in accordance with a position relationship between the bucket and the target surface, wherein the hardware processor is configured to change a target angle relating to the working angle in accordance with a change in a distance between the bucket and the target surface and a change in an operation speed of the bucket, and to control the working angle to follow the changed target angle.

11. The shovel according to claim 1, wherein the hardware processor is configured to change the target angle based on a correspondence between the target angle, the operation speed, and the distance, the correspondence being set such that a ratio of an increase in the target angle to an increase in the distance increases as the operation speed increases.

12. The shovel according to claim 1, wherein the hardware processor is configured to change the target angle based on a correspondence between the target angle, the operation speed, and the distance, the correspondence being set such that the target angle increases as an absolute value of the distance increases and the target angle increases as an absolute value of the operation speed increases when the bucket is at a position higher than the target surface and that the target angle decreases as an absolute value of the distance increases and the target angle decreases as an absolute value of the operation speed increases when the bucket is at a position lower than the target surface.

13. The shovel according to claim 12, wherein the correspondence is set such that the target angle becomes a predetermined value regardless of the operation speed when the distance is zero.

14. The shovel according to claim 12, wherein the correspondence is stored as a database or expressed using a mathematical expression.

15. The shovel according to claim 1, wherein the target surface is a design surface whose data is stored in a storage.

16. The shovel according to claim 1, wherein the distance between the bucket and the target surface is a distance between a predetermined point on the bucket and the target surface, and the hardware processor is configured to cause the predetermined point to differ depending on an attitude of the bucket changes as the distance changes.

17. The shovel according to claim 1, wherein the distance between the bucket and the target surface is a distance between a predetermined point on the bucket and an intersection of the target surface and a circumference of a circle centered at a boom foot pin and passing through the predetermined point.

18. The shovel according to claim 7, wherein the dimension of the trajectory of the bucket with respect to the ground includes an excavation length and an excavation depth, and the angle of the trajectory of the bucket with respect to the reference surface includes a penetration angle, a horizontal pulling angle, and a scooping angle.

19. The shovel according to claim 8, wherein the predetermined angle or the predetermined dimension is predefined for each of different types of work site or each of different types of excavation target.

20. The shovel according to claim 8, wherein the hardware processor is configured to update the predetermined angle or the predetermined dimension by performing reinforcement learning related to the predetermined angle or the predetermined dimension as actual work of the shovel progresses, so as to maximize an evaluation index as a reward.

* * * * *